US006947060B2

(12) United States Patent
Abe

(10) Patent No.: US 6,947,060 B2
(45) **Date of Patent: *Sep. 20, 2005**

(54) IMAGE FORMING APPARATUS, ELECTRON BEAM APPARATUS, MODULATION CIRCUIT, AND IMAGE-FORMING APPARATUS DRIVING METHOD

(75) Inventor: Naoto Abe, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,980

(22) Filed: Feb. 12, 1999

(65) Prior Publication Data

US 2003/0095085 A1 May 22, 2003

(30) Foreign Application Priority Data

Feb. 16, 1998 (JP) ..... 10-033369
May 8, 1998 (JP) ..... 10-126460
Feb. 10, 1999 (JP) ..... 11-032255

(51) Int. Cl.[7] ..... G09G 5/10

(52) U.S. Cl. ..... 345/691; 345/77; 345/89; 345/208

(58) Field of Search ..... 345/74.1, 690–693, 345/204–211, 75.1, 75.2, 87, 88, 89, 98, 99, 100, 76–83; 315/169.3, 169.4; 348/371–675; G09G 3/20, 3/36, 5/10; H04N 5/202

(56) References Cited

U.S. PATENT DOCUMENTS 4,916,747 A * 4/1990 Arimoto ..... 382/298
5,379,126 A * 1/1995 Seto et al. ..... 358/456
5,488,487 A * 1/1996 Ojima et al. ..... 358/298
5,666,132 A * 9/1997 Ochi et al. ..... 345/96
5,677,725 A * 10/1997 Honbo et al. ..... 347/252
5,742,247 A * 4/1998 Chujo ..... 341/144
5,767,823 A 6/1998 Hush ..... 345/55
5,929,835 A * 7/1999 Sakamoto ..... 345/589
6,278,234 B1 * 8/2001 Ono et al. ..... 313/495
6,300,922 B1 * 10/2001 Teggatz ..... 345/75.2
2004/0174388 A1 * 9/2004 Sempel et al. ..... 345/691

FOREIGN PATENT DOCUMENTS

EP 0 150 991 8/1985
EP 0 402 983 12/1990
EP 0 421 712 A2 * 4/1991
EP 0 421 712 B1 * 5/1997
EP 0 838 800 4/1998
FR 2 739 712 4/1997
GB 2 204 174 11/1988
JP 53-105317 9/1978
JP 54-137232 10/1979

(Continued)

OTHER PUBLICATIONS

Office Action of Japanese Patent Application No. 11–032255 (Dated Sep. 17, 1999).

European Search Report (No. 2638130) dated Jun. 16, 1999.

*Primary Examiner*—Alexander Eisen
(74) *Attorney, Agent, or Firm*—Fitzpatrick, Cella, Harper & Scinto

(57) ABSTRACT

An image forming apparatus which performs pulsewidth modulation with a pulsewidth set by counting a clock. Especially, for grayscale level correction by setting the frequency of the clock, the periodic clock is counted, and an output pattern is changed in accordance with a count value of the clock. Otherwise, information corresponding to a clock pattern is stored in advance, and the information is sequentially read and used as a clock. Otherwise, a clock source in which the frequency is controlled by a control signal is used.

7 Claims, 40 Drawing Sheets

FOREIGN PATENT DOCUMENTS

| | | | | | |
|---|---|---|---|---|---|
| JP | 61-109316 | | | 5/1986 | |
| JP | 63-71889 | | | 4/1988 | |
| JP | 1-209493 | | | 8/1989 | |
| JP | 2-4004 | | | 1/1990 | |
| JP | 2-135421 | | | 5/1990 | |
| JP | 02135421 | A | * | 5/1990 | ..... G09G/3/36 |
| JP | 4-97277 | | | 3/1992 | |
| JP | 4-138495 | | | 5/1992 | |
| JP | 5-241526 | | | 9/1993 | |
| JP | 05-241526 | | * | 9/1993 | ..... G09G/3/02 |
| JP | 05241526 | A | * | 9/1993 | ..... G09G/3/02 |
| JP | 5-249920 | | | 9/1993 | |
| JP | 6-180562 | | | 6/1994 | |
| JP | 07-248748 | | | 9/1995 | |
| JP | 7-306660 | | | 11/1995 | |
| JP | 8-137427 | | | 5/1996 | |
| JP | 08-160921 | | | 6/1996 | |

* cited by examiner

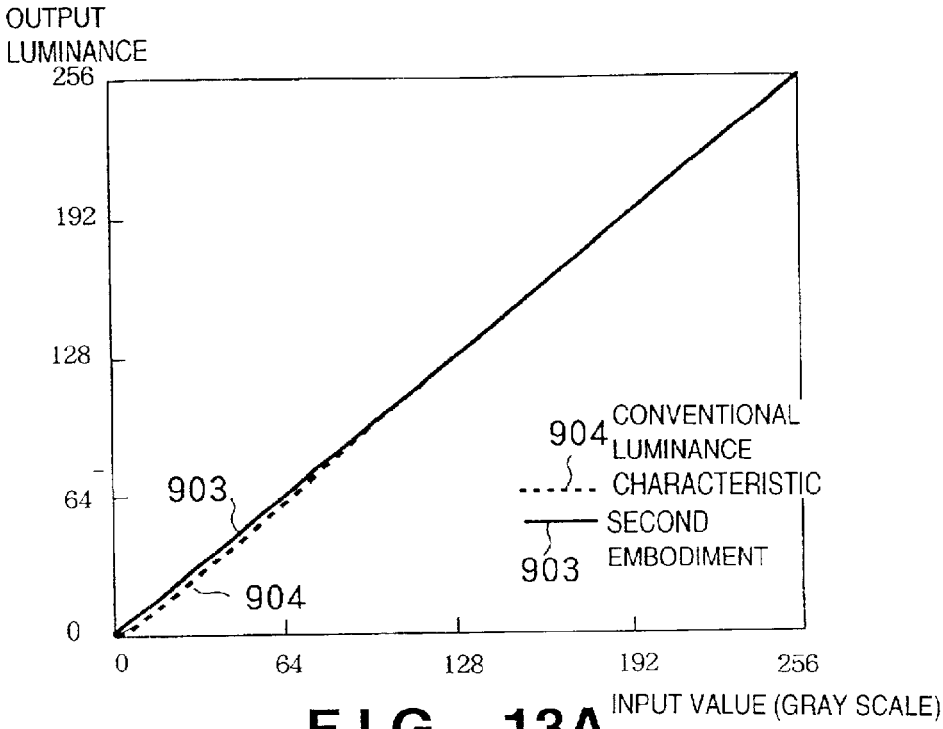
FIG. 13A
FIG. 13B
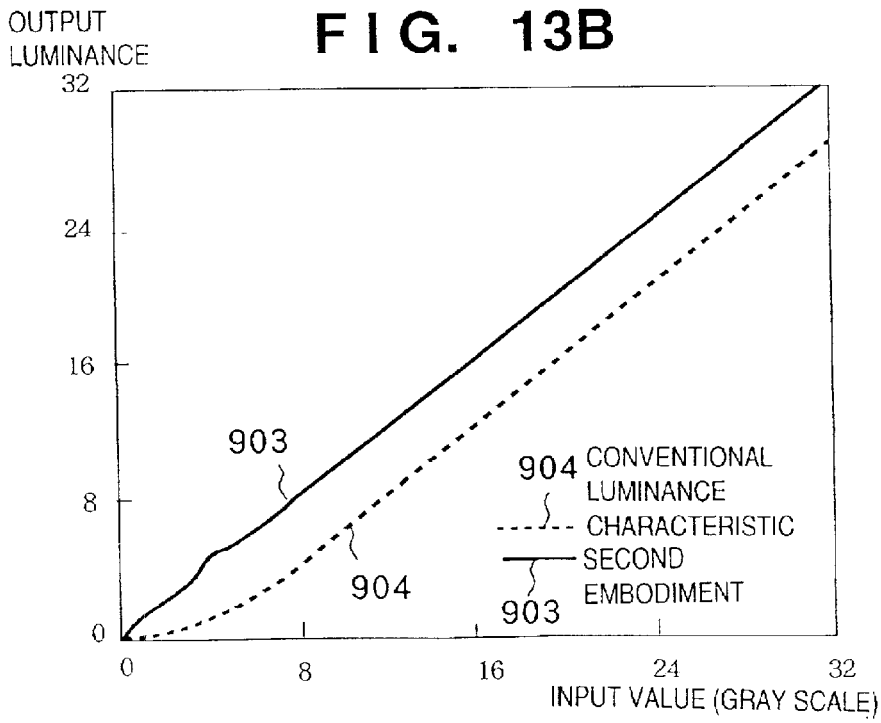

ADDRESSES OF ROM IN WHICH "H" LEVEL DATA IS STORED
( "L" LEVEL DATA ARE STORED AT OTHER ADDRESS )

| |
|---|
| 0 |
| 6 |
| 9 |
| 12 |
| 15 |
| 17 |
| 17-519 (ODD NUMBER ADDRESSES) |

TABLE SHOWING ADDRESSES OF "1" DATA
("0" DATA ARE STORED AT OTHER ADDRESSES)

FIG. 32

| | | | | | | | | | | | | |
|---|---|---|---|---|---|---|---|---|---|---|---|---|
| 0 | 40 | 86 | 152 | 240 | 350 | 484 | 640 | 820 | 1026 | 1256 | 1516 | 1800 |
| 2 | 42 | 90 | 156 | 246 | 356 | 490 | 648 | 830 | 1038 | 1270 | 1530 | 1816 |
| 4 | 44 | 92 | 160 | 250 | 362 | 498 | 656 | 840 | 1048 | 1284 | 1544 | 1830 |
| 6 | 46 | 96 | 164 | 256 | 368 | 506 | 666 | 850 | 1060 | 1296 | 1558 | 1846 |
| 8 | 48 | 98 | 168 | 260 | 374 | 512 | 674 | 860 | 1070 | 1308 | 1572 | 1860 |
| 10 | 50 | 102 | 172 | 266 | 382 | 520 | 682 | 870 | 1082 | 1320 | 1584 | 1876 |
| 12 | 52 | 104 | 176 | 272 | 388 | 528 | 692 | 880 | 1094 | 1332 | 1598 | 1892 |
| 14 | 54 | 108 | 182 | 276 | 394 | 536 | 700 | 890 | 1104 | 1346 | 1612 | 1906 |
| 16 | 56 | 110 | 186 | 282 | 400 | 542 | 710 | 900 | 1116 | 1358 | 1626 | 1922 |
| 18 | 58 | 114 | 190 | 288 | 408 | 550 | 718 | 910 | 1128 | 1372 | 1642 | 1938 |
| 20 | 62 | 118 | 194 | 292 | 414 | 558 | 728 | 920 | 1140 | 1384 | 1656 | 1954 |
| 22 | 64 | 120 | 198 | 298 | 420 | 566 | 736 | 930 | 1150 | 1396 | 1670 | 1968 |
| 24 | 66 | 124 | 202 | 304 | 428 | 574 | 746 | 942 | 1162 | 1410 | 1684 | 1984 |
| 26 | 68 | 128 | 208 | 310 | 434 | 582 | 754 | 952 | 1174 | 1424 | 1698 | 2000 |
| 28 | 70 | 130 | 212 | 316 | 440 | 590 | 764 | 962 | 1186 | 1436 | 1712 | 2016 |
| 30 | 74 | 134 | 216 | 320 | 448 | 598 | 774 | 972 | 1198 | 1450 | 1728 | 2032 |
| 32 | 76 | 138 | 222 | 326 | 454 | 606 | 782 | 984 | 1210 | 1462 | 1742 | 2048 |
| 34 | 78 | 142 | 226 | 332 | 462 | 614 | 792 | 994 | 1222 | 1476 | 1756 | |
| 36 | 82 | 146 | 230 | 338 | 468 | 622 | 802 | 1004 | 1234 | 1490 | 1772 | |
| 38 | 84 | 150 | 236 | 344 | 476 | 632 | 810 | 1016 | 1246 | 1502 | 1786 | |

| COUNTER VALUE | FREQUENCY DIVISION RATIO |
|---|---|
| 0 ~ 63 | 1 / 1 |
| 64 ~ 191 | 1 / 2 |
| 192 ~ 703 | 1 / 4 |

FIG. 40

| COUNTER VALUE | FREQUENCY DIVISION RATIO |
|---|---|
| 0 ~ 47 | 1 / 1 |
| 48 ~ 111 | 1 / 2 |
| 112 ~ 207 | 1 / 3 |
| 208 ~ 367 | 1 / 4 |
| 368 ~ 527 | 1 / 5 |
| 528 ~ 751 | 1 / 6 |
| 752 ~ 1029 | 1 / 8 |

FIG. 44

TABLE SHOWING ADDRESSES OF "1" DATA
( "0" DATA ARE STORED AT OTHER ADDRESSES )

| | | | | | | | | | | | | |
|---|---|---|---|---|---|---|---|---|---|---|---|---|
| 0 | 76 | 124 | 190 | 276 | 384 | 514 | 666 | 844 | 1046 | 1274 | 1528 | 1806 |
| 20 | 78 | 126 | 194 | 280 | 390 | 520 | 676 | 854 | 1058 | 1286 | 1540 | 1822 |
| 26 | 80 | 130 | 198 | 286 | 396 | 528 | 684 | 864 | 1068 | 1298 | 1554 | 1836 |
| 32 | 84 | 132 | 202 | 290 | 402 | 534 | 692 | 874 | 1080 | 1310 | 1568 | 1850 |
| 36 | 86 | 136 | 204 | 296 | 408 | 542 | 700 | 884 | 1090 | 1322 | 1580 | 1866 |
| 40 | 88 | 138 | 208 | 300 | 414 | 550 | 710 | 892 | 1102 | 1336 | 1594 | 1880 |
| 42 | 90 | 142 | 214 | 306 | 420 | 556 | 718 | 902 | 1112 | 1348 | 1608 | 1896 |
| 46 | 92 | 144 | 218 | 310 | 426 | 564 | 726 | 912 | 1124 | 1360 | 1622 | 1910 |
| 48 | 94 | 148 | 222 | 316 | 432 | 572 | 736 | 922 | 1134 | 1372 | 1636 | 1926 |
| 50 | 96 | 152 | 226 | 322 | 438 | 580 | 744 | 932 | 1146 | 1384 | 1650 | 1940 |
| 54 | 98 | 154 | 230 | 326 | 446 | 588 | 752 | 942 | 1158 | 1398 | 1664 | 1956 |
| 56 | 100 | 158 | 234 | 332 | 452 | 594 | 762 | 952 | 1168 | 1410 | 1678 | 1972 |
| 58 | 104 | 160 | 238 | 338 | 458 | 602 | 770 | 962 | 1180 | 1422 | 1692 | 1986 |
| 60 | 106 | 164 | 242 | 342 | 466 | 610 | 780 | 974 | 1192 | 1436 | 1706 | 2002 |
| 64 | 108 | 168 | 248 | 348 | 472 | 618 | 788 | 984 | 1204 | 1448 | 1720 | 2018 |
| 66 | 110 | 172 | 252 | 354 | 478 | 626 | 798 | 994 | 1214 | 1462 | 1734 | 2034 |
| 68 | 114 | 174 | 256 | 360 | 486 | 634 | 808 | 1004 | 1226 | 1474 | 1748 | 2048 |
| 70 | 116 | 178 | 262 | 366 | 492 | 642 | 816 | 1014 | 1238 | 1488 | 1762 | |
| 72 | 118 | 182 | 266 | 372 | 500 | 650 | 826 | 1026 | 1250 | 1500 | 1778 | |
| 74 | 122 | 186 | 270 | 378 | 506 | 658 | 836 | 1036 | 1262 | 1514 | 1792 | |

IMAGE FORMING APPARATUS, ELECTRON BEAM APPARATUS, MODULATION CIRCUIT, AND IMAGE-FORMING APPARATUS DRIVING METHOD

BACKGROUND OF THE INVENTION

1. Field of the Invention

The present invention relates to an image forming apparatus, an electron beam apparatus, a modulation circuit, and an image-forming apparatus driving method.

2. Related Background Art

Japanese Patent Application Laid-Open No. Showa 53-105317 discloses a construction to generate luminance tonality in a display panel. Further, Japanese Patent Application Laid-Open No. Showa 54-137232 discloses a matrix display apparatus which selects an output from two clock-pulse generation means having different oscillation frequencies. Further, Japanese Patent Application Laid-Open No. Heisei 7-248748 discloses a liquid crystal display apparatus where an analog amplifier having a nonlinear characteristic is used to set a pulse width for a grayscale level. Further, Japanese Patent Application Laid-Open No. Heisei 8-160921 discloses a construction to quadruple luminance modulation by spatially and temporally changing two values of a digital signal.

Further, a flat display panel having a plurality of surface-conduction (SCE) type emission devices arranged in a matrix on a substrate is known. In this display panel, row-directional scanning is performed while sequentially selecting a row-direction wiring, and a signal corresponding to an image signal is applied to a column-direction wiring in synchronization with the row-directional scanning, whereby the respective SCE-type emission devices discharge electrons in accordance with the input image signal. The emitted electrons collide with phosphor or the like, thus causing light emission.

In this display panel, a gradation image is displayed by performing pulsewidth modulation on the input image signal in correspondence with its grayscale level and applying the pulsewidth-modulated signal to a column-direction wiring.

FIG. 7 shows the waveform of a pulsewidth modulation signal inputted into the display panel. As it is apparent from FIG. 7, the rising waveform of the signal is unsharp since the capacity of column (row) direction wiring is large and the current is limited by output impedance of a driver on the signal input side. Actually, the rise time is about 1 to 2 $\mu$sec. If the display panel is driven by this pulsewidth-modulated signal, the light-emission luminance is not linear with respect to input grayscale data, as shown in FIGS. 8A and 8B. In this case, the tonality representation is degraded.

FIGS. 8A and 8B show grayscale data (8 bits: 256 levels) determining a pulsewidth on the horizontal axis, and light emission luminance normalized in 256 levels, on the vertical axis. FIG. 8B, as an enlarged view of the graph of 8A, shows "0" to "32" luminance levels. The pulsewidth for one grayscale level is about 220 nsec, and the devices are respectively driven by a pulsewidth determined by (input grayscale level)×(220 nsec). In the display-panel driving waveform as shown in FIGS. 8A and 8B, within about 1 msec rising time, the display panel hardly emits light by the input data at "0" to "3" level, as apparent from FIG. 9B.

Further, in an image display apparatus which inputs an NTSC signal then converts it into a digital signal and displays an image on a display panel, an analog television signal is temporarily converted into a digital signal, then γ correction or the like using a look-up table is performed on the digital signal, and pulsewidth modulation, for example, is performed on the digital signal for image display.

In the look-up table, input/output data is, e.g., 8-bit data. At a low-luminance grayscale level, with respect to "00H" ("H" represents a hexadecimal number) input data, "00H" data is outputted; at an intermediate grayscale level, with respect to "AAH" input data, "55H" data is outputted; at a high-luminance grayscale level, with respect to "FFH" input data, "FFH" data is outputted. The converted result is used for display as an image signal having a linear characteristic.

In the luminance conversion processing using such a look-up table, the initially intended control on luminance signal can be performed excellently, however, in use of 8-bit input/output look-up table as shown in the conventional art, as no γ-correction value exists corresponding to the minimum or lower resolution of digital data, the conversion table is generated by rounding off required output data in accordance with necessity. Accordingly, the tonality (luminance resolution) of the displayed image is reduced, and the image quality of the displayed image is degraded. For example, in the conventional γ correction, the look-up table input/output characteristic is as follows. At a low luminance level, increment in input data by 4 results in increment in output data by 1; that is, if the input data is "4" or less, the output data is rounded to "0" or "1". Accordingly, the tonality (luminance resolution) especially at a low luminance level is reduced and the image quality is degraded. In the above conventional art, the problem occurs in γ correction, however, a similar problem occurs in a similar construction when contrast conversion or the like is performed.

SUMMARY OF THE INVENTION

The present invention provides the following construction as a novel image forming apparatus.

That is, the image forming apparatus according to one aspect of the present invention is an image forming apparatus comprising: an image forming member provided to form an image; and pulsewidth modulation means for generating a pulsewidth modulation signal in accordance with an image signal, wherein the pulsewidth modulation means generates the pulsewidth modulation signal by counting pulses of a first clock signal in accordance with the image signal, and wherein an output pattern of the first clock signal is generated by selecting whether or not pulses corresponding to pulses of a second clock signal are outputted.

In the image forming apparatus, preferably, the second clock signal has a regular frequency.

Further, it is selected whether or not pulses corresponding to the pulses of the second clock signal based on whether or not the pulses of the clock signal are outputted.

Further, it may be selected whether or not pulses corresponding to the pulses of the second clock signal are outputted, in accordance with a count value obtained by counting pulses of the second clock signal.

Further, the image forming apparatus may further comprise storage means for storing information for selecting whether or not pulses corresponding to the pulses of the second clock signal are outputted.

Further, the image forming apparatus may further comprise a counter which counts pulses of the second clock signal; and selection means for selecting whether or not pulses corresponding to the pulses of the second clock signal are outputted, in accordance with output from the counter.

The selection means may have a decoder which decodes the output from the counter, or may have storage means in which the output from the counter is inputted as an address, and from which information on whether or not pulses corresponding to the pulses of the second clock signal are outputted is outputted.

Further, the image forming apparatus according to another aspect of the present invention is an image forming apparatus comprising: an image forming member provided to form an image; and pulsewidth modulation means for generating a pulsewidth modulation signal in accordance with an image signal, wherein the pulsewidth modulation means generates the pulsewidth modulation signal by counting pulses of a first clock signal in accordance with the image signal, and wherein the first clock signal is generated by reading data of pattern of the first clock signal from storage means.

In the image forming apparatus, preferably, output pattern data of the first clock signal is stored as digital data in the storage means.

Further, the storage means stores information on whether or not pulses corresponding to the pulses of a second clock signal are outputted, and wherein the information may be read in accordance with a count value of the pulse of the second clock signal.

Further, the image forming apparatus may further comprise output means for loading data corresponding to the output pattern of the first clock signal from the storage means and sequentially outputting the data. The output means may have a plurality of flip-flops which latch data corresponding to the output pattern of the first clock signal, and the flip-flops, serially connected, may sequentially output information corresponding to the output pattern of the first clock signal.

Further, the image forming apparatus according to another aspect of the present invention is an image forming apparatus comprising: an image forming member provided to form an image; and pulsewidth modulation means for generating a pulsewidth modulation signal in accordance with an image signal, wherein the pulsewidth modulation means generates the pulsewidth modulation signal by counting pulses of a first clock signal in accordance with the image signal, and wherein the first clock signal is generated by controlling an oscillation frequency of an oscillation unit which varies the oscillation frequency by a control signal.

In the image forming apparatus, the oscillation unit varies the oscillation frequency in accordance with a control voltage.

In the above-described each construction of the image forming apparatus, the first clock signal has an output pattern to increase a pulsewidth of the pulsewidth modulation signal, when an image signal corresponding to a lowest grayscale level is inputted, to be wider than a difference between pulsewidths of pulsewidth modulation signals corresponding to adjacent grayscale levels other than the lowest grayscale level.

Further, the first clock signal has an output pattern to generate the pulsewidth modulation signal while performing correction on an input image signal, in accordance with a characteristic of the image forming member.

Further, the first clock signal has an output pattern to release or mitigate γ correction status of an input image signal.

Further, the image forming member comprises a plurality of devices for forming an image by light emission, arranged in a matrix. In the plurality of devices arranged in the matrix, an device to be driven is sequentially selected by each row, and the device in the selected row is controlled by the pulsewidth modulation signal. Further, the device causes a light emitting member to emit light by emitting electrons.

Further, the image forming member forms the image by causing a light emitting member to emit light by emitting electrons emitted from electron emission device. Preferably, the device is a cold cathode electron emission device, and especially, a surface-conduction type emission device, an FE (Field Emission) type electron emission device, or an MIM (Metal/Insulator/Metal) type electron emission device.

Further, the present invention provides the following construction as a novel electron-beam apparatus.

That is, the electron-beam apparatus according to the present invention is an electron beam apparatus comprising: an electron beam source; and pulsewidth modulation means for generating a pulsewidth modulation signal as a modulation signal to control electron emission, wherein the pulsewidth modulation means generates the pulsewidth modulation signal by counting pulses of a first clock signal in accordance with an image signal, and wherein an output pattern of the first clock signal is generated by selecting whether or not pulses corresponding to the pulses of a second clock signal are outputted.

Further, the electron-beam apparatus according to another aspect of the present invention is an electron beam apparatus comprising: an electron beam source; and pulsewidth modulation means for generating a pulsewidth modulation signal as a modulation signal to control electron emission, wherein the pulsewidth modulation means generates the pulsewidth modulation signal by counting pulses of a first clock signal in accordance with an image signal, and wherein the first clock is generated by reading a pattern of the first clock signal from storage means.

Further, the electron-beam apparatus according to another aspect of the present invention is an electron beam apparatus comprising: an electron beam source; and pulsewidth modulation means for generating a pulsewith modulation signal as a modulation signal to control electron emission, wherein the pulsewidth modulation means generates the pulsewidth modulation signal by counting pulses of a first clock signal in accordance with an image signal, and wherein the first clock signal is generated by controlling an oscillation frequency of an oscillation unit which varies the oscillation frequency by a control signal.

Further, the present invention provides the following construction as a novel modulation circuit.

That is, the modulator according to the present invention is a modulation circuit which generates a pulsewidth modulation signal, wherein the pulsewidth modulation signal being generated by counting pulses of a first clock signal in accordance with an image signal, and wherein a pattern of the first clock signal being generated by selecting whether or not pulses corresponding to the pulses of a second clock signal are outputted.

Further, the modulation circuit according to another aspect of the present invention is a modulation circuit which generates a pulsewidth modulation signal, wherein the pulsewidth modulation signal being generated by counting pulses of a first clock signal in accordance with an image signal, and wherein the first clock signal being generated by reading an output pattern of the first clock signal pattern from storage means.

Further, the modulator according to another aspect of the present invention is a modulation circuit which generates a pulsewidth modulation signal, wherein the pulsewidth modulation signal being generated by counting pulses of a first clock signal in accordance with an image signal, and wherein the first clock signal being generated by controlling an oscillation frequency of an oscillation unit which varies the oscillation frequency by a control signal.

Further, the present invention provides the following construction as a novel image-forming apparatus driving method.

That is, the image-forming apparatus driving method according to the present invention is a method for driving an image forming apparatus comprising an image forming member which forms an image and pulsewidth modulation means for generating a pulsewidth modulation signal in accordance with an image signal, the method comprising: a step of generating the pulsewidth modulation signal by counting pulses of a first clock signal in accordance with the image signal, wherein an output pattern of the first clock signal is generated by selecting whether or not pulses corresponding to the pulses of a second clock signal are outputted.

Further, the image-forming apparatus driving method according to another aspect of the present invention is a method for driving an image forming apparatus comprising an image forming member which forms an image and pulsewidth modulation means for generating a pulsewidth modulation signal in accordance with an image signal, the method comprising: a step of generating the pulsewidth modulation signal by counting pulses of a first clock signal in accordance with the image signal, wherein the first clock signal is generated by reading an output pattern of the first clock signal from storage means.

Further, the image-forming apparatus driving method according to another aspect of the present invention is a method for driving an image forming apparatus comprising an image forming member which forms an image and pulsewidth modulation means for generating a pulsewidth modulation signal in accordance with an image signal, the method comprising: a step of generating the pulsewidth modulation signal by counting pulses of a first clock signal in accordance with the image signal, wherein the first clock signal is generated by controlling an oscillation frequency of an oscillation unit which varies the oscillation frequency by a control signal.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 13A and 13B are line graphs showing the relation between input data and light emission luminance according to the second embodiment;

FIG. 32 is a table showing ROM data of the PWM clock generator according to the fifth and sixth embodiments of the present invention;

FIG. 40 is a table explaining the operation of the PWM clock generator of a second modification;

FIG. 44 is a table showing the ROM data of the PWM clock generator according to eighth and ninth embodiments of the present invention.

DESCRIPTION OF THE PREFERRED EMBODIMENTS

Preferred embodiments of the present invention will be described in detail in accordance with the accompanying drawings.

An image display apparatus according to embodiments of the present invention uses a matrix image display panel. The matrix image display panel basically comprises a multiple electron beam source having a number of electron beam sources, e.g., cold cathode devices, arrayed on a substrate, and an image forming member which forms an image by electron emission, opposite to each other, within a thin vacuum container. The cold cathode devices are formed on a substrate while being precisely positioned by using photolithography etching or the like, therefore, a number of cold cathode devices can be arrayed at fine intervals. Further, in comparison with thermionic cathode devices conventionally used in a CRT or the like, the cold cathode devices themselves and peripheral parts can be driven at a comparatively low temperature, therefore, a multiple electron beam source having electron beam sources wired in a finer array pitch can be easily realized. Note that the construction and manufacturing method of the matrix image display panel will be described later.

Hereinbelow, the embodiments of the present invention will be described with reference to the drawings.

<First Embodiment>

Figure 1:
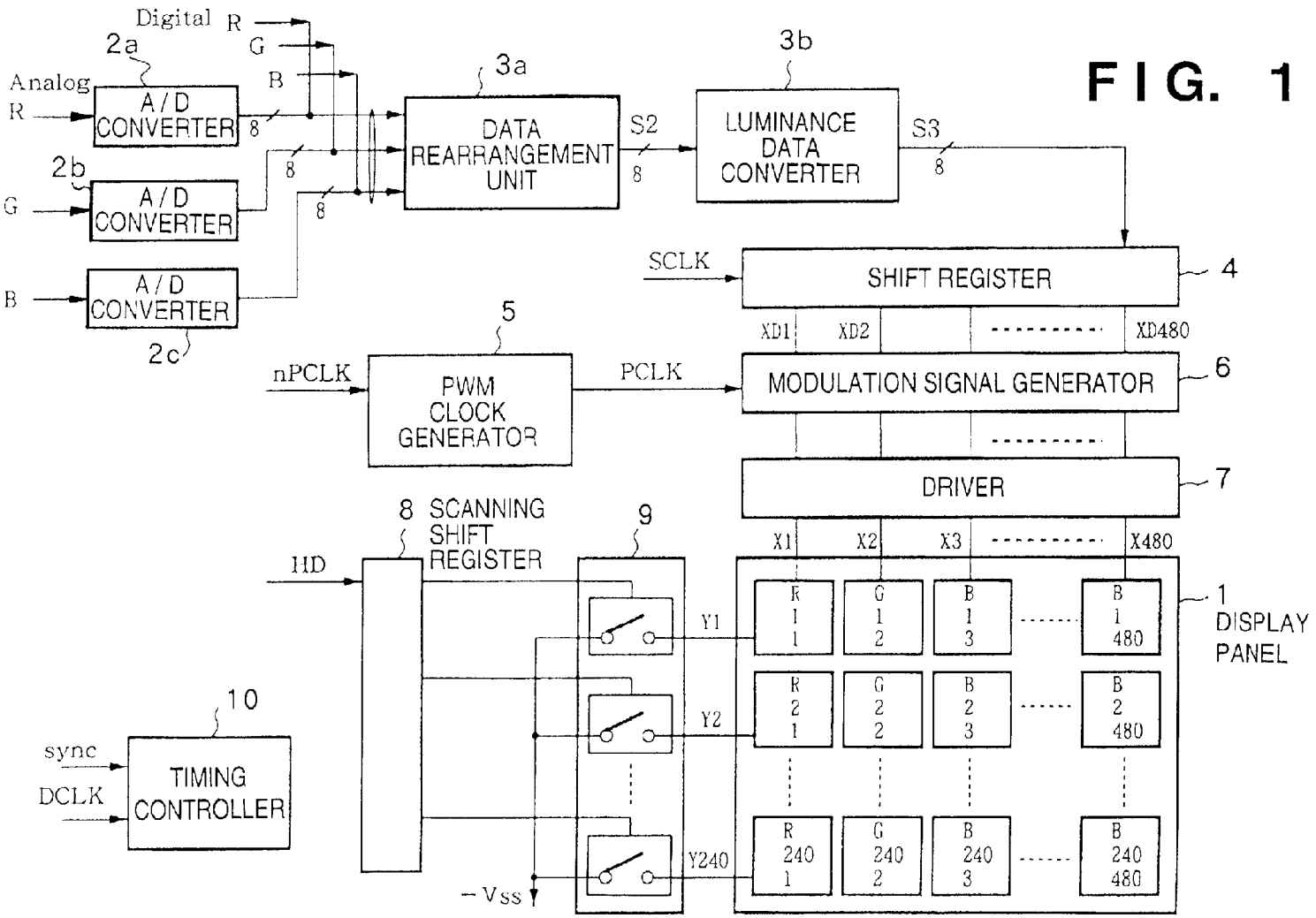
FIG. 1 is a block diagram showing the construction of an image display apparatus according to embodiments of the present invention.

FIG. 1 is a block diagram showing the construction of the image display apparatus according to a first embodiment of the present invention.

In FIG. 1, reference numeral 1 denotes a display panel of the present embodiment containing a substrate holding a number of arrayed electron beam sources, e.g., cold cathode devices, within a thin vacuum container. In the display panel 1, 480 devices i.e., 160 pixels (RGB), are arranged in a horizontal direction, and 240 devices (240 pixels) are arranged in a vertical direction. In the present embodiment, the display panel 1 as the matrix image display panel has 480×240 devices (160×240 pixels), however, the number of devices is not limited to the above number but is determined in accordance with necessity or purpose of the product. In the display panel 1, the pixels are arrayed in RGB stripes as shown in FIG. 20. Numerals 2*a* to 2*c* denote analog/digital converters (A/D converters) which respectively input analog RGB signals decoded from, e.g., an NTSC signal, and convert the input signals into, e.g., 8-bit width digital RGB signals and outputs the converted signals. Numeral 3*a* denotes a data rearrangement unit which inputs the digital RGB signals from the A/D converters 2*a* to 2*c*, a computer (not shown) or the like, and changes the order of the digital RGB signals in correspondence with the pixel array of the display panel 1. Numeral 3*b* denotes a luminance data converter having a conversion table to convert the digital RGB signals in the order changed by the data rearrangement unit 3*a* into data having a desired luminance characteristic. In the present embodiment, the luminance data converter 3*b* performs γ conversion. Numeral 4 denotes a shift register which sequentially shift-transfers the serial data sent from the luminance data converter 3*b*, in synchronization with a shift clock (SCLK), and holds respectively 8-bit width digital data (XD1 to XD480) corresponding to the respective row-direction devices of the display panel 1. Numeral 5 denotes a PWM clock generator which supplies a PWM clock (PCLK) for pulsewidth modulation to a modulation signal generator 6. The modulation signal generator 6 determines the pulsewidths of output signals based on the PWM clock (PCLK), in correspondence with the digital data inputted from the shift register 4. Numeral 7 denotes a driver which drives modulation signal lines (column wirings) of the display panel 1 in correspondence with the pulsewidths of pulse signals outputted from the modulation signal generator 6 (drive signals from the driver 7 are denoted by numerals X1 to X480).

Numeral 8 denotes a scanning shift register which outputs scanning data for sequentially selecting the scanning wirings (row wirings Y1 to Y240) of the display panel 1, corresponding to the scanning lines of input image, with a horizontal scan synchronizing signal (HD) as a shift clock. Numeral 9 denotes a scanning driver which sequentially drives the scanning wirings (row wirings) of the display panel 1, in accordance with the scanning data outputted from the scanning shift register 8. Numeral 10 denotes a timing controller which generates a control signal of necessary timing in the respective function blocks, from a synchronizing signal (sync), a data sampling clock (DCLK) and the like of the input image.

Figure 2:
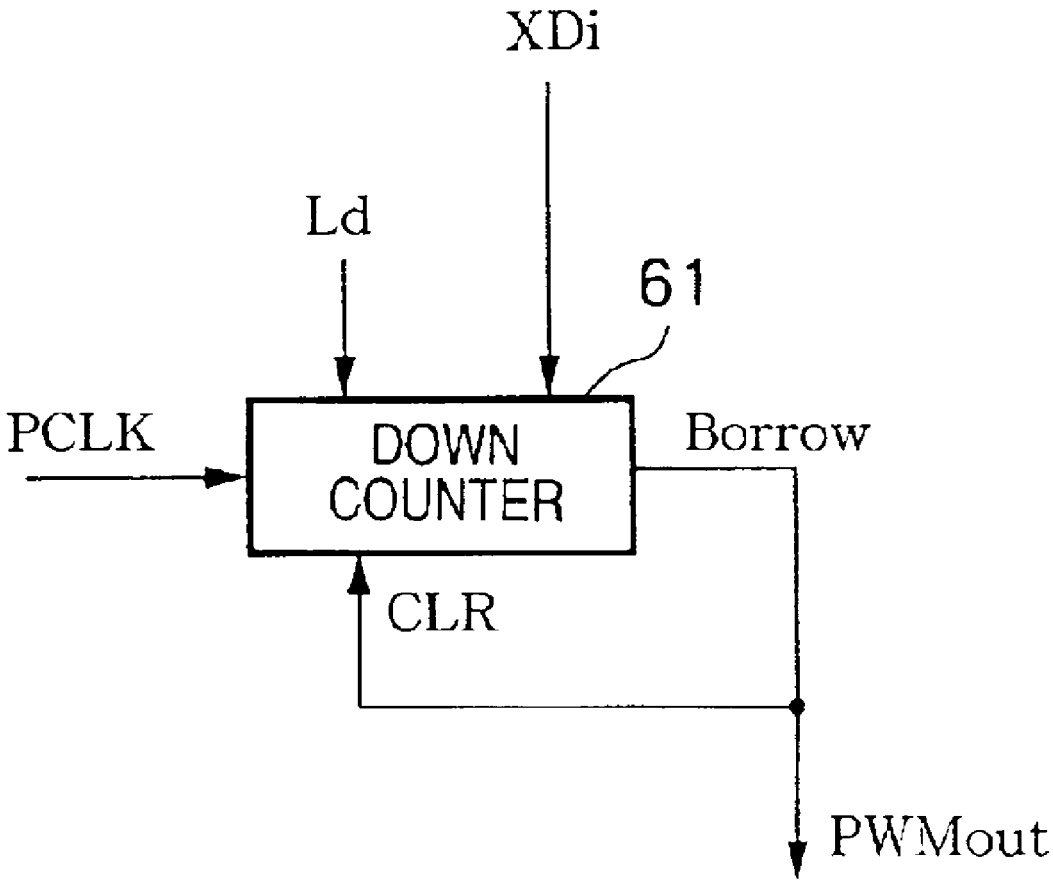
FIG. 2 is a block diagram showing the construction of a modulation signal generator according to a first embodiment of the present invention.

FIG. 2 is a block diagram showing the construction of the modulation signal generator 6 of the present embodiment.

Figure 3:
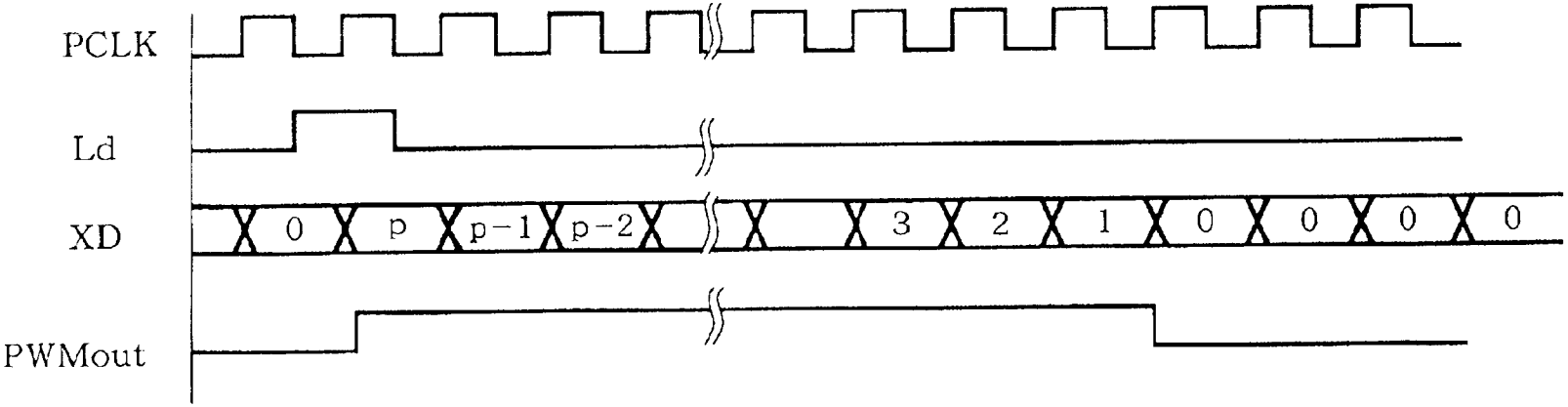
FIG. 3 is a timing chart showing the operation timing of the modulation signal generator of the first embodiment.

In FIG. 2, numeral 61 denotes a down counter which loads the respective 8-bit width digital data (XDi:XD1 to XD480) outputted from the shift register 4 at a timing of a load signal (Ld), and counts down the loaded 8-bit data in synchronization with the PWM clock (PCLK), with borrow output of the down counter 61, for example, as a pulsewidth modulation output (PWMout). That is, the level of the PWMout becomes high when data is loaded to the counter 61, and the counter 61 counts down in synchronization with the PWM clock (PCLK), while a pulsewidth modulation signal is outputted until the count value becomes "0" and the level of the borrow output becomes low. FIG. 3 is a timing chart showing the operation timing of the down counter. FIG. 3 shows the output timing of the PWMout signal when XD=p holds.

Figure 4:
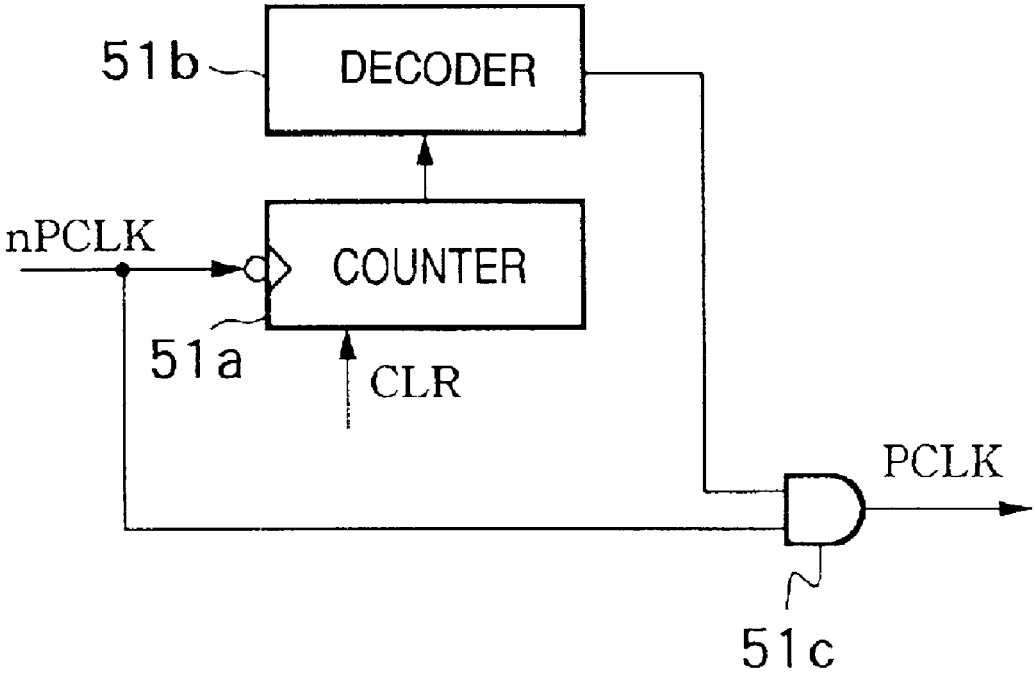
FIG. 4 is a block diagram showing the operation timing of a PWM clock generator according to the first embodiment.

FIG. 4 is a block diagram showing the PWM clock generator 5 of the present embodiment.

In FIG. 4, numeral 51*a* denotes a counter which counts up at the falling edge of an n clock (nPCLK); 51*b*, a decoder which decodes the output from the counter 51*a*; and 51*c*, an AND circuit.

Figure 5:
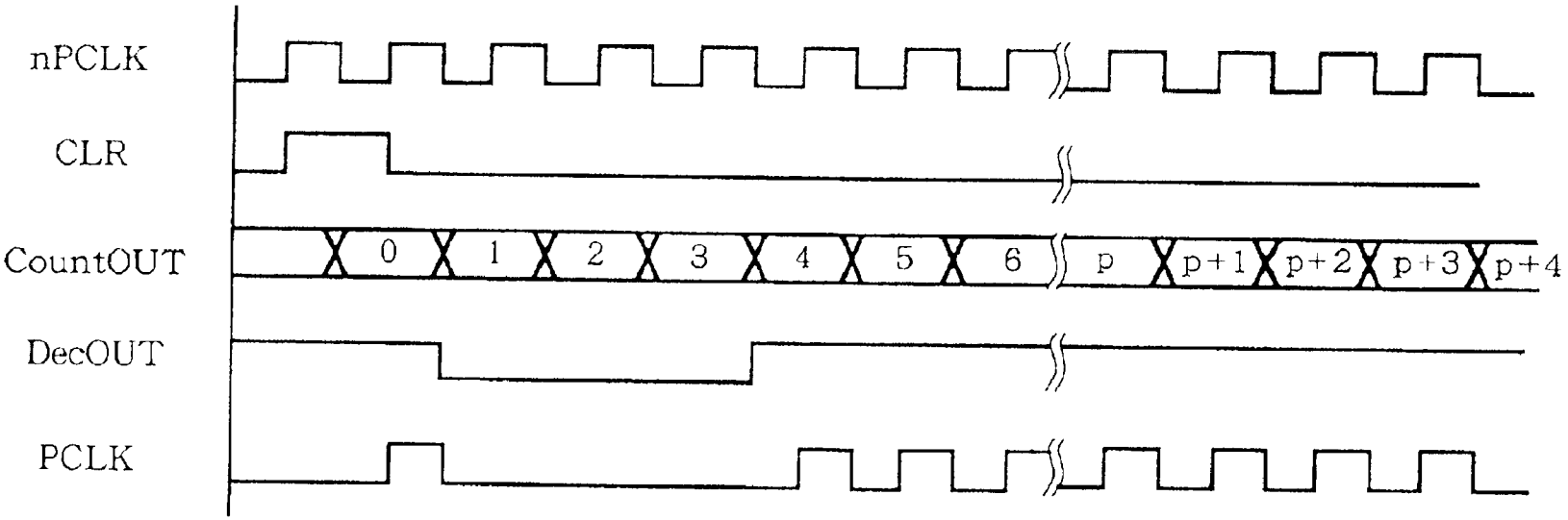
FIG. 5 is a timing chart showing the operation timing of the PWM clock generator of the first embodiment.

FIG. 5 is a timing chart showing the operation timing of the PWM clock generator 5 in FIG. 4. FIGS. 4 and 5 will be described later.

Figure 6:
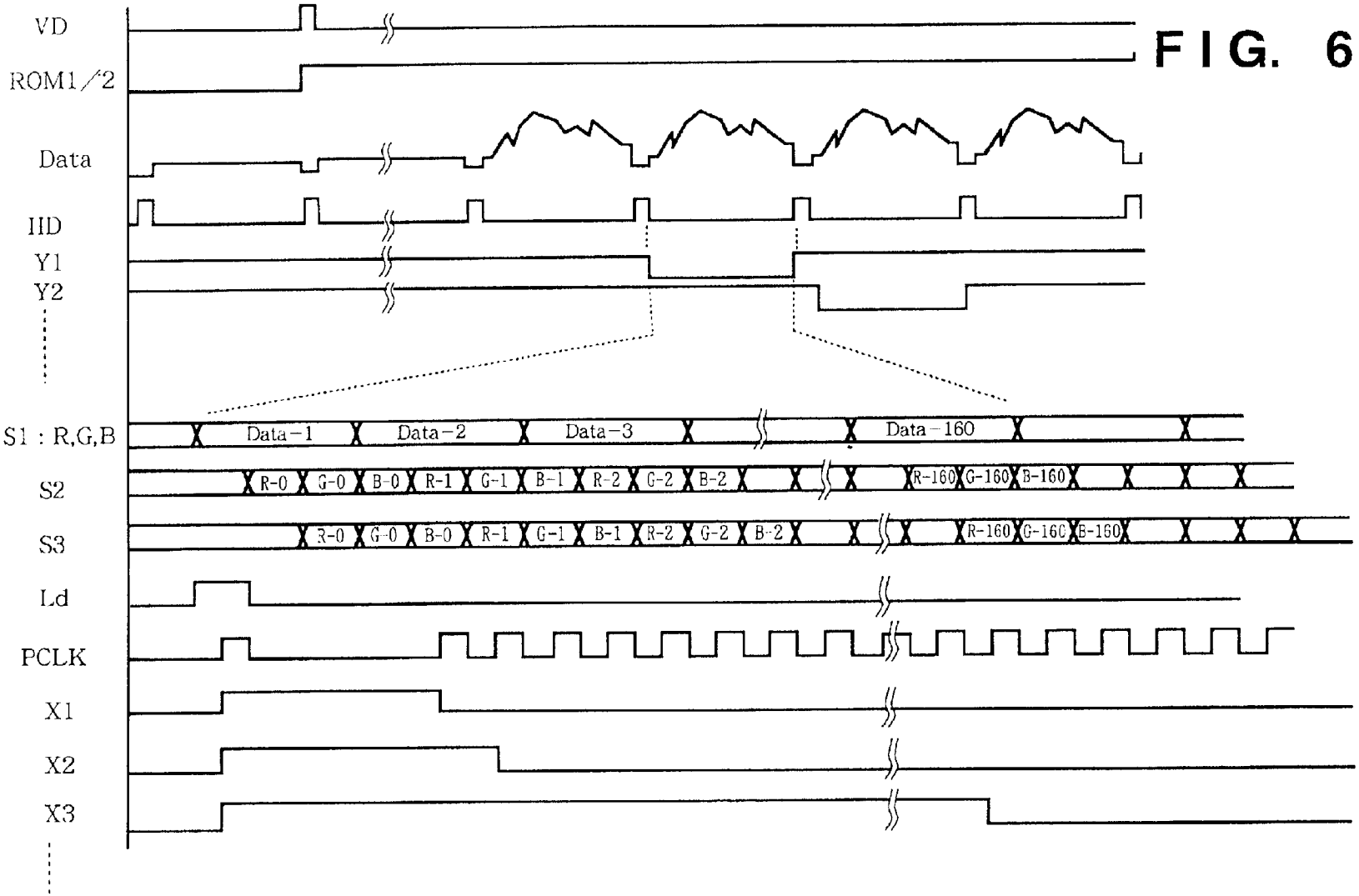
FIG. 6 is a timing chart showing the operation timing of the image display apparatus of the first embodiment.

FIG. 6 is a timing chart showing the operation timing of the image display apparatus of the first embodiment of the present invention as shown in FIG. 1.

In FIG. 1, decoded analog RGB signals are inputted into the corresponding A/D converters 2*a* to 2*c*, and converted into respective 8-bit width digital RGB signals. The data rearrangement unit 3*a* inputs the digital RGB signals from the A/D converters 2*a* to 2*c* (or the computer or the like). If the number of pixel data in one scanning line (1H) is determined from the number of pixels on the side of the modulation signal lines (column wirings) of the panel 1, the processing is simple. Accordingly, in this embodiment, the number of pixel data in one scanning line is "160" equal to the number of pixels in the horizontal direction of the display panel 1. The digital RGB signals are outputted from the A/D converters 2*a* to 2*c* in synchronization with the data sampling clock (DCLK). As shown in FIG. 6, the data rearrangement unit 3*a* changes the RGB parallel signals at the timing of the shift clock (SCLK), as a clock having a frequency triple of that of the data sampling clock (DCLK), and sequentially outputs the signals in accordance with the RGB pixel array of the display panel 1.

The output signal (S2) from the data rearrangement unit 3*a* is sent to the luminance data converter 3*b*. The luminance data converter 3*b* converts the input digital data into data having a luminance characteristic such as the γ characteristic of the panel or the like, and outputs the data to the shift register 4 (the output signal is referred to as S3). The shift register 4 sequentially shift-transfers the signal (S3) outputted from the luminance data converter 3*b*, in synchronization with the shift clock (SCLK), and outputs 8-bit width digital data (XD1 to XD480) corresponding to the respective devices of the display panel 1 in scanning-signal period (horizontal scanning period) units. These 8-bit digital data (XD1 to XD480) are inputted into the modulation signal generator 6. As described above, the modulation signal generator 6 determines the pulse signal widths of pulsewidth-modulated signals to be outputted, in correspondence with the digital data (set value) and the PWM clock (PCLK), for the respective devices. That is, the modulation signal generator 6 outputs modulation signals each having a pulsewidth determined from a period until "the PWM clock (PCLK) number" becomes equal to the "set value". The driver 7 outputs a +Vdd (e.g., +7.5 V) potential (Xa to X480) signals, to drive the modulation signal lines (column-direction wirings) of the display panel 1 with the pulsewidths determined by the outputs from the modulation signal generator 6.

On the other hand, the scanning shift register 8 generates scanning data for sequentially selecting the scanning wirings (row wirings) of the display panel 1 corresponding to the digital data sending an input image, with the horizontal scan synchronizing signal (HD) as a shift clock. Upon selection of the row wiring of the display panel 1, the scanning driver 9, comprising, e.g., transistor switching circuits, outputs the output from the scanning shift register 8 to the row wiring such that the drive potential is a −Vss (e.g., −7.5 V).

When the scanning driver 9 has outputted the drive potential (−Vss: e.g., −7.5 V) to the selected row wiring, then after an interval of 3 μsec, for example, the driver 7 outputs the +Vdd (e.g., +7,5 V) potential (X1 to X480) with the pulsewidth outputted from the modulation signal generator 6, to drive the modulation signal line (column wiring) of the display panel 1 in correspondence with the image signal to be displayed.

Figure 7:
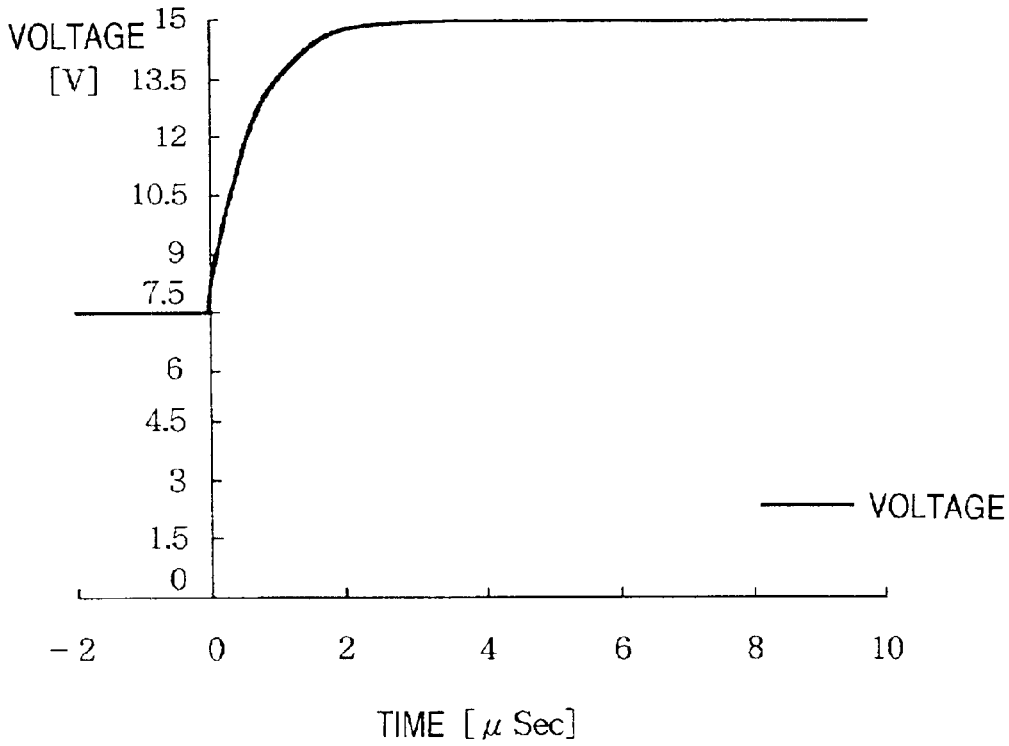
FIG. 7 is a line graph showing the waveform of the conventional display-panel drive signal.

FIG. 7 is a line graph showing the voltage waveform applied to respective devices of a general display panel where the devices are wired in a matrix.

As shown in FIG. 7, in the column direction of the display panel, the rise of the drive voltage waveform is unsharp, since the capacity on the signal wiring side in the display panel is large and the current is limited by the output impedance of the driver 7, thus about 1 to 2 μsec rising period is required.

In this driving, an device to which only the potential +Vdd or −Vss is applied does not contribute to electron emission due to the characteristics of a surface-conduction type emission device. That is, as such a device does not emit electrons toward the phosphor member provided in the display panel 1, the corresponding pixel does not emit light. On the other hand, a device of a selected row wiring, to which a pulsewidth modulation signal corresponding to the image signal is applied during scanning, receives a potential (+Vdd)−(−Vss) with pulsewidth in proportion to the pulsewidth-modulated signal. Then, the device to which the potential (+Vdd)−(−Vss) has been applied emits electrons toward the phosphor member of the display panel 1. In this manner, the respective row-direction wirings are sequentially selected and the devices of the respective rows are driven with pulsewidths corresponding to the image signal values, whereby an image is displayed on the display panel 1.

In the first embodiment, to display an image based on the NTSC signal on the display panel 1 having 240 scanning lines, 480 of 485 interlaced available lines are overlap-driven for each field. That is, the display panel 1 is driven by an image signal for 240 scanning lines, of a frame frequency of 60 Hz. The period necessary for display for one scanning line is about 63.5 μsec, and about 56.5 μsec within the 1-scanning line display period is the maximum period of the drive pulse (X1 to X480).

Figure 8A:
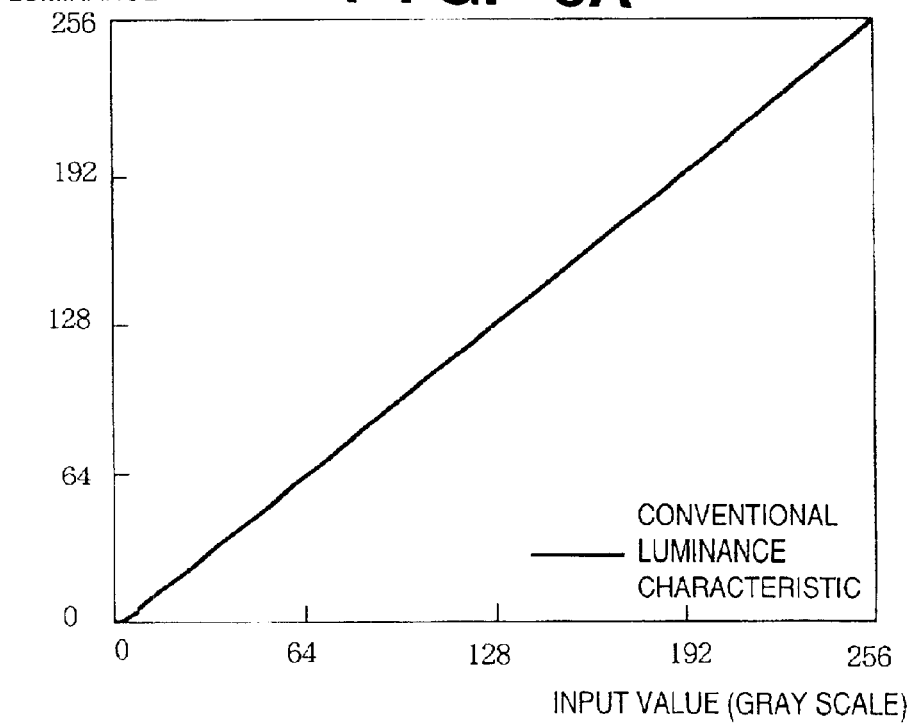
FIGS. 8A and 8B are line graphs showing the problem due to rising delay of the conventional drive signal.
Figure 8B:
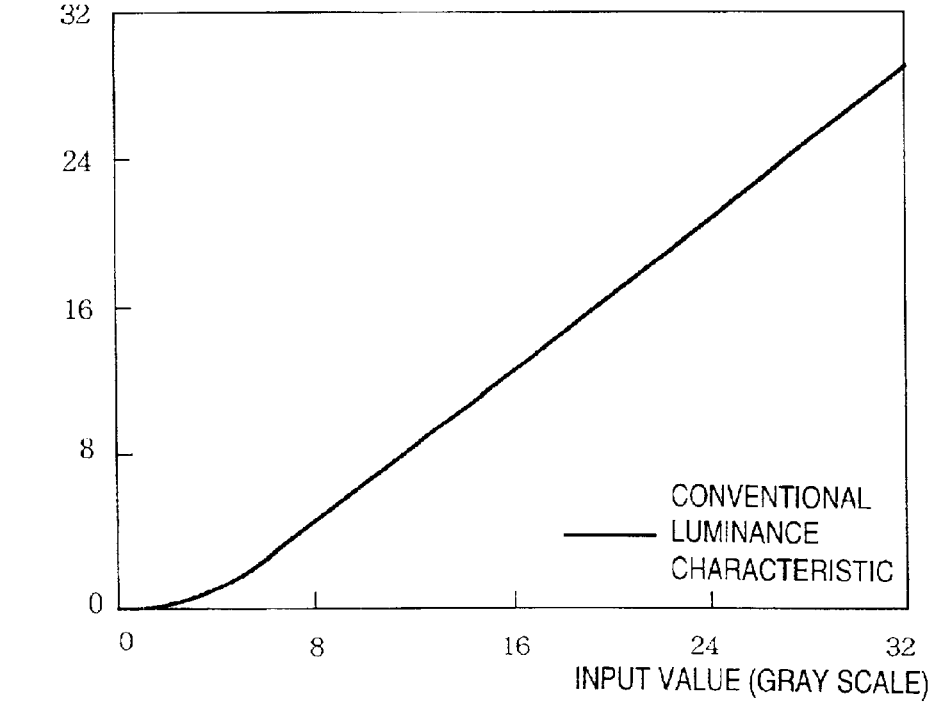

FIGS. 8A and 8B are line graphs showing the luminance characteristic of the conventional display panel. FIG. 8B shows an enlarged part of the graph of FIG. 8A.

Figure 9A:
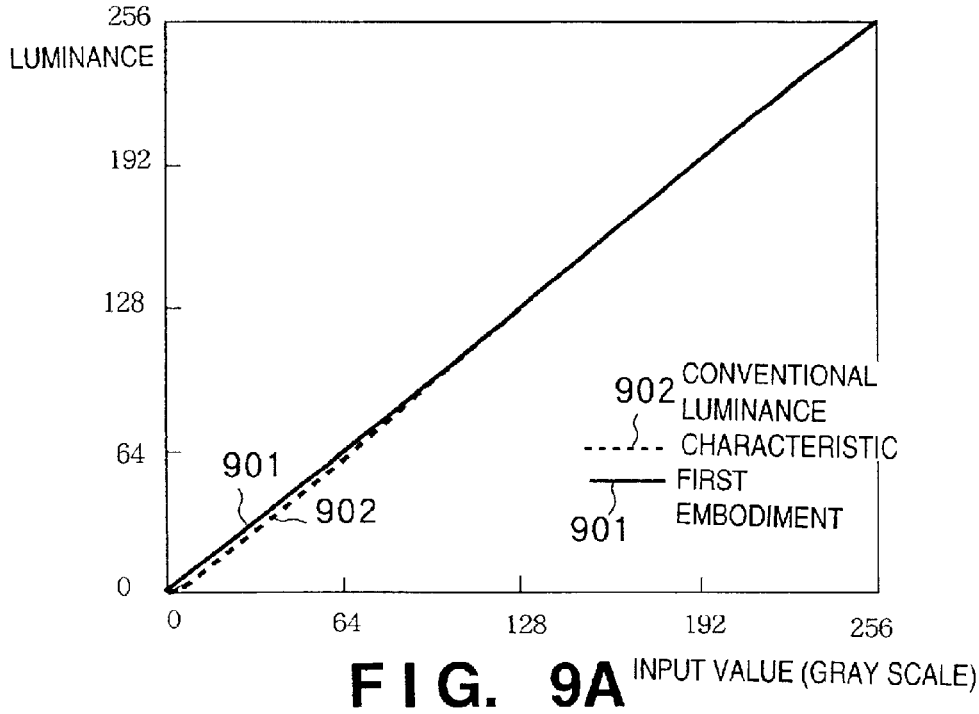
FIGS. 9A and 9B are line graphs showing the relation between input data and light emission luminance according to the first embodiment.
Figure 9B:
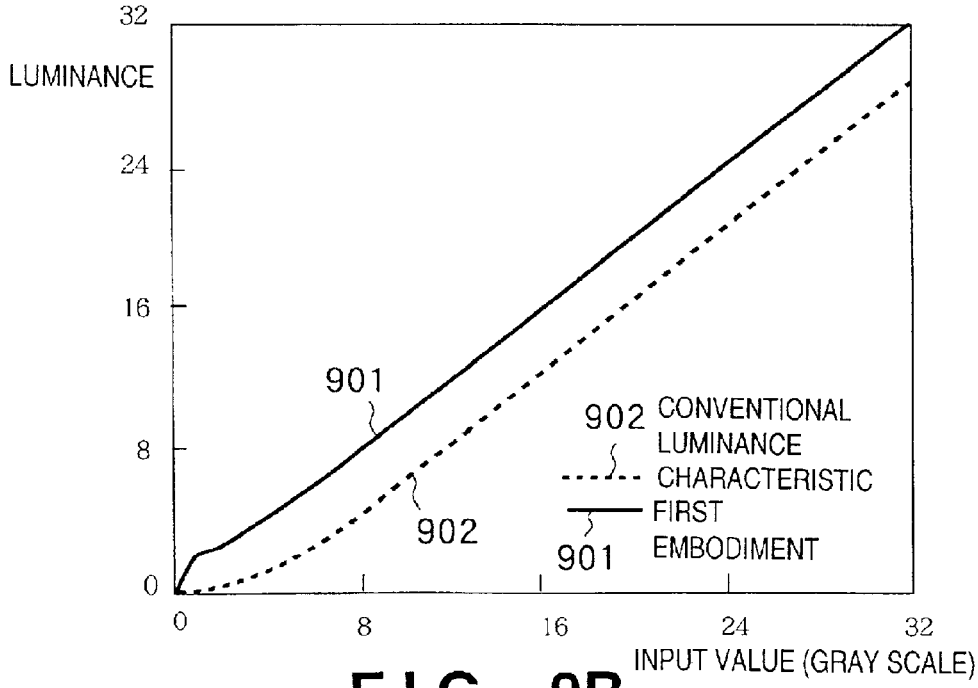

On the other hand, FIGS. 9A and 9B are line graphs showing the luminance characteristic with respect to input data (image signal) in the present embodiment, corresponding to FIGS. 8A and 8B. In FIGS. 9A and 9B, numeral 901 denotes the light-emission luminance characteristic of the present embodiment; and 902, the conventional light-emission luminance characteristic.

To realize the luminance characteristic of the present embodiment, in the characteristic of the conventional display panel as shown in FIG. 8B, a characteristic part (of set value "16" or greater) where the tonality is almost linear is approximated so as to obtain an X segment. In FIG. 8B, the grayscale level at this time is about "4". Then, all pulsewidth periods where light emission does not occur even if the display panel 1 is driven are allotted to "1 grayscale level".

Assuming that a pulsewidth incremental period when the "set value" of image data increases from "i−1" to "i" is Ti (8 bits: i=1 to 255), these periods are determined as follows:

$$T1 = 220\ \text{nsec} \times 4 = 880\ \text{nsec}$$
$$T2 = 220\ \text{nsec}$$
$$T3 = 220\ \text{nsec}$$
$$\vdots$$
$$T225 = 220\ \text{nsec}$$

To realize this processing, the pulsewidth modulation in the present embodiment is performed by the PWM clock generator 5 and the modulation signal generator 6. This operation will be described in detail with reference to the above-described FIGS. 4 to 6.

In FIG. 4, the n clock (nPCLK) is a clock having a frequency the same as that of the PWM clock (PCLK), i.e., a clock having a frequency of about 4.5 MHz. The counter 51*a* is reset by a CLR signal at the timing of the start of the pulsewidth modulation, and counts up by the falling edge of the n clock (nPCLK). The output from the counter 51*a* is decoded by the decoder 51*b*. When the counter output is "1" to "3" (decimal number), a low level signal is outputted to the AND circuit 51*c*. On the other hand, the n clock (nPCLK) is inputted into the other input of the AND circuit 51*c*. The AND circuit 51*c* outputs a logical product between the n clock and the output from the decoder 51*b*. Thus, as shown in FIG. 5, when the output value of the counter 51*a* is "1" to "3" (decimal number), output of the PWM clock (PCLK) is inhibited, and when the output value is not "1" to "3", the n clock (nPCLK) is outputted as the PWM clock (PCLK). In this manner, by inhibiting output of the clock signal PCLK until the n clock (nPCLK) is counted to "3", the output pulsewidth of the low level data "1" to "3" is lengthened, so that the light emission luminance at low luminance levels is increased.

As described above, the modulation signal generator 6 outputs a signal with a pulsewidth (PWMout) determined by a period until the PWM clock (PCLK) number becomes equal to the set value, control in the above-described T1=880 nsec, T2=220 nsec, T2=220 nsec, . . . , T256=220 nsec can be realized.

FIGS. 9A and 9B show the obtained luminance characteristic of the display panel 1 according to the first embodiment. FIGS. 9A and 9B show the set values (8 bits: 256 grayscale levels) to determine the pulsewidths on the horizontal axis, and the relation between the luminance in the present embodiment and the conventional luminance, both normalized in 256 grayscale levels, on the vertical axis. In FIG. 9B, the set values on the horizontal axis are "0" to "32", and the luminance values on the vertical axis are "0" to "32", thus enlarging the corresponding part in FIG. 9A. As it is apparent from FIG. 9B, in comparison with the conventional art, the tonality representation at low-luminance levels is improved.

As a result, an image can be displayed on the display panel 1 with excellent tonality. Especially, the degradation of tonality representation (luminance resolution) in a dark image portion (low luminance portion), where a problem occurs in the conventional art, is greatly improved.

In the present embodiment, the frequency of the n clock (nPCLK) and that of the PWM clock (PCLK) are the same. In the present embodiment, as "256+4" n clock (nPCLK) is required, the maximum period of actual drive pulse (X1 to X480) is about 220 nsec×259=about 57 μsec. Apart from a case where no problem occurs if the maximum period is about 57 μsec, in a case where the maximum period of drive pulse (X1 to X480) must be about 56.5 μsec for another processing time, the period of the n clock (nPCLK) may be about 217 nsec, i.e., its frequency may by about 4.6 MHz.

<Second Embodiment>

Next, a second embodiment of the present invention will be described as a case where the luminance difference between adjacent grayscale levels is equal in all the levels.

Figure 10:
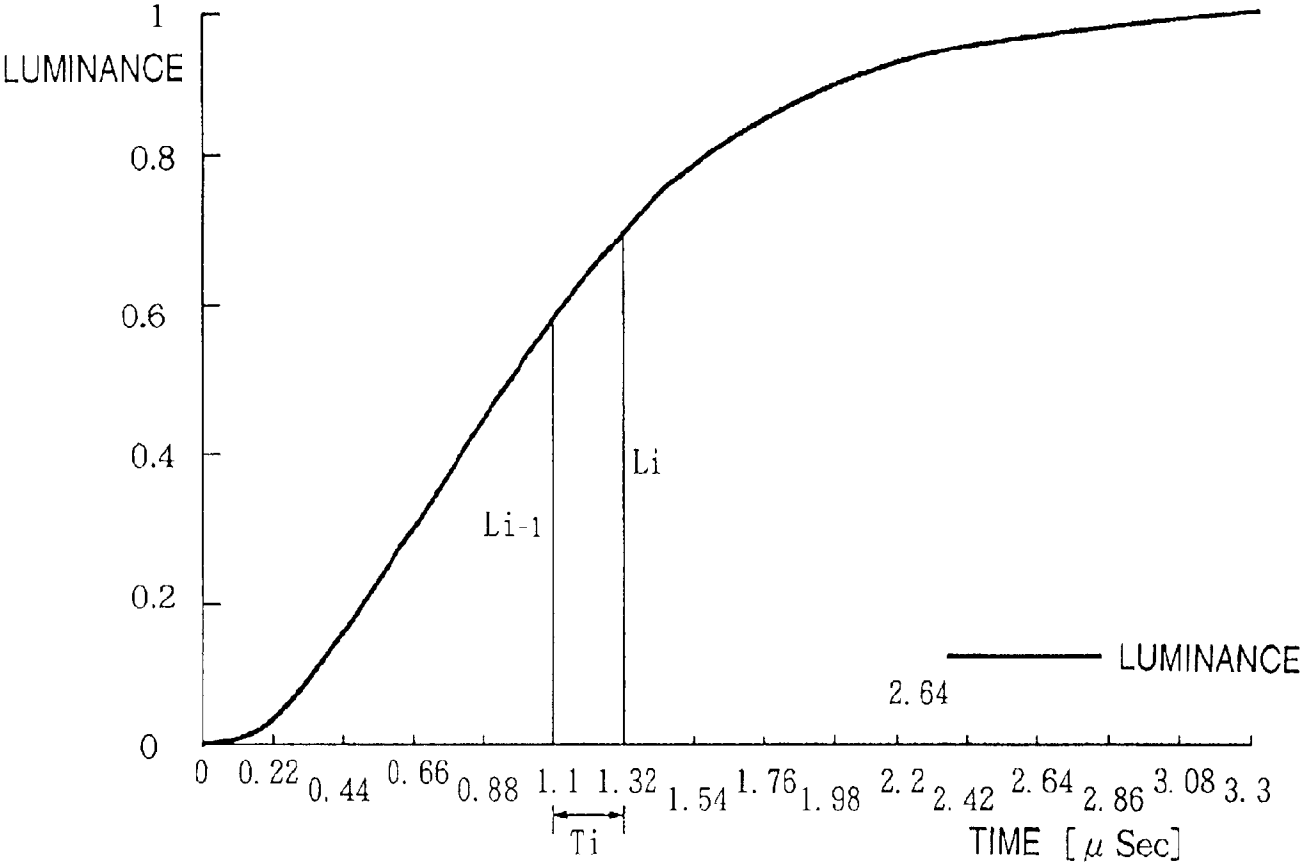
FIG. 10 is a line graph showing the relation between device driving time and light emission luminance.

FIG. 10 is a line graph showing the conventional light emission luminance with respect to time, with the time base on the horizontal axis and the light emission luminance (normalized) on the vertical axis.

In this graph, to perform pulsewidth modulation such that the luminance difference between adjacent grayscale levels is always the same in each level, assuming that the maximum pulsewidth value when the image data value (grayscale) increases from "i−1" to "i" is Ti, the pulsewidth increment Ti upon display of a pixel at i-th grayscale level is determined as follows:

$$K'(\text{constant}) = (Ti/\tau) \times (Li-1+Li) \times (1/2) \quad (1)$$

K': constant

Ti: i-th pulsewidth increment

τ: field (frame) period

Li: i-th light emission luminance

That is, the pulsewidth Ti to satisfy the following relation is sequentially determined:

$$K = Ti \times (Li-1+Li) \quad (2)$$

(K: constant)

When i is a large number (in FIG. 10, i is 5 μsec or more, corresponding to an undegraded portion of the drive waveform), Ti has its value of about 220 nsec. Actually, the minimum resolution of Ti is set to about 110 nsec, and to practically satisfy the equation (2), the following pulsewidths are obtained by sequentially calculating from i=1:

$$T1 = 660\ \text{nsec}$$
$$T2 = 330\ \text{nsec}$$
$$T3 = 330\ \text{nsec}$$
$$T4 = 330\ \text{nsec}$$
$$\vdots$$
$$Ti - 220\ \text{nsec}\ (i \geq 5)$$

Note that the pulsewidth changes are made by corporation between the PWM clock generator 5 and the modulation signal generator 6, similar to that in the first embodiment. As the difference from the first embodiment resides in the difference in the construction of the PWM clock generator 5, and the other constituents are the same as those in the first embodiment, therefore, explanations of those constituents will be omitted.

Figure 11:
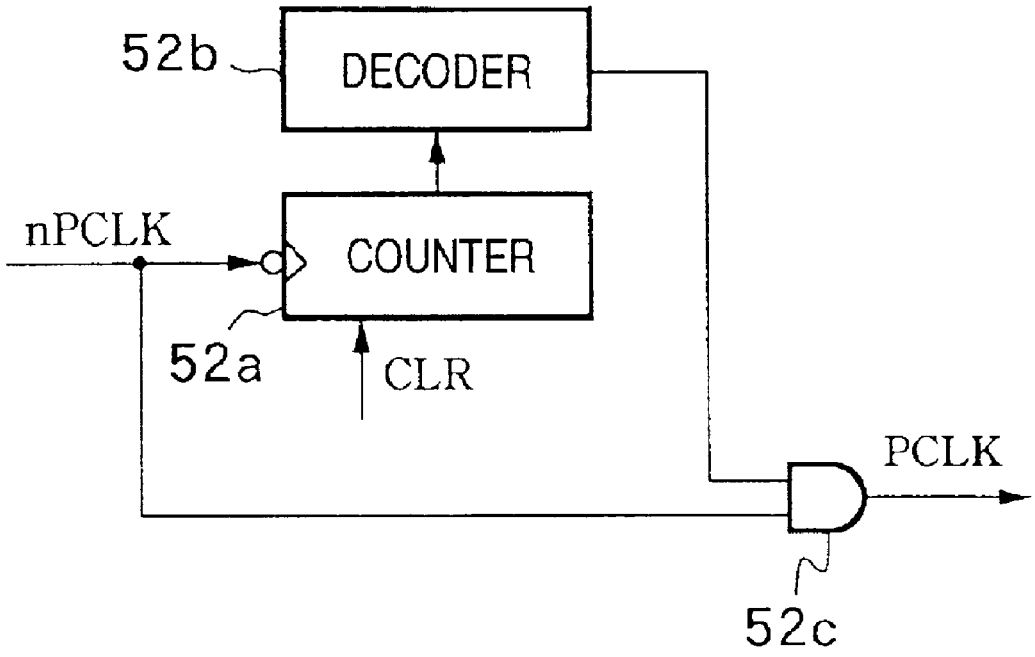
FIG. 11 is a block diagram showing the construction of the PWM clock generator according to a second embodiment of the present invention.
Figure 12:
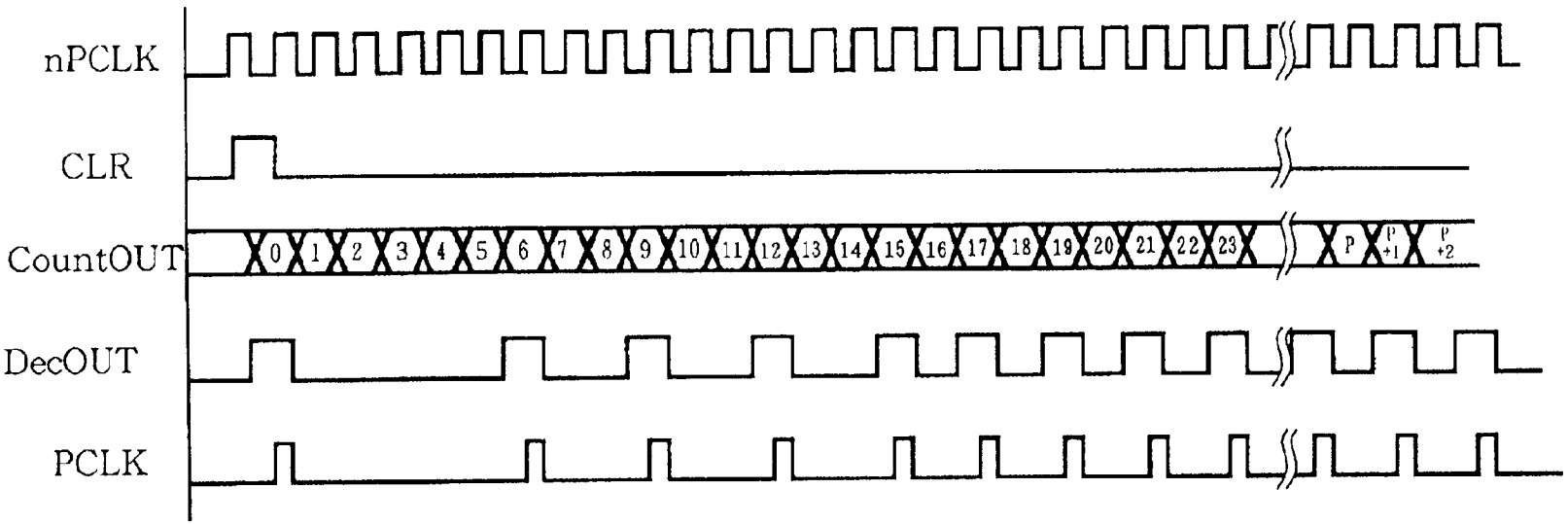
FIG. 12 is a timing chart showing the operation timing of the PWM clock generator of the second embodiment.

FIG. 11 is a block diagram showing the construction of the PWM clock generator 5 according to the second embodiment. FIG. 12 is a timing chart showing the operation timing of the PWM clock generator 5.

In FIG. 11, numeral 52*a* denotes a counter; 52*b*, a decoder; and 52*c*, an AND circuit, corresponding to those in FIG. 4.

In FIG. 11, as the minimum resolution of the above-mentioned pulsewidth increment Ti is about 110 nsec, the n clock (nPCLK) is a clock having a period of about 110 nsec, i.e., a clock having a frequency of about 9.0 MHz. First, the value of the counter 52*a* is reset to "0" by the CLR signal at the start timing of the pulsewidth modulation, then, the counter 52*a* counts up in synchronization with the fall of the n clock (nPCLK). The decoder 52*b* decodes the output from the counter 52*a* (CountOUT), and when the output value from the counter 52*a* is "0", "6", "9", "12" and "15", or a higher odd number, the decoder 52*b* outputs a high level signal (DecOUT). The AND circuit 52*c* outputs a logical product between the output from the decoder 52*b* and the n clock (nPCLK), as the PWM clock (PCLK) as shown in the timing chart of FIG. 12.

As described above, as the modulation signal generator 6 counts the PWM clock (PCLK) to a count value corresponding to the value inputted from the shift register 4, and outputs a modulation signal with a corresponding pulsewidth, the respective devices of the display panel 1 can be driven in accordance with input image data, in correspondence with the above-described pulsewidth increments, T1=660 nsec, T2=330 nsec, T3=330 nsec, T4=330 nsec, . . . , Ti=220 nsec (i≧5).

FIGS. 13A and 13B are line graphs showing the relation between the input values (set values) and the light emission luminance in the second embodiment. FIG. 13B shows an enlarged part of FIG. 13A. In these figures, numeral 903 denotes the light emission luminance characteristic in the second embodiment; and 904, the conventional light emission luminance characteristic.

FIG. 13A shows the input data (image data: grayscale values) (8 bits: 256 grayscale levels) to determine the pulsewidths on the horizontal axis, and the luminance normalized in 256 grayscale levels, on the vertical axis. FIG. 13B shows, as the enlarged part of the graph of FIG. 13A, "0" to "32" input data on the horizontal axis, and "0" to "32" light emission luminance levels, on the vertical axis. As it is apparent from FIG. 13B, in comparison with the conventional art, the tonality representation at low luminance levels is improved.

As described above, according to the second embodiment, an image can be displayed with excellent tonality representation. Especially, in a dark image portion (low luminance portion) where a problem occurs in the conventional art, sufficient tonality representation (luminance resolution) can be obtained.

Note that in the second embodiment, the n clock (nPCLK) has a frequency double of the clock frequency of the PWM clock (PCLK). In the second embodiment, as "256×2+7" n clock (nPCLK) is required, the maximum period of actual drive pulse (X1 to X480) is about 110 nsec×519=about 57 μsec. Apart from a case where no problem occurs if the maximum period is about 57 μsec, in a case where the maximum period of drive pulse (X1 to X480) must be about 56.5 μsec for another processing time, the period of the n clock (nPCLK) may be about 108.5 nsec, i.e., its frequency may by about 9.2 MHz.

<Third Embodiment>

Next, a third embodiment of the present invention will be described below. As the difference from the second embodiment resides in the difference in construction of the PWM clock generator 5, and the other constituents regarding the PWM clock (PCLK) are the same as those of the second embodiment, explanations of those constituents will be omitted.

Figures 14, 15:
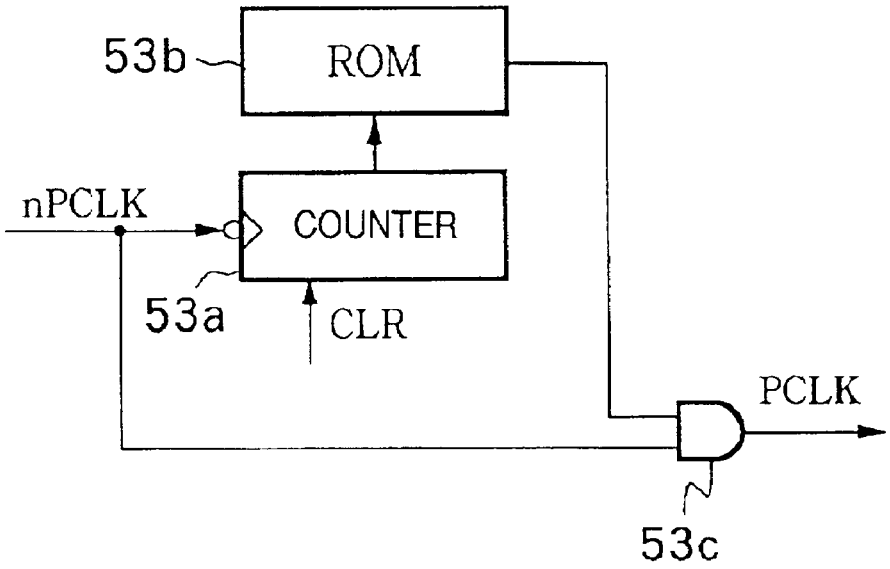
FIG. 14 is a block diagram showing the construction of the PWM clock generator according to a third embodiment of the present invention.
FIG. 15 is a table showing the data structure of a ROM according to the third embodiment.

FIG. 14 is a block diagram showing the construction of the PWM clock generator 5 according to the third embodiment. FIG. 15 is a table showing the structure of data stored in a ROM 53*b*.

In FIG. 14, numeral 53*a* denotes a counter; 53*b*, a memory such as a read only memory (ROM) having 1-bit width output; and 53*c*, an AND circuit.

In FIG. 14, the n clock (nPCLK) is a clock having a period of about 110 nsec, i.e., a clock having a frequency of about 9.0 MHz. First, the value of the counter 53*a* is reset to "0" by the CLR signal at the start timing of pulsewidth modulation processing, then the counter 53*a* counts up at the fall of the n clock (nPCLK). The output from the counter 53*a* is inputted as an address of the ROM 53*b*. As the output from the ROM 53*b*, a high level signal is outputted to an AND circuit 53*c* when the value of the counter 53*a* is decimal "0", "6", "9", "12" and "15", or a higher odd number. The signal timing at this time is similar to that shown in FIG. 12.

As described above, according to the third embodiment, similarly to the above-described second embodiment, the pulsewidth increments can be set as T1=660 nsec, T2=330 nsec, T3=330 nsec, T4=330 nsec . . . , Ti=220 nsec (i≧5), in accordance with the respective grayscale levels. Thus, a light emission luminance characteristic similar to that of the second embodiment can be obtained, and advantages similar to those of the second embodiment can be obtained.

<Fourth Embodiment>

Next, a fourth embodiment of the present invention will be described. As the difference between the above embodiment and the fourth embodiment resides in the difference in the construction of the PWM clock generator 5, and the other constituents regarding the PWM clock (PCLK) are the same as those of the above embodiment, explanations of those devices will be omitted.

Figure 16:
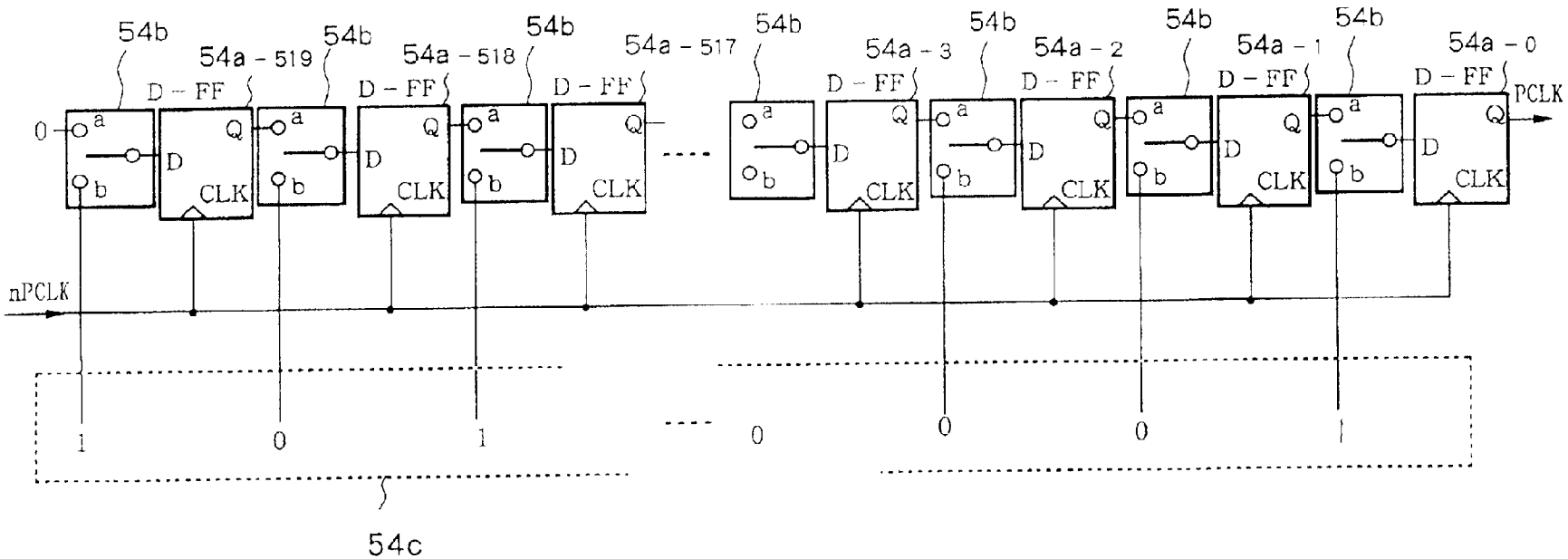
FIG. 16 is a block diagram showing the construction of the PWM clock generator according to a fourth embodiment of the present invention.

FIG. 16 is a block diagram showing the construction of the PWM clock generator 5 according to the fourth embodiment of the present invention.

In FIG. 16, numerals $\mathbf{54}_{a\text{-}0}$ to $\mathbf{54}_{a\text{-}3}$ and $\mathbf{54}_{a\text{-}517}$ to $\mathbf{54}_{a\text{-}519}$ denote D-flip-flops; 54*b*, selectors; and 54*c*, a memory such as a mask ROM where predetermined data is stored in advance.

In FIG. 16, the PWM clock (PCLK) is generated as follows. The n clock (nPCLK) is a clock having a period of 110 nsec, i.e., a clock having a frequency of about 9.0 MHz. Initially, the respective selectors 54*b* are connected to a contact b side, and data from the memory 54*c* such as a mask ROM is inputted into the D-flip-flops $\mathbf{54}_{a\text{-}0}$ to $\mathbf{54}_{a\text{-}3}$ and $\mathbf{54}_{a\text{-}517}$ to $\mathbf{54}_{a\text{-}519}$. Thus, when the data from the memory 54*c* has been inputted into the respective flip-flops, the respective selectors 54*b* are connected to a contact a side. Next, the n clock (nPCLK) is inputted, then the flip-flops operate as shift registers to sequentially output data, from the flip-flop $\mathbf{54}_{a\text{-}0}$, as the first register, as pulsewidth modulation (PWM) clocks (PCLKs).

Note that the respective data stored in the memory 54*c* is the same as data shown in FIG. 15. Further, the address space of the memory 54*c* may range from "0" to "519" addresses corresponding to the D-flip-flops $\mathbf{54}_{a\text{-}0}$ to $\mathbf{54}_{a\text{-}3}$ and $\mathbf{54}_{a\text{-}517}$ to $\mathbf{54}_{a\text{-}519}$. The output PWM clocks (PCLKs) are the same as the PCLK of the second embodiment, and advantages similar to those in the second embodiment can be obtained (See FIGS. 13A and 13B).

<Fifth Embodiment>

Next, a fifth embodiment of the present invention will be described as a case where correction similar to the correction by the luminance data converter 3*b* in the above embodiment is performed by setting the pattern of a clock signal to determine the pulsewidth of the pulsewidth modulation signal.

The construction of the fifth embodiment is the same as that shown in FIG. 1 except that the luminance data converter 3*b* is omitted.

Figure 31:
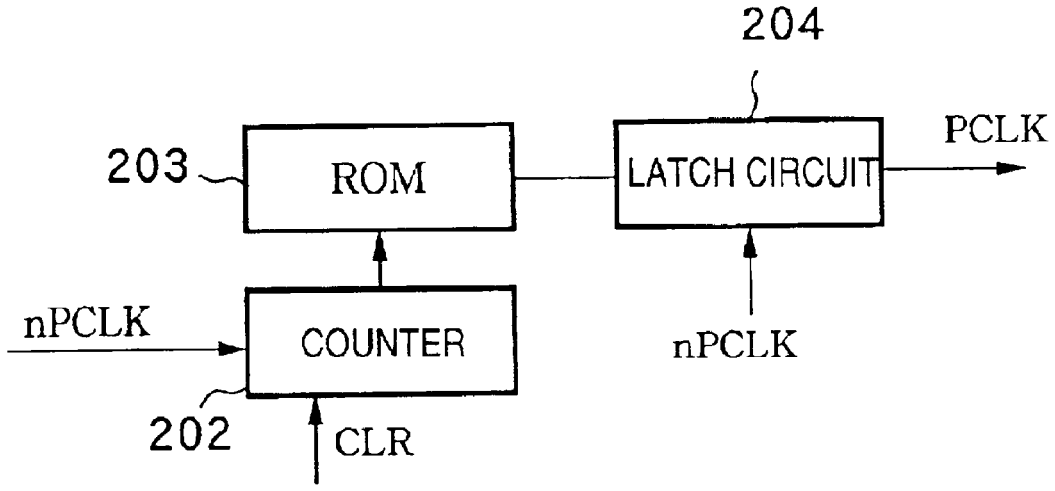
FIG. 31 is a block diagram showing the construction of the PWM clock generator according to a fifth embodiment of the present invention.

FIG. 31 is a block diagram showing the construction of the PWM clock generator 5 according to the fifth embodiment.

In FIG. 31, numeral 202 denotes a counter which counts the n clock (nPCLK); 203, a ROM in which preset 1-bit data are stored at respective addresses; 204, a latch circuit which latches the output data (1 bit) from the ROM 203.

FIG. 32 is a table showing an example of data in the memory 203 such as a ROM. In FIG. 32, the ROM 203 has addresses "0" to "2048", and data corresponding to the respective addresses indicate "1". Note that data indicating "0" are stored in addresses not shown in this figure.

Figure 33:
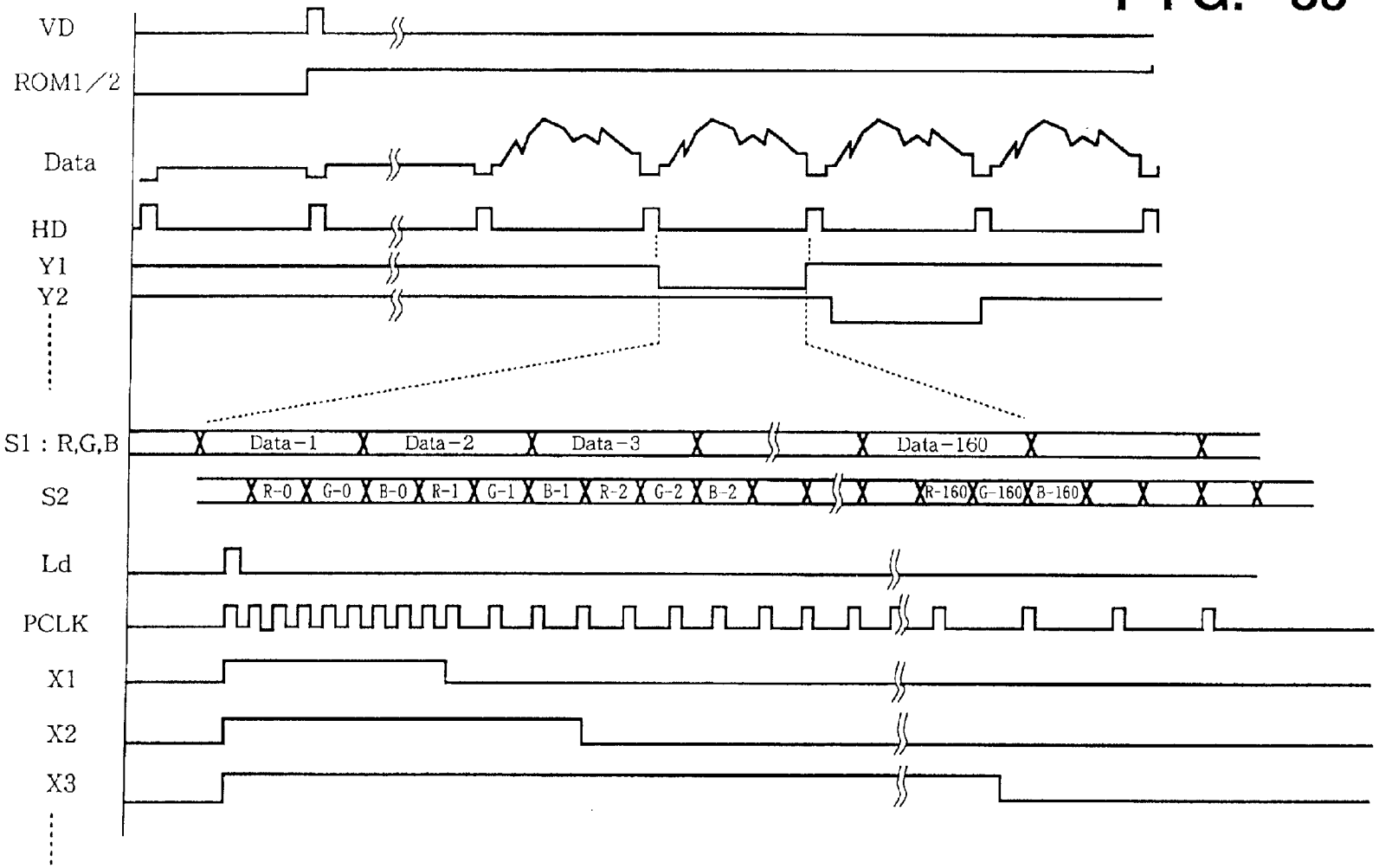
FIG. 33 is a timing chart showing the operation timing of the image display apparatus according to the fifth embodiment.

FIG. 33 is a timing chart showing the operation timing in the image display apparatus according to the fifth embodiment. Hereinbelow, the fifth embodiment will be described.

In FIG. 1, when the analog RGB signals, decoded by a decoder (not shown) from an NTSC signal, for example, are inputted, the A/D converters 2 convert the signals into, e.g., respective 8-bit digital RGB signals. The data rearrangement unit 3*a* inputs the digital RGB signals (SG1) from the A/D converters 2 or the computer. If the number of data in one scanning line (1H) is determined by the number of pixels of the modulation signal lines (column wirings) of the matrix image display panel 1, the processing becomes simple. In the present embodiment, the number of pixels on the modulation-signal side of the matrix image display panel 1 is "160". The digital RGB signals (SG1) from the A/D converters 2 or the computer are outputted in synchronization with a data sampling clock (DCLK) (not shown). Note that in the present embodiment, the luminance data converter 3*b* is omitted.

As shown in FIG. 33, the input signals (SG1) in the data rearrangement unit 3*a*, as parallel RGB signals, are rearranged at the timing of a shift clock (SCLK) (not shown) as a clock having a frequency triple of that of the data sampling clock (DCLK), and sequentially outputted in accordance with the RGB pixel array of the matrix image display panel 1. The output signals (SG2) from the data rearrangement unit 3*a* are sent to the shift register 4. The serial data is sequentially shift-transferred in synchronization with the shift clock (SCLK), and outputted as 8-bit digital data XDi (i=1 to 480) corresponding to the respective devices of the matrix image display panel 1, in the scanning signal period (horizontal scanning period) units. The 8-bit digital data (XD1 to XD480) are inputted into the modulation signal generator 6. As described above, the modulation signal generator 6 outputs signals having pulsewidths respectively determined by a period until the "PWM clock (PCLK) number" becomes equal to the "set value". The driver 7 drives the modulation signal lines (column wirings) of the matrix image display panel 1 in accordance with the pulsewidths outputted from the modulation signal generator 6, by a potential +Vdd (e.g., +7.5 V). As a result, in the modulation signal generator 6, the luminance conversion is performed such that the relationship between the "set values" and the drive pulsewidths is linear.

On the other hand, the scanning shift register 8 generates data for sequentially scanning the scanning wirings of the matrix image display panel 1 corresponding to an input image, with the horizontal scan synchronizing signal (HD) as a shift clock. Then, the scanning driver 9, comprising, e.g., transistor switching circuits, sequentially outputs the output from the scanning shift register 8 such that the potential becomes −Vss (e.g., −7.5 V) in the selected row wiring of the matrix image display panel 1.

In the present embodiment, γ conversion will be described as an example of luminance conversion. The γ conversion characteristic will be described using BTA (Broadcasting Technology Association), SMPTE (Society of Motion Picture and Television Engineers, Inc.) 1125/60 studio standards:

$$L=[(V+0.1115)/1.1115]^{1/0.45}:V\geqq 0.0923$$

$$L=V/4.0:V<0.0923 \tag{3}$$

L: output luminance

V: input data

In the above equation (3), the input data V indicates digital data (XD1 to XD480) corresponding to the devices, and L, the converted luminance. In the matrix image display panel 1 of the present embodiment, the pulsewidth is proportional to light emission luminance, therefore, the γ conversion is realized by setting a necessary pulsewidth to be proportional to the output luminance L of the equation (3).

If the γ conversion function of the equation (3) is $$L=f(V) \tag{4}$$

then, the pulsewidth τ to drive each device of the display panel 1 is $$\tau\propto f(V) \tag{5}$$

That is, assuming that the pulse period of the i-th PWM clock (PCLK) is ti, and the input data V and the conversion function f(V) are normalized by "255" for the sake of simplicity, $$f(V)\cong 255\times\left(\sum_{i=0}^{V} ti\right)\div\left(\sum_{i=0}^{255} ti\right) \tag{6}$$

In the above expression (6), "(Σti):i=0 to V" indicates the summation of pulse periods i=0 to i=V. "(Σti):i=0 to 255" indicates the summation of pulse periods i=0 to i=255. The luminance conversion is realized by supplying the PWM clock (PCLK) to the modulation signal generator 6.

In the present embodiment, the PWM clock (PCLK) generator is realized by the construction as shown in FIG. 31. In FIG. 31, the counter 202 counts the n clock (nPCLK), and outputs a 12-bit count value as an address signal of the ROM 203. The latch circuit 204 latches output read by this address from the ROM 203, and outputs it as the PWM clock (PCLK).

The data stored in the ROM 203 satisfies the expression (6). That is, the expression (6) is calculated, sequentially from V=0, to determine the pulse period ti such that it is close to f(V).

FIG. 32 shows an example of the data in the ROM 203 determining the pulse period ti calculated from the BAT, SMPTE 1125/60 studio standard. FIG. 32 shows only the addresses where the data output is "1" (logical "H" level). That is, the output value of the data in the addresses not shown in FIG. 32 is "0" (logical "L" level).

The counter 202 of the PWM clock generator 5 is reset by the CLR pulse, and sequentially counts up from "0" in synchronization with the nPCLK. Then, the output from the counter becomes the address of the ROM 203. The latch circuit 204 removes glitch from the 1-bit data read by the address from the ROM 203, and outputs the data as the PWM clock (PCLK) as shown in FIG. 33. Thus, the above-described modulation signal generator 6 determines the pulsewidth from the PWM clock (PCLK) and the digital value from the shift register 4.

In the present embodiment, the n clock (nPCLK) is determined as follows. That is, to perform display based on an NTSC signal on the matrix image display panel 1 having 240 scanning lines, 480 of 485 interlaced available lines are overlap-driven for each field. That is, the display panel 1 is driven by an image signal for 240 scanning lines, of a frame frequency of 60 Hz. The period necessary for display for one scanning line is about 63.5 μsec, and about 56.5 μsec within the 1-scanning line display period is the maximum period of the drive pulse (X1 to X480). At this time, the period of the n clock (nPCLK) is about 27.5 nsec, i.e., it has a frequency of about 36 MHz.

Figure 34:
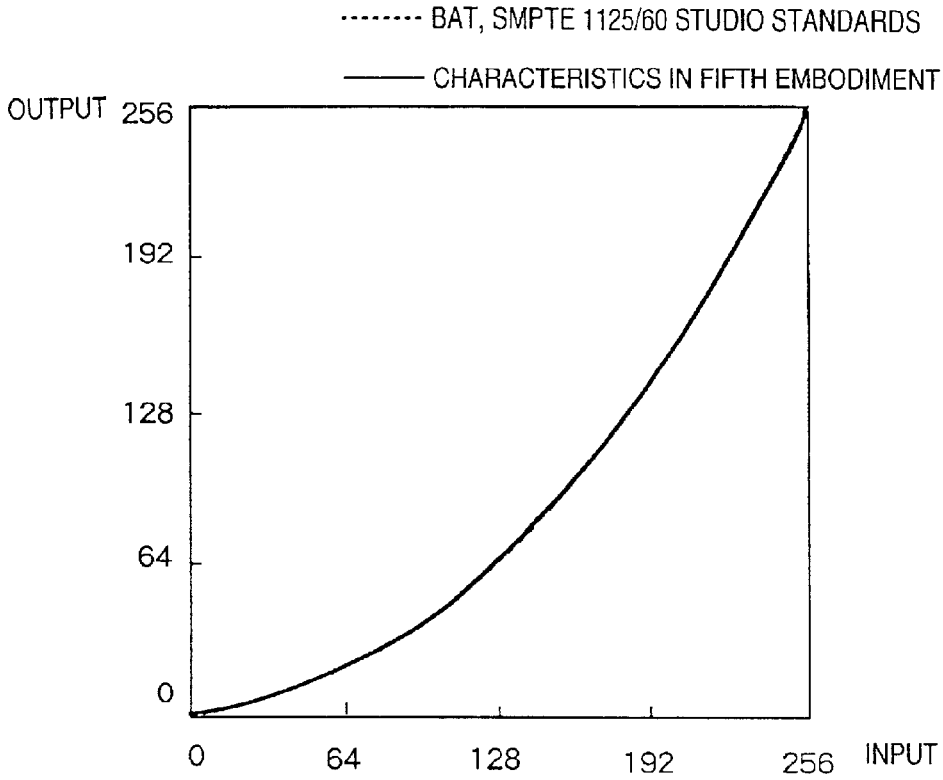
FIG. 34 is a line graph showing luminance output characteristic with respect to input data in the fifth embodiment.
Figure 35:
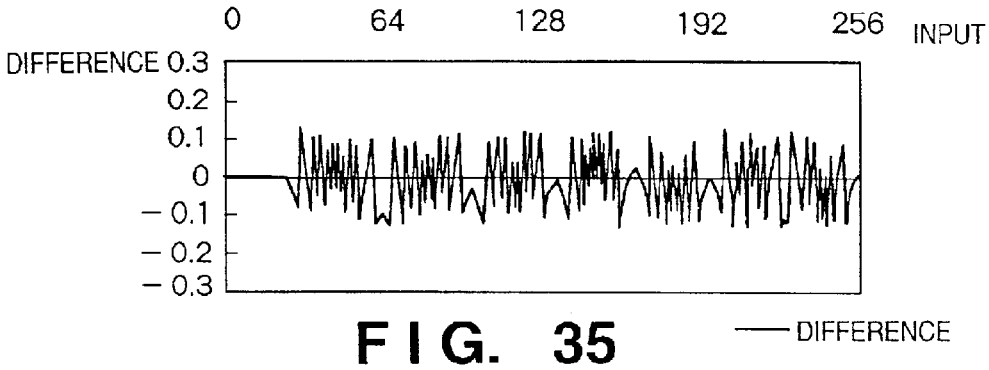
FIG. 35 is a graph showing, as an enlarged part of FIG. 34, difference between the luminance characteristic and input data in the fifth embodiment.

FIG. 34 is a line graph showing the characteristic of the pulsewidths (since the pulsewidths are proportional to the light emission luminance, they may be regarded as light emission luminance), determined by the modulation signal generator 6 from the PWM clocks (PCLKs), with respect to input digital data, in the present embodiment. FIG. 34 also shows the γ-conversion characteristic (hereinafter, referred to as "ideal values") based on the BTA, SMPTE 1125/60 studio standards. Since the difference between the characteristic in the present embodiment and that of the ideal values is very small and they cannot be easily distinguished from each other in the graph of FIG. 34. FIG. 35 shows an enlarged part of the difference between the γ-converted ideal values and luminance conversion in the present embodiment.

As a result, in the matrix image display panel 1, image display can be performed with excellent tonality representation, and especially, sufficient tonality (luminance resolution) can be obtained in a dark image portion where a problem occurs in the conventional art.

<Sixth Embodiment>

Next, a sixth embodiment of the present invention will be described below. As the constituents of the sixth embodiments are the same as those of the fifth embodiment, except the PWM clock generator 5, explanations of the corresponding elements will be omitted.

Figure 36:
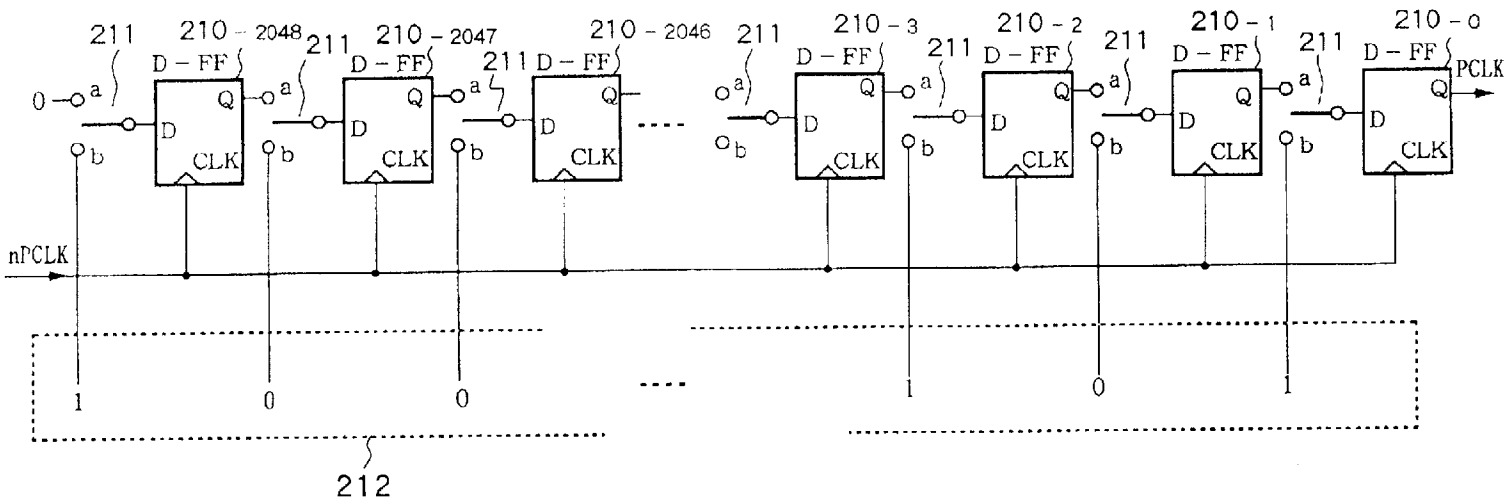
FIG. 36 is a block diagram showing the construction of the PWM clock generator according to a sixth embodiment of the present invention.

FIG. 36 is a block diagram showing the construction of the PWM clock generator 5 of the fifth embodiment of the present invention.

In FIG. 36, numerals $\mathbf{210}_{-0}$ to $\mathbf{210}_{-3}$ and $\mathbf{210}_{-2046}$ to $\mathbf{210}_{-2048}$ denote D-flip-flops; numeral 211 denotes selectors; and numeral 212 denotes a memory such as a mask ROM in which predetermined data is written in advance.

In FIG. 36, the PWM clock (PCLK) is generated as follows.

Initially, the respective selectors 211 are connected to the contact b side by a load signal (not shown), and data from the memory 212 such as a mask ROM is loaded onto the D-flip-flops $\mathbf{210}_{-0}$ to $\mathbf{210}_{-3}$ and $\mathbf{210}_{-2046}$ to $\mathbf{210}_{-2048}$. Thus, the 1-bit data are loaded onto the respective flip-flops, and the selectors 211 are connected to the contact a side. Then, the data are sequentially outputted from the D-flip-flop $\mathbf{210}_{-0}$ to $\mathbf{210}_{-3}$, and from $\mathbf{210}_{-2046}$ to $\mathbf{210}_{-2048}$, as PWM clocks (PCLKs), by the n clock (nPCLK). Note that the data stored in the memory 211 such as a mask ROM is the same as that shown in FIG. 32. The memory 211 such as a mask ROM has addresses from "0" to "2048" corresponding to the D-flip-flops $\mathbf{210}_{-0}$ to $\mathbf{210}_{-3}$ and $\mathbf{210}_{-2046}$ to $\mathbf{210}_{-2048}$. As the output PWM clocks (PCLKs) are the same as those in the above-described fifth embodiment, a luminance conversion characteristic similar to that in the fifth embodiment is obtained.

As described above, according to the sixth embodiment, an image can be displayed with excellent tonality, similarly to the fifth embodiment. Especially, sufficient tonality can be obtained in a dark image portion where a problem occurs in the conventional art.

Further, in comparison with the fifth embodiment, as the counter 202 can be omitted, the luminance conversion can be realized with minimal hardware construction. Especially, as the circuit construction omits the counter 202 and its internal address decoder (not shown), the construction is applicable to an IC.

<First Modification>

Next, a first modification to the fifth embodiment will be described in detail below. As the constituents of the modification are the same as those of the above-described fifth embodiment except the construction of the PWM clock generator 5, explanations of those constituents will be omitted.

Figures 37, 38:
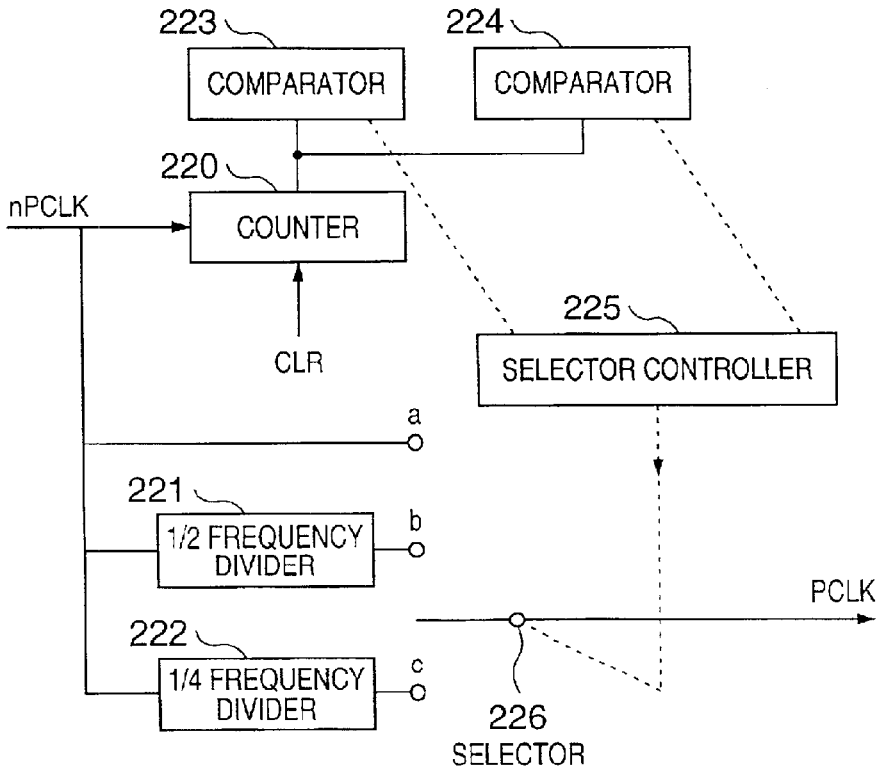
FIG. 37 is a block diagram showing the construction of the PWM clock generator according to a first modification.
FIG. 38 is a table explaining the operation of the PWM clock generator of the first modification.

FIG. 37 is a block diagram showing the construction of the PWM clock generator 5 according to the first modification.

In FIG. 37, numeral 220 denotes a counter; numeral 221 denotes a 1/2 frequency divider; numeral 222 denotes a 1/4 frequency divider; numerals 223 and 224 denote comparators; numeral 225 denotes a selector controller; and numeral 226 denotes a selector.

Hereinbelow, the operation of the PWM clock generator will be described. First, the counter 220 is reset by the CLR signal (not shown). Next, the counter 220 sequentially counts up by the n clock (nPCLK). The comparators 223 and 224 respectively compare set values (not shown) with the output value from the counter 220, and output the relationship between both of the values, as the result of the comparison. The selector controller 225 inputs the output signals from the comparators 223 and 224, and performs switching on the selector 226. On the other hand, the 1/2 frequency divider 221 and the 1/4 frequency divider 222 respectively frequency-divide the n clock (nPCLK). The selector 226 selects one of the n clock (nPCLK), the output from the 1/2 frequency divider 221 and that from the 1/4 frequency divider 222, and outputs the selected signal in accordance with the output from the selector controller 225. The selected output signal becomes the PWM clock (PCLK). FIG. 38 is a table showing the relation between the output values from the counter 220 and the frequency division ratios (output values from the frequency dividers 221 and 222) selected by the selector 226.

That is, the comparators 223 and 224 respectively compare the predetermined values "64" and "192" (decimal numbers) with the count value of the counter 220, and if the output value from the counter 220 is less than "64", the selector 226 selects a contact a and outputs a signal, having a frequency division ratio of 1/1, as the PWM clock (PCLK). If the count value of the counter 220 is "64" or greater and less than "192", the selector 226 selects a contact b and outputs a signal, having a frequency division ratio of 1/2, as the PWM clock (PCLK). Further, if the count value of the counter 220 is "192" or greater, the selector 226 selects a contact c and outputs a signal, having a frequency division ratio of 1/4, as the PWM clock (PCLK).

The actual n clock (nPCLK) is determined as follows. Similarly to the above-described fifth embodiment, to perform display based on an NTSC signal on the matrix image display panel 1 having 240 scanning lines, 480 of 485 interlaced available lines are overlap-driven for each field. That is, the display panel 1 is driven by an image signal for 240 scanning lines, of a frame frequency of 60 Hz. The period necessary for display for one scanning line is about 63.5 μsec, and about 56.5 μsec within the 1-scanning line display period is the maximum period of the drive pulse (X1 to X480). As "704" n clock (nPCLK) is required, the period of the n clock (nPCLK) is about 80 μsec, i.e., it has a frequency of about 12.5 MHz.

Figure 39:
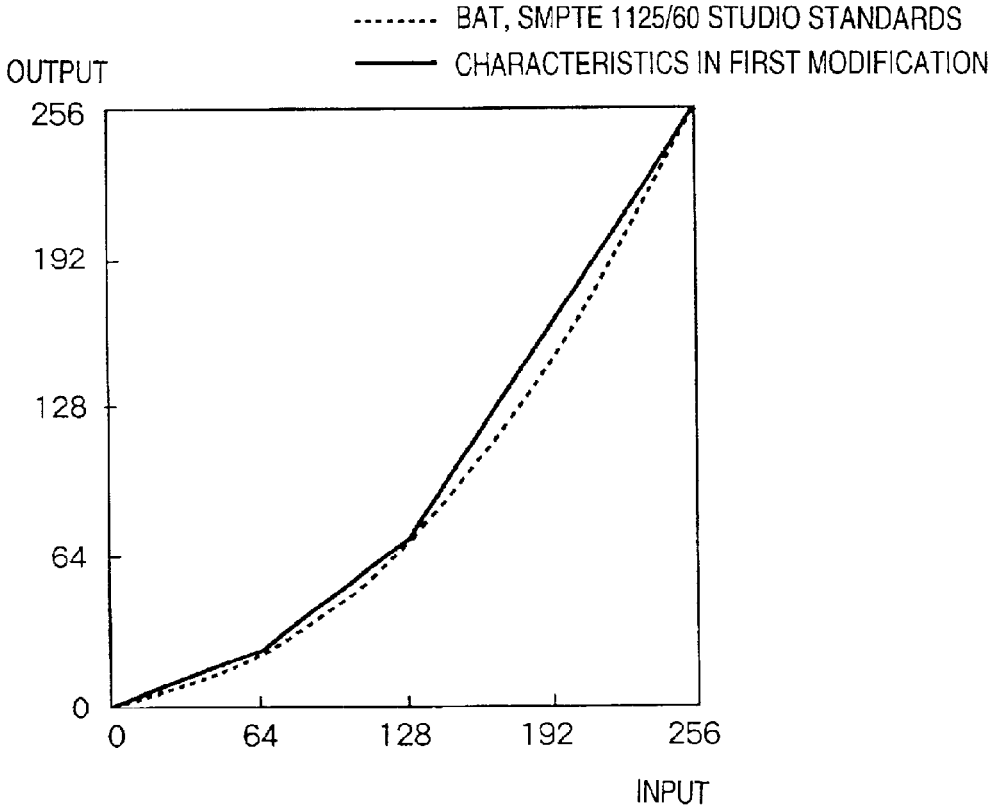
FIG. 39 is a line graph showing luminance output characteristic with respect to input data in the first modification.

In the present modification, similar to the above-described fifth embodiment, the modulation signal generator 6 outputs pulsewidth modulation signals having pulsewidths (since the pulsewidths are approximately proportional to the light emission luminance, they may be regarded as light emission luminance) respectively determined based on the PWM clocks (PCLKs) and input digital data. FIG. 39 shows the characteristic of the output signals.

FIG. 39 is a line graph showing the BTA, SMPTE 1125/60 standard γ-conversion characteristic (ideal values). As it is understood from the graph of FIG. 39, there is a difference between the characteristic of the pulsewidth modulation signals in the first modification and the characteristic of the ideal values.

<Second Modification>

Next, a second modification will be described. Since the constituents of the second modification are the same as those in the first modification except the number of frequency dividers 221, 222 and the like and that of the comparators 223, 224 and the like of the PWM clock generator 6, explanations of those constituents will be omitted.

Specifically, as shown in the relation between the counter values and the frequency division ratios in the second modification as shown in FIG. 40, the PWM clock generator 6 has six comparators which respectively compare the count value of the counter 220 with predetermined values "48", "112", "208", "368", "528" and "752" (decimal numbers), and one of the outputs from the frequency dividers is selected in accordance with the results of the comparison. That is, if the output from the counter 220 is less than "48", output having the frequency division ratio of 1/1 is selected as the PWM clock (PCLK). If the count value of the counter 220 is "48" or greater and less than "112", output having the frequency division ratio of 1/2 is selected as the PWM clock (PCLK). Further, if the count value of the counter 220 is "112" or greater and less than "208", output having a frequency division ratio of 1/3 is elected as the PWM clock (PCLK). If the count value of the counter 220 is "208" or greater and less than "368", output having the frequency division ratio of 1/4 is selected as the PWM clock (PCLK). If the count value of the counter 220 is "368" or greater and less than "528", output having a frequency division ratio of 1/5 is selected as the PWM clock (PCLK). If the count value of the counter 220 is "528" or greater and less than "752", output having a frequency division ratio of 1/6 is selected as the PWM clock (PCLK). Further, if the count value of the counter 220 is "752" or greater and less than "1030", the output having a frequency division ratio of 1/8 is selected as the PWM clock (PCLK).

The n clock (nPCLK) is determined as follows. Similarly to the above-described fifth embodiment, to perform display based on an NTSC signal on the matrix image display panel 1 having 240 scanning lines, 480 of 485 interlaced available lines are overlap-driven for each field. That is, the display panel 1 is driven by an image signal for 240 scanning lines, of a frame frequency of 60 Hz. In this case, the period necessary for display for one scanning line is about 63.6 μsec, and about 56.5 μsec within the 1-scanning line display period is the maximum period of the drive pulse (X1 to X480). As maximum "1030" n clock (nPCLK) is required, the period of the n clock (nPCLK) is about 55 μsec, i.e., it has a frequency of about 18 MHz.

Figure 41:
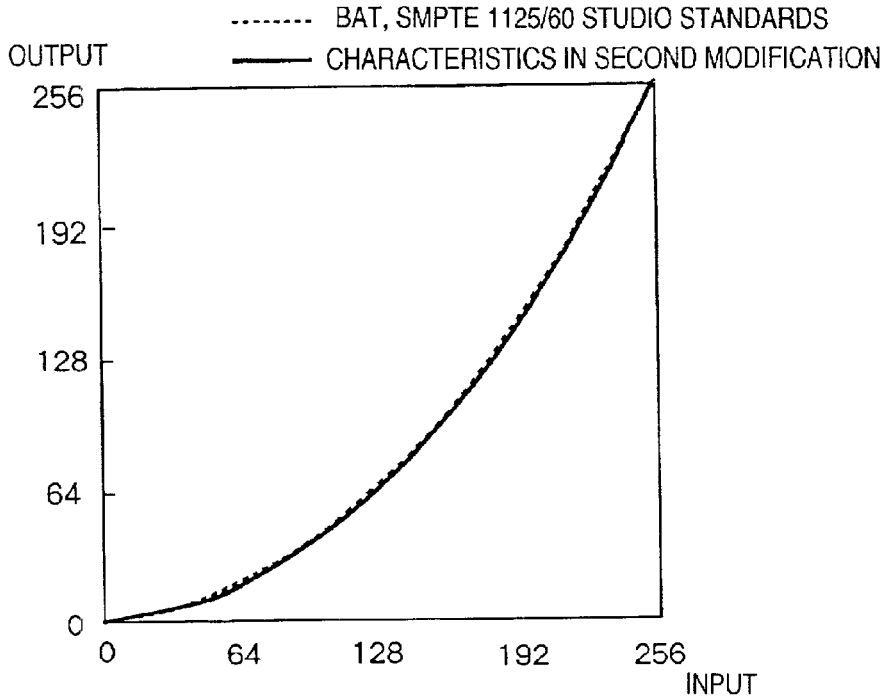
FIG. 41 is a line graph showing a luminance output characteristic with respect to input data in the second modification.

FIG. 41 shows the characteristic of the pulsewidths (since the pulsewidths are proportional to the light emission luminance, the pulsewidths may be regarded as light emission luminance), determined from the PWM clocks from the modulation signal generator 6 similar to that of the fifth embodiment, with respect to input digital data.

Figure 42:
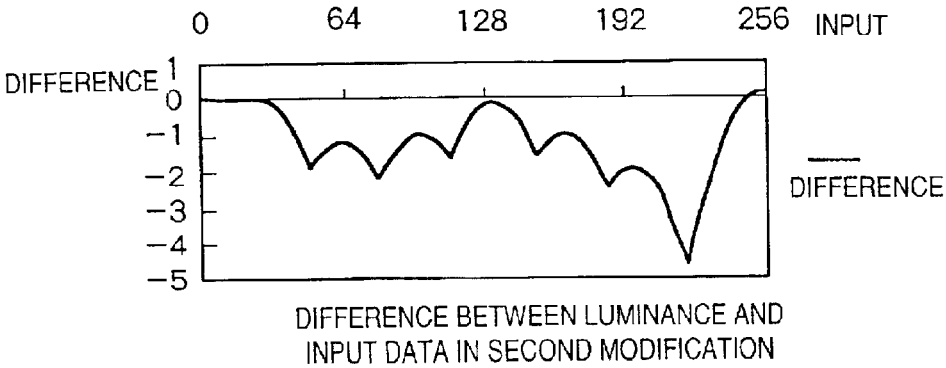
FIG. 42 is a line graph showing an enlarged part of FIG. 41, and a difference between the luminance and input data in the second modification.

FIG. 41 also shows the BTA, SMPTE 1125/60 studio standard γ-conversion characteristic (hereinafter referred to as "ideal values"). Since the difference between the characteristic in the present modification and that of the ideal values is very small and they cannot be easily distinguished from each other in the graph of FIG. 41, FIG. 42 shows an enlarged part of the differences between the γ-converted ideal values and luminance conversion in the second modification. As it is understood from the graphs of FIGS. 41 and 42, although there is a small amount of difference between the characteristic in the second modification and that of the ideal values, any degradation cannot be detected by subjective evaluation of a general TV screen. However, the number of frequency division ratios must be increased.

<Seventh Embodiment>

Next, a seventh embodiment of the present invention will be described below. Since the constituents of the seventh embodiment are the same as those of the above-described fifth embodiment except the PWM clock generator 5, explanations of those constituents will be omitted.

Figure 43:
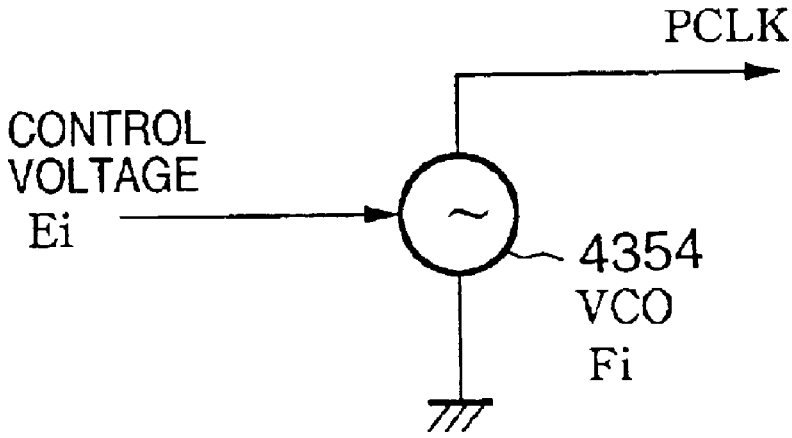
FIG. 43 is a block diagram showing the construction of the PWM clock generator according to a seventh embodiment of the present invention.

FIG. 43 is a block diagram showing the construction of the PWM clock generator 5 according to the seventh embodiment. Numeral 4354 denotes a voltage control oscillator (VCO).

In FIG. 43, the PWM clock (PCLK) outputted from the PWM clock generator 5 is output from an oscillator which outputs a signal having a frequency proportional to a control voltage Ei. That is, as an oscillation frequency Fi ("i" represents i-th clock) of the VCO 4354 that outputs the PWM clock (PCLK), $$Ei \propto Fi \tag{7}$$

At this time, as a period ti of the output signal from the VCO 4354 that outputs the PWM clock (PCLK), $$Fi = 1/ti \tag{8}$$

Then the both members of the expression (6) are differentiated as:

$$f(V)' \propto ti \tag{9}$$

("'" means differentiation)

Accordingly, from the expressions (7) to (9), the control voltage Ei is expressed as:

$$Ei \propto 1/(f(V)') \tag{10}$$

That is, the control voltage Ei is a voltage proportional to the reciprocal of the differentiated value from a desired luminance conversion table.

Similarly to the fifth embodiment, to perform display based on an NTSC signal on the matrix image display panel 1 having 240 scanning lines, 480 of 485 interlaced available lines are overlap-driven for each field. That is, the display panel 1 is driven by an image signal for 240 scanning lines, of a frame frequency of 60 Hz. In this case, the period necessary for display for one scanning line is about 63.6 μsec, and about 56.5 μsec within the 1-scanning line display period is the maximum period of PWM pulse. The control voltage Ei is determined on the condition of the equation (10). As a result, the period ti of the VCO 4354 that outputs the actual PWM clock (PCLK) changes from the period of about 55 nsec (about 18 MHz) to about 440 nsec (about 2.25 MHz).

As a result, an image can be displayed on the matrix image display panel 1 with excellent tonality representation. Especially, sufficient tonality representation (luminance resolution) can be obtained in a dark image portion where a problem occurs in the conventional art.

<Eighth Embodiment>

Next, an eighth embodiment of the present invention will be described. In the eighth embodiment, as an example of the luminance conversion, inverse γ correction and correction on an unsharpened rise of a waveform (e.g., luminance correction in a case where the rise time is about 1–2 μsec) are performed by setting the frequency of a clock for a pulsewidth setting.

As the constituents of the eighth embodiment are the same as those of the fifth embodiment except the data contents of the memory 203 such as a ROM in FIG. 31, explanations of those constituents will be omitted.

In the eighth embodiment, the respective pulsewidths are determined in accordance with the equations (3) and (4) described in the fifth embodiment. However, the expression (5) is replaced with the following expression, with a value Lfτ obtained by integrating luminance Lf(t) per unit time, obtained by a voltage actually applied to the cold cathode device at that time, by the pulsewidth τ:

$$Lf\tau \propto f(V) \tag{11}$$

to determine the period t.

The luminance per unit time, obtained by the voltage actually applied to the cold cathode device at that time, may be obtained by simply integrating an emission current value, obtained by the voltage actually applied to the cold cathode device at that time, by the pulsewidth τ (because the emission current value of the cold cathode device is approximately proportional to the luminance).

That is, assuming that the i-th PWM clock (PCLK) pulse period is ti, and the luminance per unit time, obtained by the voltage actually applied to the cold cathode device at that time, is Lfi, excellent inverse a conversion can be realized if the drive waveform of the matrix image display panel 1 is unsharp, by supplying the PWM clock (PCLK) which satisfies the following expression:

$$f(V) \cong 255 \times \left(\sum_{i=0}^{V} ti \times Lfi\right) \div \left(\sum_{i=0}^{255} ti \times Lfi\right) \tag{12}$$

(V and f(V) are normalized by 255 for the sake of simplicity)

In the eighth embodiment, similar to the seventh embodiment, the actual n clock (nPCLK) has a waveform of a period of about 27.5 nsec, i.e., it has a frequency of about 36 MHz, as shown in FIG. 7 if the first embodiment. The expression (101) is sequentially calculated to obtain the data contents of the memory 203 such as a ROM. FIG. 44 shows a table showing the addresses where the data value is "1", similar to the fifth embodiment.

In the eighth embodiment using the memory 203 such as a ROM holding the data as shown in FIG. 44, excellent inverse γ conversion can be performed, and similarly to the fifth embodiment, the tonality at low luminance levels is improved.

As a result, an image can be displayed with excellent tonality on the matrix image display panel 1. Especially, sufficient tonality (luminance resolution) can be obtained in a dark image portion where a problem occurs in the conventional art.

<Ninth Embodiment>

Next, a ninth embodiment of the present invention will be described in detail below. As the difference from the sixth embodiment resides in the difference in the data contents of the memory 212 such as a ROM in FIG. 36, and the other constituents are the same as those of the sixth embodiment, explanations of those constituents will be omitted.

In the ninth embodiment, the memory 212 such as a mask ROM has the same data as that in FIG. 44. The memory 212 such as a mask ROM has addresses from "0" to "2048" corresponding to the D-flip-flops $\mathbf{210}_{-0}$ to $\mathbf{210}_{-3}$ and $\mathbf{210}_{-2046}$ to $\mathbf{210}_{-2048}$. As the output PWM clocks (PCLKs) are the same as those in the eighth embodiment, the same luminance conversion characteristic as that in the eighth embodiment is obtained.

Further, similar to the eighth embodiment, an image, excellently inverse-γ converted, can be displayed on the matrix image display panel 1 with excellent tonality. Especially, sufficient tonality (luminance resolution) can be obtained in a dark image portion where a problem occurs in the conventional art.

Further, in comparison with the eighth embodiment, the counter 203 can be omitted, therefore, the luminance conversion can be realized with a smaller hardware construction. Especially, as the counter 203 and its internal address decoder (not shown) are omitted, the construction is applicable to an IC.

Further, in the eighth and ninth embodiments using the memory to generate a clock for a pulsewidth setting, it may be arranged such that the tonality representation characteristic can be determined in correspondence with a user's preference by providing plural sets of data in the memory 212 such as a mask ROM, and arbitrarily selecting by the user's setting or the like using a system controller (not shown) or the like. Further, the user is provided with an excellent image, with respect to an input image signal or an environment around the image display apparatus, by arranging such that the system controller (not shown) selects appropriate data from the plural sets of data in the memory such as a mask ROM, in accordance with the input image signal or environment around the image display apparatus (especially illumination).

<Other Embodiments>

[n Clock]

In some of the above-described embodiments, a frequency double of the clock frequency of the PWM clock (PCLK) is employed as the n clock (nPCLK), however, a frequency triple or quadruple of the clock frequency or other frequencies may be used. In such cases, as the clock frequency increases, the limitation on hardware design increases. However, the equation (2) holds with higher precision, and the tonality representation is further improved.

[Another Construction of Modulation Signal Generator 6]

Figure 17:
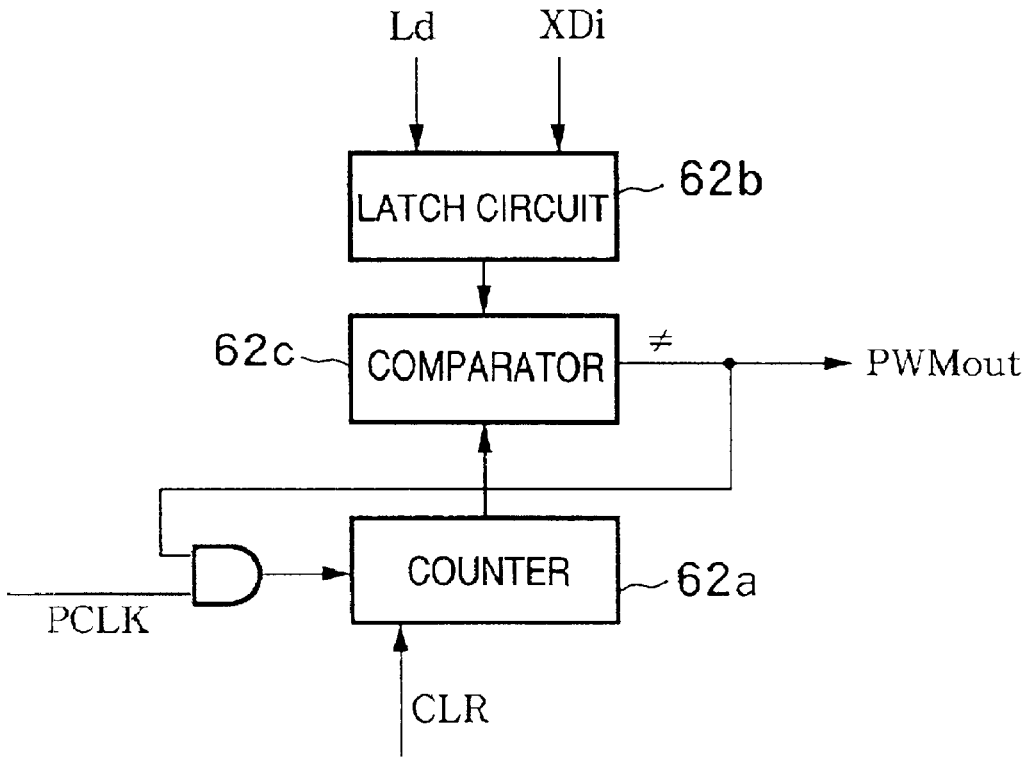
FIG. 17 is a block diagram showing the construction of the modulation signal generator according to another embodiment of the present invention.

In the respective above-described embodiments, the modulation signal generator 6 uses the down counter as shown in FIG. 2, however, the modulation signal generator 6 may be constructed with an up counter 62*a*, a comparator 62*c* and a latch circuit 62*b* as shown in FIG. 17.

Figure 18:
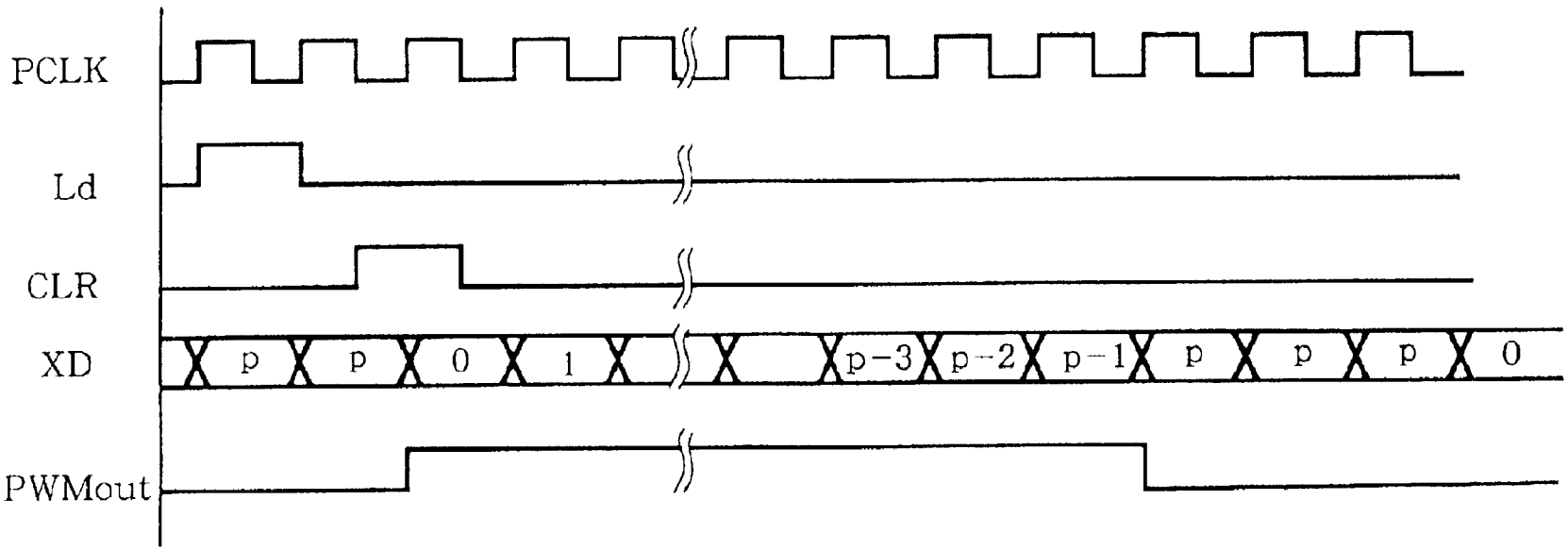
FIG. 18 is a timing chart showing the operation timing of the modulation signal generator in FIG. 17.

FIG. 18 is a timing chart showing the operation of the modulation signal generator 6 in the construction of FIG. 17.

In FIG. 17, the latch circuit 62*b* latches output digital data (XD1 to XD480) from the shift register 4 by the load signal (Ld). On the other hand, the up counter 62*a* counts up from "0" in synchronization with the fall of the PWM clock (PCLK). Then, the comparator 62*c* compares the value loaded by the latch circuit 62*b* with the count value of the counter 62*a*, while outputting a signal (PWMout) until these two values become the same. FIG. 18 shows the timing of the pulsewidth modulation output in a case where the latch 62*b* is set to a value "p". In this construction, it is possible to output a signal modulated by a pulsewidth determined by a period until the PWM clock (PCLK) count value becomes the value inputted from the shift register 4. This construction can be applied to the respective embodiments of the present invention. Further, the latch circuit may be replaced with a register.

(Method for Determining PWM Clock (PCLK) Pulsewidth)

Further, in the above-described embodiment, the pulsewidth of the PWM clock (PCLK) is determined based on the luminance of input image data. However, similar advantages can be obtained by determining the pulsewidth based on any other luminance-correlated parameter (e.g., the emission current value or device current value). This PWM signal determination method is applicable to the above-described embodiments of the present invention.

[γ Correction]

In the above-described embodiments, the γ correction is performed. However, for display on a CRT, for example, correction (inverse γ correction) to release or mitigate the γ correction on γ-corrected signal may preferably be adopted.

[Display Panel]

Further, in the embodiments of the present invention, the display panel is constructed with the cold cathode electron emission devices, however, the display panel may be constructed by other electron emission devices, or a construction which forms an image by using organic EL (electroluminescence) or the like, may be employed. Further, the cold-cathode electron beam source may comprise surface-conduction emission (SCI)-type electron emission devices or FE (Field Emission)-type electron emission devices, MIM (Metal/Insulator/Metal)-type electron emission devices or the like, without any problem.

The image display apparatus according to the embodiments of the present invention basically comprises a multiple electron beam source having a number of electron beam sources, e.g., cold cathode devices, arrayed on a substrate, and an image forming member which forms an image by electron emission, opposite to each other in a thin vacuum container.

Since these cold cathode devices can be formed while precisely positioned on a substrate by using a manufacturing technique such as a photolithography etching, a large number of devices can be arranged in a fine pitch. Further, in comparison with thermionic devices conventionally used in a CRT or the like, the cold cathode devices themselves and peripheral parts can be driven at a comparatively low temperature, therefore, a multiple electron beam source having electron beam sources arrayed in a finer pitch can be easily realized.

Further, the most preferable device among the cold cathode devices is surface-conduction type emission device (SCE). That is, among the cold cathode devices, the MIM-type device requires comparatively precise control of the thickness of an insulating layer and upper electrode. Further, in the FE-type device, the needle-like shape of the tip of an electron emitting portion must be precisely controlled. For these reasons, these devices increase manufacturing costs, or may cause difficulty in manufacturing a large-sized image display panel due to limitation on the manufacturing process. On the other hand, the SCE-type device has a simple structure and it can be easily manufactured, therefore, it can be used in a large-sized image display panel. In recent years, as large-sized and low-price display devices are especially needed, the SCE-type device is particularly preferable.

(Structure and Manufacture of Display Panel)

Next, the structure of the image display apparatus applied to the embodiments of the present invention and a method for manufacturing the image display apparatus will be described with a specific example.

Figure 19:
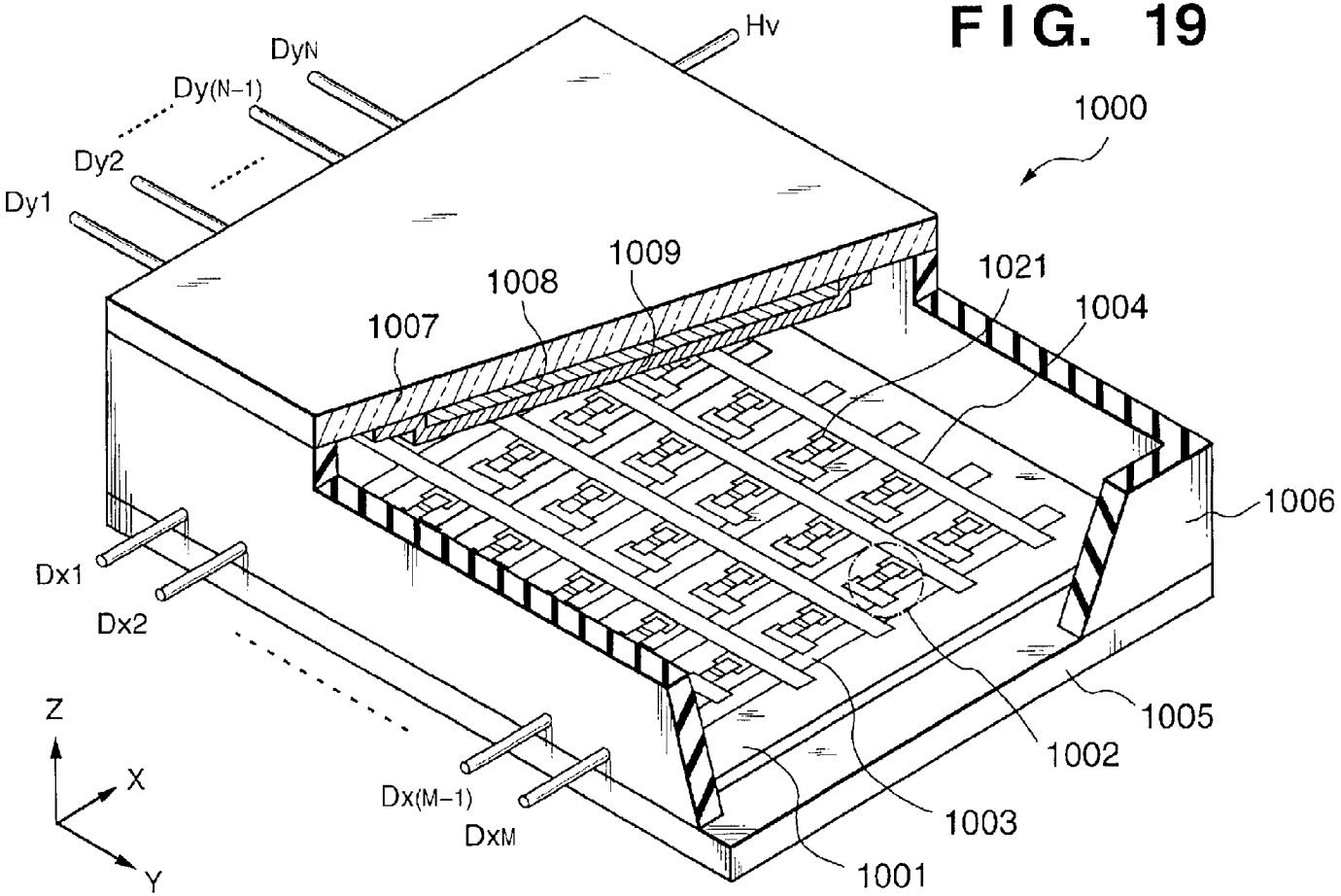
FIG. 19 is a perspective view, partially cut away, showing a display panel in an image display apparatus according to the embodiments of the present invention.

FIG. 19 is a perspective view of a display panel 1000 used in this example. A portion of the panel is cut away in order to illustrate the internal structure.

In FIG. 19, numeral 1005 denotes a rear plate; numeral 1006 denotes a side wall; and numeral 1007 denotes a face plate. An airtight container for maintaining a vacuum in the interior of the display panel is formed by the components 1005 to 1007. When assembling the airtight container, the joints between the members require to be sealed to maintain sufficient strength and air-tightness. For example, a seal is achieved by coating the joints with frit glass and carrying out calcination in the atmosphere or in a nitrogen atmosphere at a temperature of 400 to 500° C. for 10 min or more. The method of evacuating the interior of the airtight container will be described later.

A substrate 1001 is fixed to the rear plate 1005. N×M SCE-type devices 1002 are formed on the substrate 1001. (Here N and M are positive integers having a value of "2" or greater, and they can be appropriately set in accordance with a target number of display pixels. For example, in a display apparatus with the purpose of high-definition television display, the numbers N and M are preferably set to "3000" or greater and "1000" or greater, respectively. In this example, N=3072, M=1024 hold.) The N×M SCE-type devices 1002 are simply matrix-wired by M row-direction wires 1003 and N column-direction wires 1004. The portion constituted by the components 1001 to 1004 is referred to as a "multiple electron beam source". Note that the method of manufacturing the multiple electron beam source and the structure thereof will be described in detail later.

In this example, the substrate 1001 of the multiple electron beam source is fixed to the rear plate 1005 of the vacuum container. However, if the substrate 1001 of the multiple electron beam source has sufficient strength, the substrate 1001 itself may be used as the rear plate of the vacuum container.

Figure 20A:
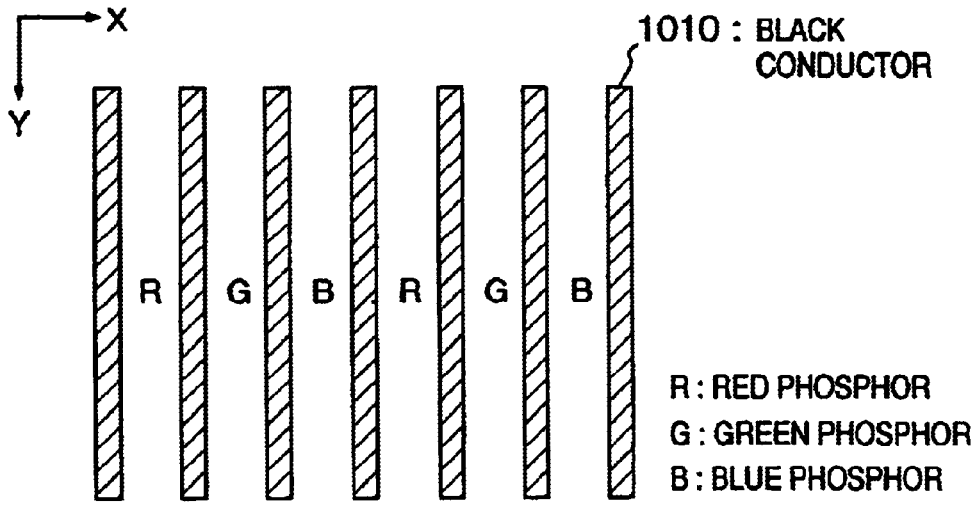
FIGS. 20A and 20B are plan views exemplifying phosphor arrays on a face plate of the display panel.

Further, a phosphor film 1008 is formed on the lower surface of the face plate 1007. Since the display panel 1000 of this example is used for color display, portions of the phosphor film 1008 are coated with phosphor of the three primary colors, red (R), green (G) and blue (B) used in the field of CRT technology. The phosphor of each color is applied in the form of stripes, as shown in FIG. 20A, and a black conductor 1010 is provided between the phosphor stripes. The black conductor 1010 is provided so as to prevent positional shift of the display colors even if there is some deviation in a position irradiated with an electron beam, or to prevent reduction of display contrast by preventing the reflection of external light, further to prevent the phosphor film from being charged up by the electron beam. Though the main ingredient used in the black conductor 1010 is graphite, any other material may be used as long as it attains the above-mentioned objects.

Figure 20B:
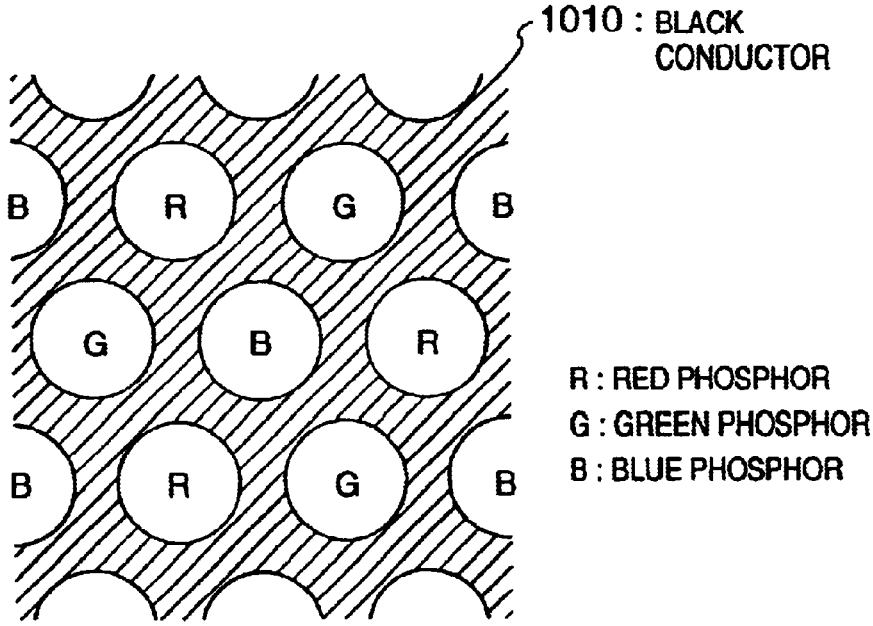

Further, the application of the phosphor of the three primary colors is not limited to the stripe-shaped array shown in FIG. 20A. For example, a delta-shaped array as shown in FIG. 20B, or another array may be adopted. Note that upon formation of a monochromatic display panel, single-color phosphor material may be used as the phosphor film 1008, and the black conductor material may not necessarily be used.

Further, a metal backing 1009, known in the field of CRT technology, is provided on the surface of the phosphor film 1008 on the rear plate side. The metal backing 1009 is provided so as to improve the utilization of light by reflecting part of the light emitted by the phosphor film 1008, to protect the phosphor film 1008 against damage due to collision by negative ions, to act as an electrode for applying an electron-beam acceleration voltage, and to act as a conduction path for the electrons that have excited the phosphor film 1008. The metal backing 1009 is provided by forming the phosphor film 1008 on the face plate substrate 1007, then subsequently smoothing the surface of the phosphor film, and vacuum-depositing aluminum on this surface. In a case where a phosphor material for low voltages is used as the phosphor film 1008, the metal backing 1009 is omitted.

Though not used in the example, transparent electrodes made of a material such as ITO (Indium Tin Oxide) may be provided between the face plate substrate 1007 and the phosphor film 1008, for application of electron-beam acceleration voltage or improvement in conductivity of the phosphor film.

Further, numerals Dx1 to Dxm, Dy1 to Dyn and Hv denote feed terminals, each having an air-tight structure, for connecting the display panel with electrical circuitry (not shown). The feed terminals Dx1 to Dxm are electrically connected to the row-direction wires 1003 of the multiple electron beam source, the feed terminals Dy1 to Dyn are electrically connected to the column-direction wires 1004 of the multiple electron beam source, and the terminal Hv is electrically connected to the metal backing 1009 of the face plate.

To evacuate the interior of the airtight container, an exhaust pipe and a vacuum pump (not shown) are connected after the airtight container is assembled, and the interior of the container is exhausted to a vacuum of $10^{-7}$ Torr. The exhaust pipe is then sealed. To maintain the degree of vacuum within airtight container, a getter film (not shown) is formed in a predetermined position in the airtight container immediately before or immediately after the pipe is sealed. The getter film is formed by heating a getter material, the main ingredient of which is Ba, for example, by a heater or high-frequency heating to deposit the material. A vacuum on the order of $1\times10^{-5}$ to $1\times10^{-7}$ Torr is maintained inside the airtight container by the adsorbing action of the getter film.

The foregoing is a description of the basic construction and method of manufacture of the display panel 1000 according to this example.

Next, the method of manufacturing the multiple electron beam source used in the display panel of the example will be described. As long as the multiple electron beam source used in the image display apparatus of the present example is an electron beam source in which cold cathode devices are wired in a matrix, there is no limitation upon the material, shape or method of manufacture of the cold cathode devices. However, the present inventors have found that among the surface-conduction type emission devices, an device, in which an electron emission portion or its peripheral part is formed of a fine particle film, provides excellent electron emission characteristic, and further, it can be easily manufactured. Accordingly, it is preferable to use such electron emission device in a multiple electron beam source of a high-luminance and large-size image display apparatus. In the example, the display panel uses an SCE-type device in which an electron emission portion or its peripheral part is formed of a fine particle film. Next, the basic structure, manufacture and characteristic of the preferred SCE-type device will be described, and thereafter, the structure of the multiple electron beam source in which a number of devices are simply matrix-wired will be described.

(Preferred Device Structure of SCE-type Device and Manufacture Thereof)

As two typical SCE-type device structures, planar-type and step-type device structures are available as SCE-type devices with the electron emission portion or periphery thereof formed of a fine particle film.

(Planar-Type SCE-type Device)

Figure 21A:
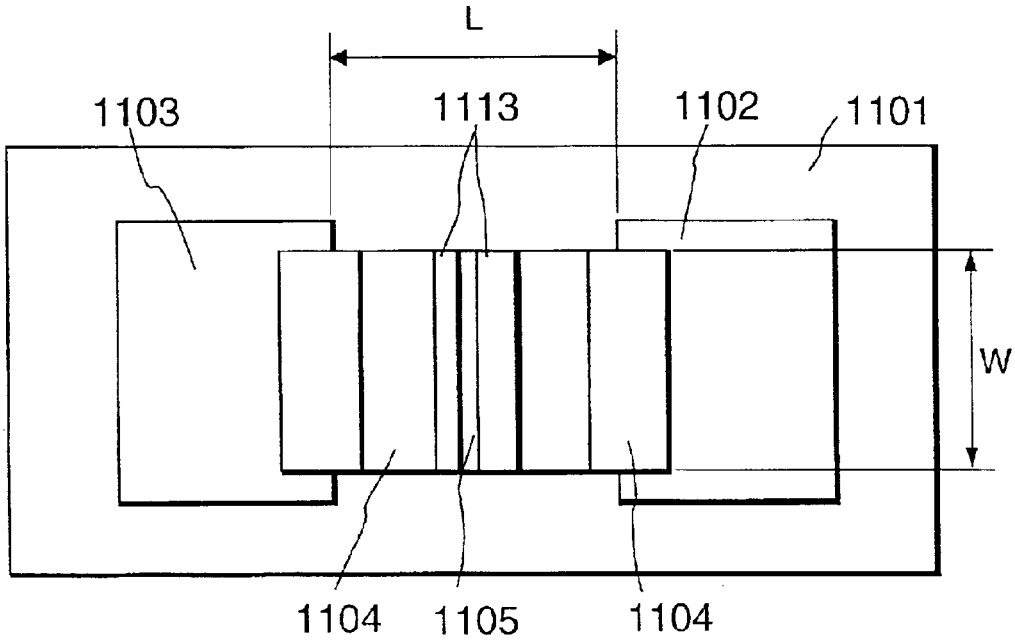
FIGS. 21A and 21B are a plan view and sectional view, respectively, of a planar-type surface-conduction type emission device used in the embodiments.
Figure 21B:
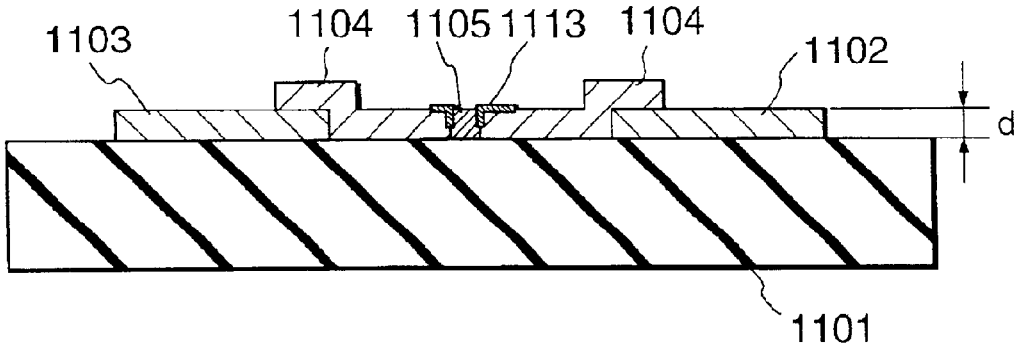

First, the structure and manufacture of the planar-type SCE-type device will be described. FIGS. 21A and 21B are a plan view and a sectional view for describing the structure of the planar-type SCE-type device. In these figures, numeral 1101 denotes a substrate; 1102 and 1103, device electrodes; 1104, a conductive thin film; 1105, an electron emission portion formed by an energization forming treatment; and 1113, a thin film formed by an electrification activation treatment.

Examples of the substrate 1101 are various glass substrates such as quartz glass and soda-lime glass, various ceramic substrates such as alumina, or a substrate obtained by depositing an insulating layer such as $SiO_2$ on the above-mentioned various substrates.

Further, the device electrodes 1102 and 1103, provided opposite to each other on the substrate 1101 in parallel with the substrate surface, are formed from conductive material. The electrons are formed by using material appropriately selected from the metals Ni, Cr, Au, Mo, W, Pt, Ti, Cu, Pd and Ag and the like or alloys of these metals, or metal oxides such as $In_2O_3$—$SnO_2$, and semiconductor materials such as polysilicon. To form the electrodes, a film manufacturing technique such as vacuum deposition and a patterning technique such as photolithography or etching may be used in combination. However, it is permissible to form the electrodes using another method (e.g., a printing technique).

The shapes of the device electrodes 1102 and 1103 are designed in correspondence with the application and purpose of the electron emission device. In general, the spacing L between the electrodes may be a suitable value selected from a range of several hundred angstroms to several hundred micrometers. Preferably, the range is on the order of several micrometers to several tens of micrometers in order for the device to be used in a display apparatus. With regard to the thickness d of the device electrodes, a suitable numerical value is selected from a range of several hundred angstroms to several micrometers.

A film of fine particles is used in the conductive thin film 1104. The fine particle film mentioned here means a film (including island-shaped aggregates) containing a large number of fine particles as structural devices. If the fine particle film is examined microscopically, usually the structure observed is one in which individual fine particles are arranged in spaced-apart relation, one in which the particles are adjacent to one another and one in which the particles overlap one another.

The particle diameter of the fine particles used in the fine particle film falls within a range of from several angstroms to several thousand angstroms, with the particularly preferred range being 10 to 200 angstroms. The film thickness of the fine particle film is appropriately selected in consideration of the following conditions: conditions necessary for achieving a good electrical connection between the device electrodes 1102 and 1103, conditions necessary for carrying out energization forming to be described later, and conditions necessary for obtaining a suitable value to be described later for the electrical resistance of the fine particle film and the like. More specifically, the film thickness is selected in the range of from several angstroms to several thousand angstroms, preferably 10 to 500 angstroms.

Examples of the material used to form the fine particle film are the metals such as Pd, Pt, Ru, Ag, Au, Ti, In, Cu, Cr, Fe, Zn, Sn, Ta, W and Pb, the oxides such as PdO, $SnO_2$, $In_2O_3$, PbO and $Sb_2O_3$, the borides such as $HfB_2$, $ZrB_2$, $LaB_6$, $CeB_6$, $YB_4$ and $GdB_4$, the carbides such as TiC, ZrC, HfC, TaC, SiC and WC, the nitrides such as TiN, ZrN and HfN, the semiconductors such as Si, and Ge, and carbon. The material may be selected appropriately from these materials.

As mentioned above, the conductive thin film 1104 is formed of a fine particle film. The sheet resistance is set so as to fall within the range of from $10^3$ to $10^7$ Ω/sq.

Since it is preferable that the conductive thin film 1104 is electrically connected with the device electrodes 1102 and 1103, the film and the device electrodes partially overlap each other. As for the method of achieving this overlap, the device is formed by depositing, from the bottom, the substrate, the device electrodes, and the conductive film, as shown in FIG. 21B. Depending upon the case, the device may be formed by depositing, from the bottom, the substrate, the conductive film, and the device electrodes.

The electron emission portion 1105 is a fissure-shaped portion formed in a part of the conductive thin film 1104 and, electrically, it has a resistance higher than that of the surrounding conductive thin film. The fissure is formed by subjecting the conductive thin film 1104 to an energization forming treatment to be described later. Fine particles having a particle diameter of several angstroms to several hundred angstroms may be placed inside the fissure. Note that since it is difficult to illustrate, finely and accurately, the actual position and shape of the electron emission portion, FIGS. 21A and 21B only provide schematic illustration.

The thin film 1113 comprises carbon or a carbon compound and covers the electron emission portion 1105 and its vicinity. The thin film 1113 is formed by performing an electrification activation treatment to be described later, after the energization forming treatment.

The thin film 1113 is one or a mixture of single-crystal graphite, polycrystalline graphite or amorphous carbon. The film thickness preferably is 500 Å or less, or more preferably, 300 Å or less. Note that since it is difficult to precisely illustrate the actual position and shape of the thin film 1113, FIGS. 21A and 21B only provide schematic illustration. Further, the plan view of FIG. 21A shows the device where a part of the thin film 1113 is removed.

The desired basic construction of the device has been described. In the present example, the device is constructed as follows. That is, soda-lime glass is used as the substrate 1101, and a Ni thin film is used as the device electrodes 1102 and 1103. The thickness d of the device electrodes is 1000 Å, and the electrode spacing L was 2 μm. Pd or PdO is used as the main ingredient of the fine particle film. The thickness of the fine particle film is about 100 Å, and the width W was 100 μm.

The method of manufacturing the preferred planar-type of the SCE-type device will be described. FIGS. 22A to 22D are cross-sectional views for explaining the process steps for manufacturing the SCE-type device. The respective parts similar to those in FIGS. 21*a* and 21B have the same reference numerals.

Figure 22A:
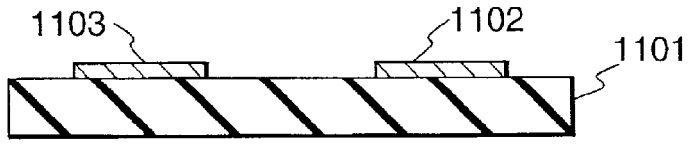
FIGS. 22A to 22E are sectional views showing steps for manufacturing the planar-type surface-conduction type emission device.

(1) First, the device electrodes 1102 and 1103 are formed on the substrate 1101, as shown in FIG. 22A. To form these electrodes, the substrate 1101 is cleaned sufficiently using a detergent, pure water or an organic solvent in advance, then the device electrode material is deposited (an example of the deposition method used is a vacuum film forming technique such as vapor deposition or sputtering). Thereafter, the deposited electrode material is patterned using photolithography, to form the pair of electrodes 1102 and 1103 shown in FIG. 22A.

Figure 22B:
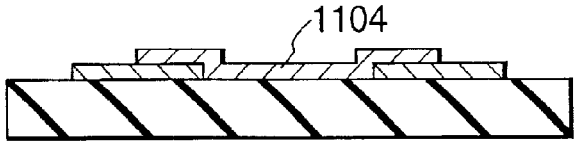

(2) Next, the conductive thin film 1104 is formed as shown in FIG. 22B. To form the conductive thin film 1104, the substrate in FIG. 22A is coated with an organic metal solution, then dried, and heating and calcination treatments are applied to form a fine particle film. Patterning is then performed by photolithographic etching to obtain a predetermined shape. The organic metal solution is a solution of an organic metal compound including the material of the fine particles used in the conductive film as the main element. (Specifically, Pd is used as the main element in this example. Further, the dipping method is employed as the method of application in this example, however, other methods, e.g., the spinner method and spray method may be used.)

Further, as the method of forming the conductive thin film made of fine particle film, other methods such as vacuum deposition and sputtering or chemical vapor deposition, rather than the method of applying the organic metal solution may be used in this example.

Figure 22C:
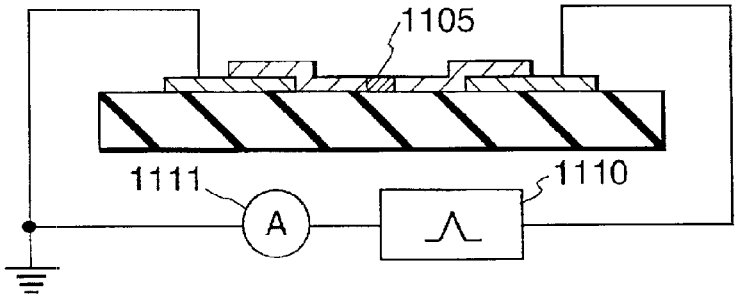

(3) Next, as shown in FIG. 22C, an appropriate voltage is applied between the device electrodes 1102 and 1103 from a forming power supply 1110, whereby an energization forming treatment is performed to form the electron emission portion 1105.

The energization forming treatment includes passing a current through the conductive thin film 1104 of the fine particle film, to locally destroy, deform or change the property of this portion, thereby obtaining a structure ideal for performing electron emission. At the portion of the electrically conductive film of the fine particle film, changed to a structure ideal for electron emission (i.e., the electron emission portion 1105), a fissure suitable for a thin film is formed. In comparison with the situation prior to formation of the electron emission portion 1105, the electrical resistance measured between the device electrodes 1102 and 1103 after formation has greatly increased.

Figure 23:
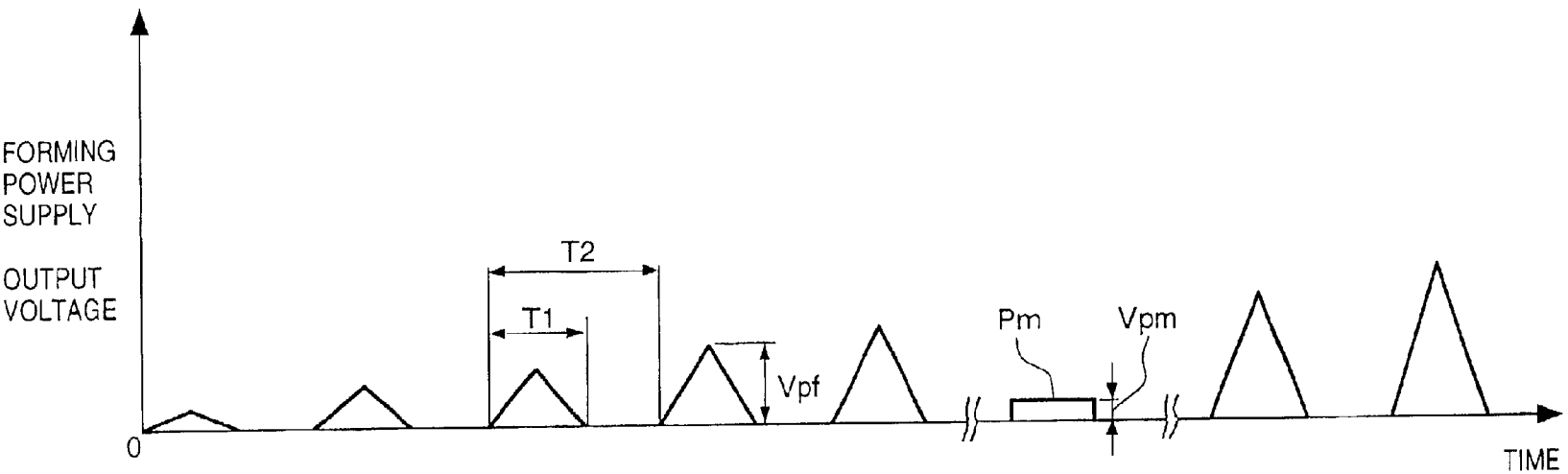
FIG. 23 is a graph showing an applied voltage waveform at the time of an energization forming treatment.

To describe the electrification method in more detail, an example of an appropriate voltage waveform supplied from the forming power supply 1110 is shown in FIG. 23. In a case where the conductive film made of the fine particle film is subjected to forming, a pulse voltage is preferred. In this example, triangular pulses having a pulse width T1 were applied consecutively at a pulse interval T2, as illustrated in the FIG. 23. At this time, the peak value Vpf of the triangular pulses was gradually increased. A monitoring pulse Pm for monitoring the formation of the electron emission portion 1105 was inserted between the triangular pulses at appropriate intervals and the current which flows at that time was measured by an ammeter 1111.

In this example, under a vacuum of $10^{-5}$ Torr, for example, the pulse width T1 is 1 msec and pulse interval T2 is 10 msec, respectively, and the peak voltage Vpf was elevated at increments of 0.1 V every pulse. The monitoring pulse Pm was inserted at every fifth application of the triangular pulse. The voltage Vpm of the monitoring pulses is 0.1 V such that the forming treatment would not be adversely affected. Electrification applied for the forming treatment was terminated when the resistance between the terminal electrodes 1102, 1103 became $1\times10^6\Omega$, namely at the stage that the current measured by the ammeter 1111 at application of the monitoring pulse fell below $1\times10^{-7}$ A.

Note that the method described above is preferred in relation to the SCE-type device of this example. In a case where the material or film thickness of the fine particle film or the design of the SCE-type device such as the device-electrode spacing L is changed, it is desirable that the conditions of electrification is appropriately changed.

Figure 22D:
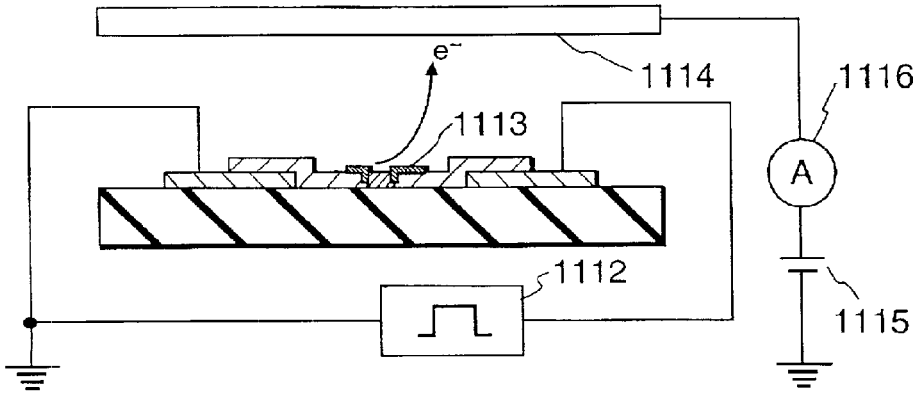

(4) Next, as shown in FIG. 22D, an appropriate voltage from an activating power supply 1112 is applied between the device electrodes 1102 and 1103 to perform an electrification activation treatment, thereby improving the electron emission characteristic. This electrification activation treatment involves subjecting the electron emission portion 1105, which has been formed by the above-described energization forming treatment, to electrification under appropriate conditions and depositing carbon or a carbon compound in the vicinity of this portion. (In this figure, the deposit consisting of carbon or a carbon compound is illustrated schematically as a member 1113.) By this electrification activation treatment, the emission current can be typically increased by more than 100 times, at the same applied voltage, in comparison with the current before application of the treatment.

More specifically, by periodically applying voltage pulses in a vacuum ranging from $10^{-4}$ to $10^{-5}$ Torr, carbon or a carbon compound in which an organic compound present in the vacuum serves as the source is deposited. The deposit 1113 is one or a mixture of single-crystal graphite, polycrystalline graphite or amorphous carbon. The film thickness is less than 500 Å, preferably less than 300 Å.

Figure 24A:
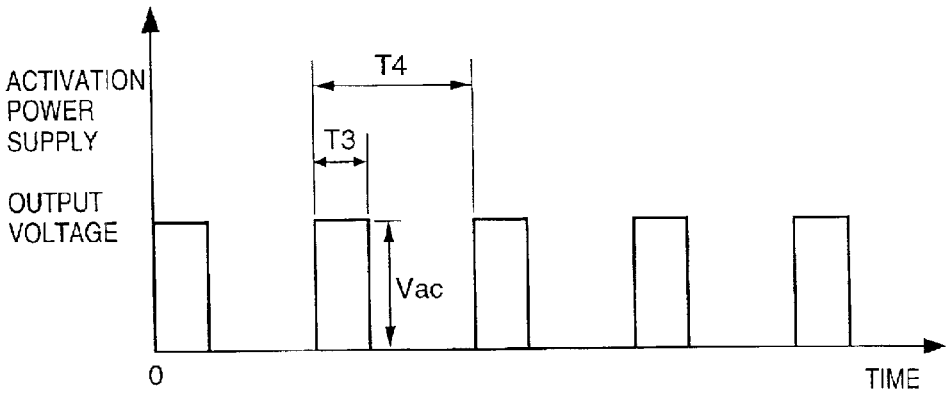
FIGS. 24A and 24B are graphs showing an applied voltage waveform and a change in emission current Ie, respectively, at the time of an electrification activation treatment.

To describe the electrification method for activation in more detail, an example of a suitable waveform supplied by the activation power supply 1112 is illustrated in FIG. 24A. In this example, the electrification activation treatment is conducted by periodically applying rectangular waves of a fixed voltage. More specifically, the voltage Vac of the rectangular waves is 14 V, the pulse width T3 is 1 msec, and the pulse interval T4 is 10 msec. The electrification conditions for activation mentioned above are desirable conditions in relation to the SCE-type device of this example. In a case where the design of the SCE-type device is changed, it is desirable that the conditions are appropriately changed.

Figure 24B:
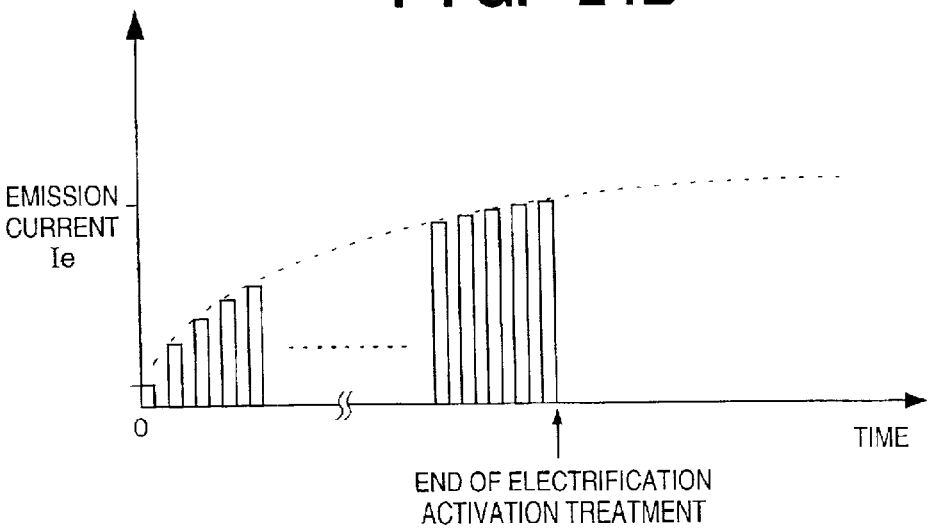

In FIG. 22D, numeral 1114 denotes an anode electrode for capturing the emission current Ie obtained from the SCE-type device. The anode electrode is connected to a DC high-voltage power supply 1115 and to an ammeter 1116. (In a case where the activation treatment is performed after the substrate 1101 is installed in the display panel, the phosphor surface of the display panel is used as the anode electrode 1114.) During the time that the voltage is being supplied from the activation power supply 1112, the emission current Ie is measured by the ammeter 1116 to monitor the progress of the electrification activation treatment, and the operation of the activation power supply 1112 is controlled. FIG. 24B shows an example of the emission current Ie measured by the ammeter 1116. When application of the pulse voltage starts, from the activation power supply 1112, the emission current Ie increases with the passage of time but eventually saturates and then almost does not increase. At the point where the emission current Ie thus substantially saturates, the application of voltage from the activation power supply 1112 is stopped, and the activation treatment by electrification is terminated.

Note that the above-mentioned electrification conditions are desirable conditions in relation to the SCE-type device of this example. In a case where the design of the SCE-type device is changed, it is desirable that the conditions are arbitrarily changed.

Figure 22E:
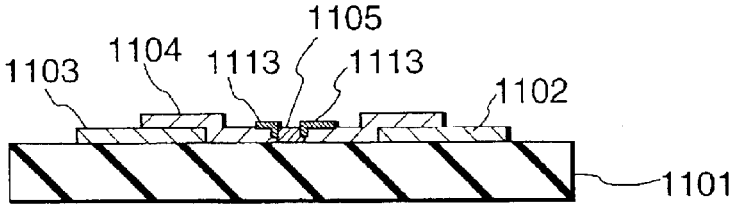

Thus, the planar-type SCE-type device shown in FIG. 22E is manufactured as set forth above.

(Step-Type SCE-type Device)

Next, one more typical structure of SCE-type device in which the electron emission portion or its periphery is formed of a fine particle film, namely the construction of a step-type SCE-type device, will be described.

Figure 25:
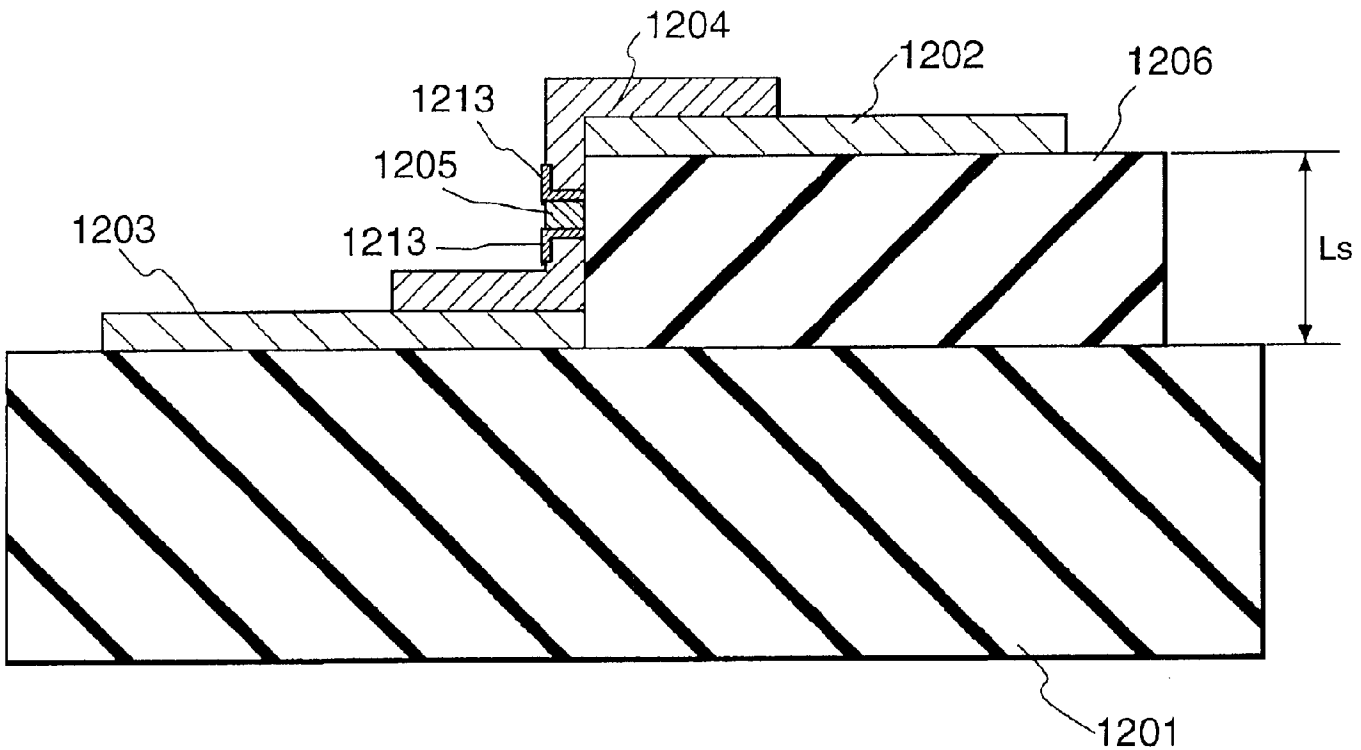
FIG. 25 is a cross-sectional view of a step-type surface-conduction type emission device used in the embodiments.

FIG. 25 is a schematic cross-sectional view for explaining the basic construction of the step-type device of the present example. Numeral 1201 denotes a substrate; 1202 and 1203, device electrodes; 1206, a step forming member; 1204, an conductive thin film using a fine particle film; 1205, an electron emission portion formed by an energization forming treatment; and 1213, a thin film formed by an electrification activation treatment.

The step-type device differs from the planar-type device in that one device electrode (1202) is provided on the step forming member 1206, and in that the electrically conductive thin film 1204 covers the side surface of the step forming member 1206. Accordingly, the device-electrode spacing L in the planar-type SCE-type device shown in FIG. 21A is set as the height Ls of the step forming member 1206 in the step-type device. The substrate 1201, the device electrodes 1202, 1203 and the conductive thin film 1204 using the fine particle film may be the same materials mentioned in the description of planar-type device. An insulating material such as $SiO_2$ is used as the step forming member 1206.

Next, the method of manufacturing the step-type SCE-type device will now be described. FIGS. 26A to 26F are cross-sectional views for explaining the manufacturing steps. The reference characters of the various members are the same as those in FIG. 25.

Figure 26A:
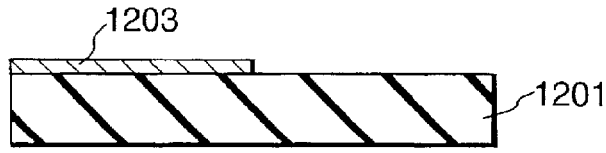
FIGS. 26A to 26F are cross-sectional views showing steps for manufacturing the step-type surface-conduction type emission device.

(1) First, the device electrode 1203 is formed on the substrate 1201, as shown in FIG. 26A.

Figure 26B:
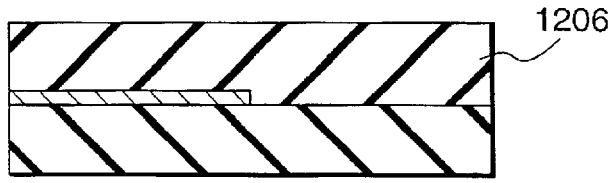

(2) Next, an insulating layer for forming the step forming member is deposited, as shown in FIG. 26B. The insulating layer is formed by depositing $SiO_2$ using the sputtering method. However, other film forming methods such as vacuum deposition or printing may be used.

Figure 26C:
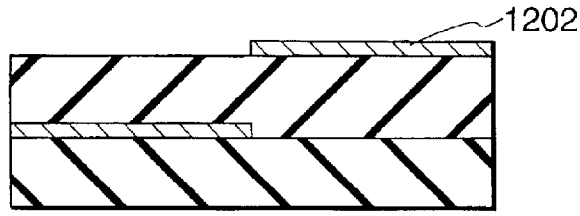

(3) Next, the device electrode 1202 is formed on the insulating layer, as shown in FIG. 26C.

Figure 26D:
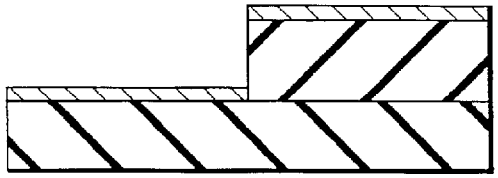

(4) Next, a part of the insulating layer is removed as by an etching process, thereby exposing the device electrode 1203, as shown in FIG. 26D.

Figure 26E:
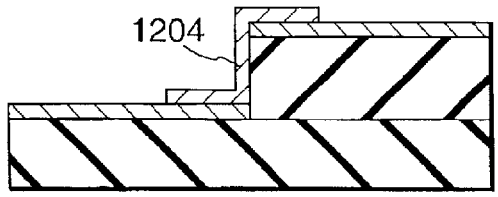

(5) Next, the conductive thin film 1204 using the fine particle film is formed, as shown in FIG. 26E. To form the electrically conductive thin film, a film forming technique such as painting is used as in the case of the planar-type device.

(6) Next, an energization forming treatment is performed as in the case of the planar-type device, thereby forming the electron emission portion. (A treatment similar to the planar-type energization forming treatment described using FIG. 22C may be used.)

(7) Next, as in the case of the planar-type device, the electrification activation treatment is performed to deposit carbon or a carbon compound on the vicinity of the electron emission portion. (A treatment similar to the planar-type electrification activation treatment described using FIG. 22D may be used.)

Figure 26F:
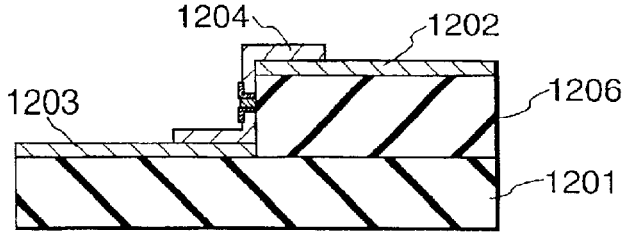

Thus, the step-type SCE-type device shown in FIG. 26F is manufactured as set forth above.

(Characteristics of SCE-Type Device Used in Display Apparatus)

The device construction and method of manufacturing the planar-type and step-type SCE-type devices have been described above. Next, the characteristics of these devices used in a display apparatus will now be described.

Figure 27:
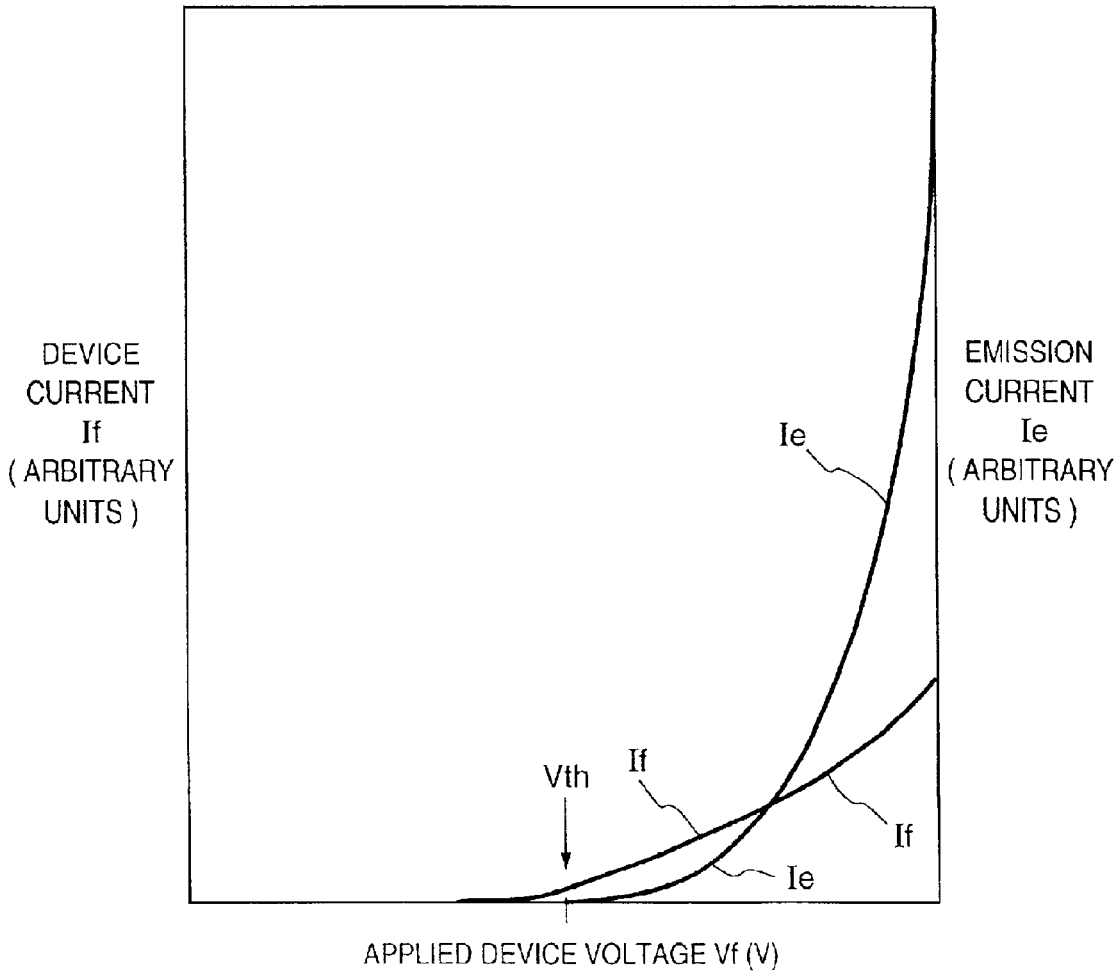
FIG. 27 is a line graph showing typical characteristics of the surface-conduction type emission device used in the embodiments.

FIG. 27 shows a typical example of an (emission current Ie) with respect to (applied device voltage Vf) characteristic and of an (device current If) with respect to (applied device voltage Vf) characteristic of the devices used in a display apparatus. Note that the emission current Ie is so much smaller than the device current If that it is difficult to use the same scale to illustrate it. Moreover, these characteristics are changed by changing the design parameters such as the size and shape of the devices. Accordingly, the two curves in the graph are each illustrated using arbitrary units.

The devices used in this display apparatus have the following three features in relation to the emission current Ie:

First, when a voltage greater than a certain voltage (referred to as a "threshold voltage Vth") is applied to the device, the emission current Ie suddenly increases. On the other hand, when the applied voltage is less than the threshold voltage Vth, almost no emission current Ie is detected. In other words, the device is a non-linear device having the clearly defined threshold voltage Vth with respect to the emission current Ie.

Second, since the emission current Ie varies in dependence upon the voltage Vf applied to the device, the magnitude of the emission current Ie can be controlled by the voltage Vf.

Third, since the response speed of the current Ie emitted from the device is high in response to a change in the voltage Vf applied to the device, the amount of charge of the electron beam emitted from the device can be controlled by the length of time over which the voltage Vf is applied.

By virtue of the foregoing characteristics, the SCE-type devices are preferably used in a display apparatus. For example, in a display apparatus in which a number of devices are provided corresponding to pixels of a displayed screen, the display screen can be scanned sequentially for display by utilizing the first characteristic mentioned. More specifically, a voltage greater than the threshold voltage Vth is appropriately applied to driven devices in conformity with a desired light emission luminance, and a voltage less than the threshold voltage Vth is applied to devices that are in an unselected state. By sequentially switching over devices driven, the display screen can be scanned sequentially to present a display.

Further, the luminance of the light emission can be controlled by utilizing the second characteristic or third characteristic. This enables grayscale display.

(Structure of a Multiple Electron Beam Source Having a Number of Simply Matrix-wired Devices)

Next, the structure of a multiple electron beam source obtained by arraying the aforesaid SCE-type devices on a substrate and wiring the devices in the form of a simple matrix will be described.

Figure 28:
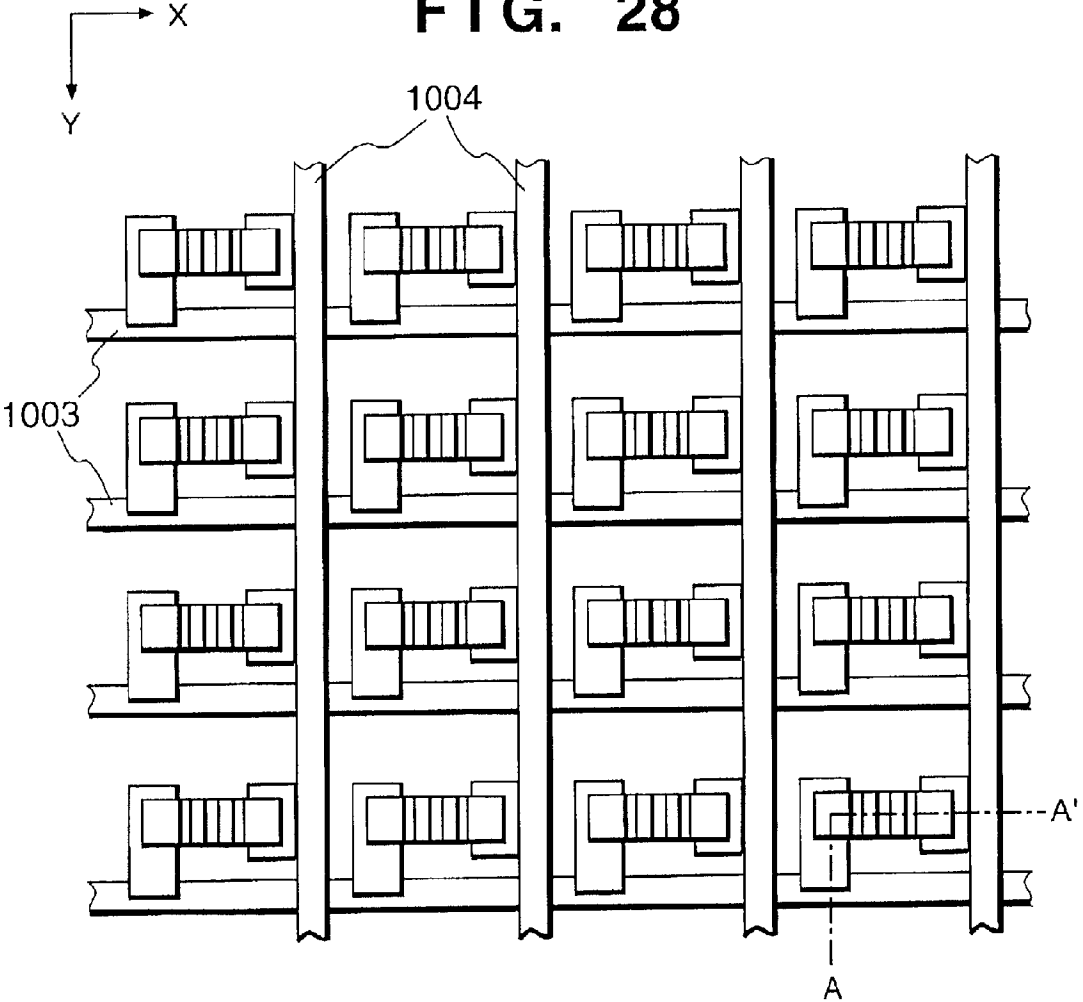
FIG. 28 is a plan view showing the substrate of a multiple electron beam source used in the embodiments.

FIG. 28 is a plan view of a multiple electron beam source used in the display panel 1000 of FIG. 19. Here SCE-type devices similar to those shown in FIGS. 21A and 21B are arrayed on the substrate and the devices are wired in the form of a matrix by the row-direction wiring electrodes 1003 and column-direction wiring electrodes 1104. An insulating layer (not shown) is formed between the electrodes at the portions where the row-direction wiring electrodes 1003 and column-direction wiring electrodes 1004 intersect, thereby maintaining electrical insulation between the electrodes.

Figure 29:
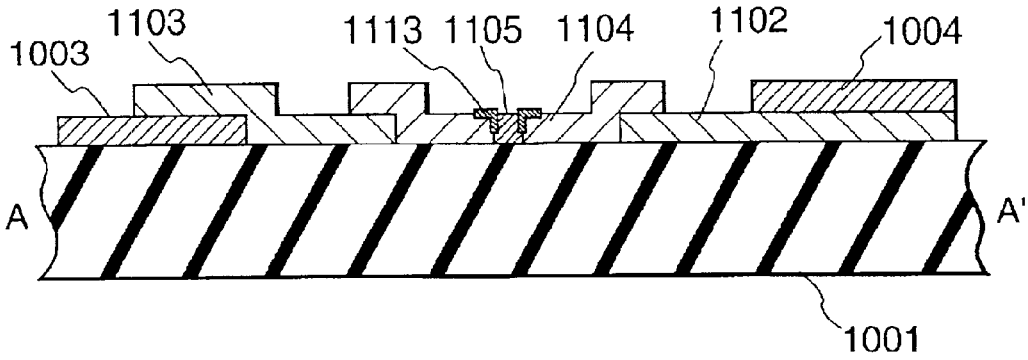
FIG. 29 is a partial cross-sectional view showing the substrate of a multiple electron beam source used in the embodiments.

FIG. 29 is a cross-sectional view cut along line A–A' of FIG. 28.

Note that the multiple electron beam source having this structure is manufactured by forming the row-direction wiring electrodes 1003, column-direction wiring electrodes 1004, inter-electrode insulating layer (not shown) and the device electrodes and electrically conductive thin film of the SCE-type devices on the substrate in advance, and then applying the energization forming treatment and electrification activation treatment by supplying current to each device via the row-direction wiring electrodes 1003 and column-direction wiring electrodes 1004.

Figure 30:
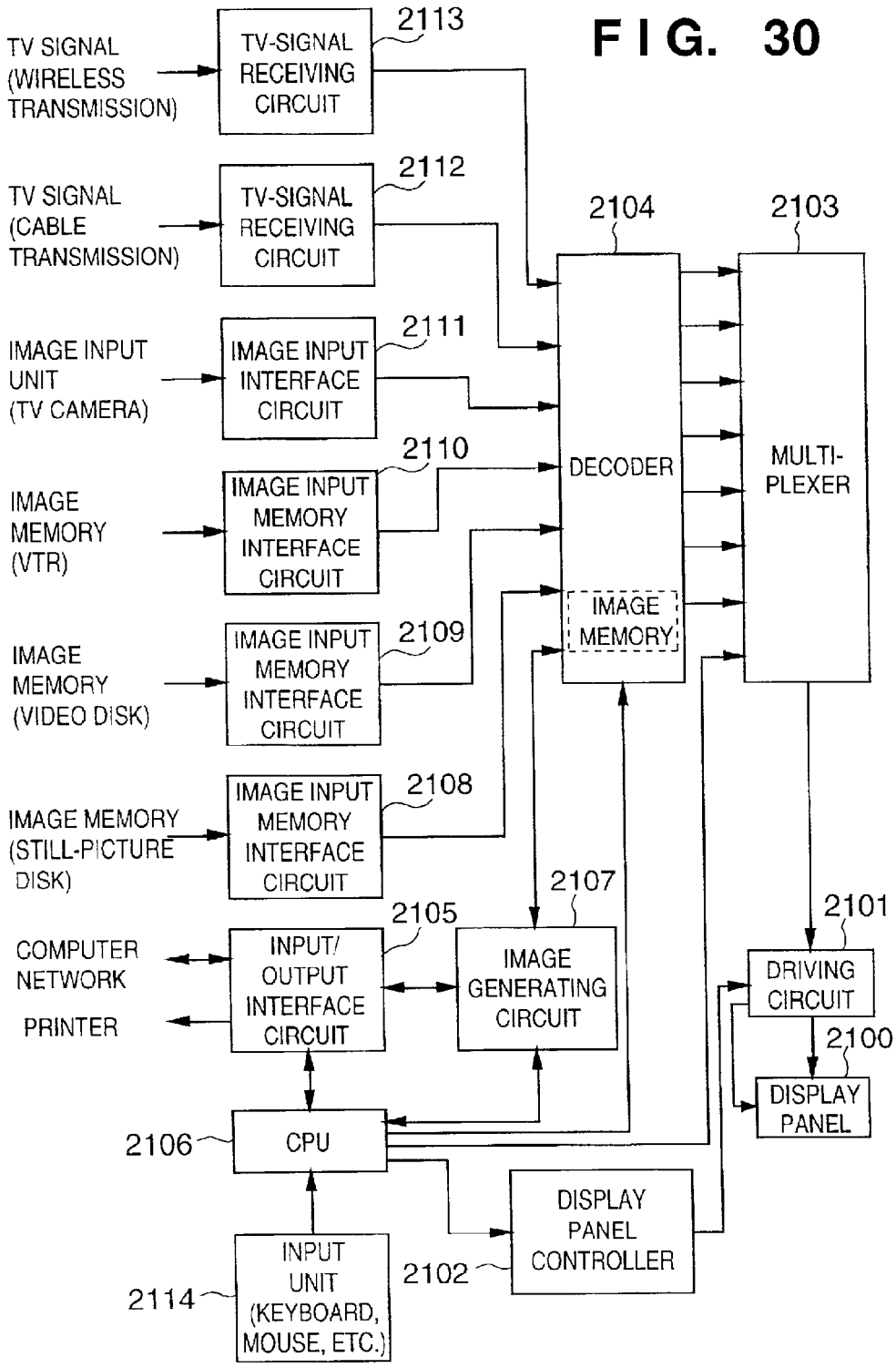
FIG. 30 is a block diagram showing a multifunctional image display apparatus according to the embodiments of the present invention.

FIG. 30 is a block diagram showing an example of a multifunctional display apparatus constructed to perform display based on image information supplied from various image information sources, the foremost of which is a television (TV) broadcast, on the display panel according to the above description. In FIG. 30, numeral 1000 denotes the display panel; numeral 2101 denotes a drive circuit for the display panel; numeral 2102 denotes a display controller; numeral 2103 denotes a multiplexer; numeral 2104 denotes a decoder; 2105, an input/output interface circuit; numeral 2106 denotes a CPU; numeral 2107 denotes an image forming circuit; numerals 2108 to 2110 denote image memory interface circuits; numeral 2111 denotes an image input interface circuit; numerals 2112 and 2113 denote TV-signal receiving circuits; and numeral 2114 denotes an input unit. Note that when the display apparatus of this example receives a signal containing both video information and audio information as a television signal, audio is of course reproduced at the same time that video is displayed. However, circuitry and speakers related to the reception, separation, reproduction, processing and storage of audio information not directly related to the features of this invention are not described.

The functions of the various units will be described in line with the flow of the image signal.

First, the TV-signal receiving circuit 2113 receives a TV image signal transmitted using a radio transmission system that relies upon radio waves, optical communication through space or the like. The system of the TV signals received is not particularly limited, but may be the NTSC system, PAL system and SECAM system and the like. A TV signal comprising a greater number of scanning lines (e.g., a so-called high definition TV signal such as one based on the MUSE system) is a preferable signal source for utilizing the advantages of the above-mentioned display panel appropriate to enlargement of screen area and to an increase in the number of pixels. The TV signal received by the TV-signal receiving circuit 2113 is outputted to the decoder 2104. The TV-signal receiving circuit 2112 receives a TV image signal transmitted by a cable transmission system using coaxial cable, optical fibers or the like. As in the case of the TV-signal receiving circuit 2113, the system of the received TV signal is not particularly limited. Further, the TV signal received by this circuit is also outputted to the decoder 2104.

The image input interface circuit 2111 inputs an image signal supplied by an image input unit such as a TV camera or image reading scanner. The input image signal is outputted to the decoder 2104. The image memory interface circuit 2110 inputs an image signal that has been stored in a video tape recorder (hereinafter abbreviated to VTR) and outputs the input image signal to the decoder 2104. The image memory interface circuit 2109 inputs an image signal that has been stored on a video disk and outputs the input image signal to the decoder 2104. The image memory interface circuit 2108 inputs an image signal from a device storing still picture data, such as a so-called still picture disk, and outputs the input still picture data to the decoder 2104.

The input/output interface circuit 2105 is a circuit for connecting the display apparatus to an external computer, computer network or output device such as a printer. The input/output interface circuit 2105 performs input/output of control signals and numerical data between the CPU 2106 in the display apparatus and an external unit, in accordance with necessity, as well as input/output of image data, character data and figure information.

The image generating circuit 2107 generates display image data based on image data and character/graphic information entered from the outside via the input/output interface circuit 2105 or based on image data character/graphic information outputted by the CPU 2106. For example, the circuit includes a circuit necessary for generating an image, such as a rewritable memory for storing image data or character/graphic information, a read-only memory in which image patterns corresponding to character codes have been stored, and a processor for executing image processing. The display image data generated by the image generating circuit 2107 is outputted to the decoder 2104. In certain cases, however, it is possible to input/output image data relative to an external computer network or printer via an input/output interface circuit 2105.

The CPU 2106 mainly controls the operation of the display apparatus and operations relating to the generation, selection and editing of display images. For example, the CPU outputs a control signal to the multiplexer 2103 to appropriately select or combine image signals displayed on the display panel. At this time, the CPU generates a control signal for the display panel controller 2102 in correspondence with the image signal displayed and appropriately controls the operation of the display apparatus, such as the frequency of the frame, the scanning method (interlaced or non-interlaced) and the number of screen scanning lines.

Further, the CPU directly outputs image data and character/graphic information to the image generating circuit 2107 or accesses the external computer or memory via the input/output interface circuit 2105 to input the image data or character/graphic information. It goes without saying that the CPU 2106 may also be used for these purposes. For example, the CPU may be directly applied to a function for generating and processing information, as in the manner of a personal computer or word processor. Alternatively, the CPU may be connected to an external computer network via the input/output interface circuit 2105, as mentioned above, so as to perform an operation such as numerical computation in cooperation with external equipment.

The input unit 2114 allows the user to input instructions, programs or data into the CPU 2106, using, e.g., a keyboard and mouse or various other input devices such as a joystick, bar code reader and voice recognition unit.

The decoder 2104 is a circuit for inversely converting various image signals, inputted from the circuits 2107 to 2113, into color signals of the three primary colors or a luminance signal and I, Q signals. It is desirable that the decoder 2104 be internally equipped with an image memory, as indicated by the dashed line, for the purpose of handling a television signal that requires an image memory when performing the inverse conversion, as in a MUSE system, by way of example. Further, the image memory is advantageous in that it facilitates display of a still picture, and in cooperation with the image generating circuit 2107 and CPU 2106, it facilitates editing and image processing such as thinning out of pixels, interpolation, enlargement, reduction and synthesis.

The multiplexer 2103 appropriately selects the display image based on a control signal inputted from the CPU 2106. That is, the multiplexer 2103 selects a desired image signal from the inversely-converted image signals which enter from the decoder 2104 and outputs the selected signal to the drive circuit 2101. In this case, by changing over and selecting the image signals within the display time of one screen, one screen can be divided into a plurality of areas and images which differ depending upon the area can be displayed as in a so-called split-screen television.

The display panel controller 2102 controls the operation of the drive circuit 2101 based on the control signal which enters from the CPU 2106. With regard to the basic operation of the display panel, a signal for controlling the operation sequence of a driving power supply (not shown) for the display panel is outputted to the drive circuit 2101. In relation to the method of driving the display panel, for example, a signal for controlling the frame frequency or scanning method (interlaced or non-interlaced) is outputted to the drive circuit 2101. Further, according to circumstances, a control signal relating to adjustment of picture quality, namely luminance of the display image, contrast, tone and sharpness, is outputted to the drive circuit 2101.

The drive circuit 2101 generates a drive signal applied to the display panel 1000 and operates based on the image signal inputted from the multiplexer 2103 and the control signal inputted from the display panel controller 2102.

The functions of the various units are as described above. By using the arrangement shown in FIG. 30, image information inputted from a variety of image information sources can be displayed on the display panel 1000 in the display apparatus of this example. That is, various image signals, including a television broadcast signal, are inversely converted in the decoder 2104, appropriately selected in the multiplexer 2103 and inputted into the drive circuit 2101. On the other hand, the display controller 2102 generates a control signal for controlling the operation of the drive circuit 2101 in accordance with the image signal for display. The drive circuit 2101 applies a drive signal to the display panel 1000 based on the aforesaid image signal and control signal. As a result, an image is displayed on the display panel 1000. This series of operations is made under the control of the CPU 2106.

Further, in the display apparatus of this example, the contribution of the image memory in the decoder 2104, the image generating circuit 2107 and CPU 2106 not only enables display of image information selected from a plurality of image information but also subjects the display image information to image processing such as enlargement, reduction, rotation, movement, edge enhancement, thinning, interpolation, color conversion and vertical-horizontal ratio conversion and to image editing such as combining, erasure, connection, substitution and insertion. Further, though not particularly described in this example, a special-purpose circuit for processing and editing may be provided with regard also to audio information in the same manner as the above-mentioned image processing and image editing.

Accordingly, the display apparatus of this example may have various functions such as the functions of TV broadcast display equipment, office terminal equipment such as television conference terminal equipment, image editing equipment for handling still pictures and moving pictures, computer terminal equipment and word processors, and game terminals, in a single unit. Thus, the display apparatus has wide application for industrial and private use.

Note that FIG. 30 merely shows an example of the construction of a multifunctional display apparatus using the display panel having SCE-type devices as electron beam sources, but the construction of the display apparatus is not limited to this arrangement. For example, circuits relating to functions not necessary for the particular purpose may be deleted from the structural devices of FIG. 30. Conversely, structural elements may be additionally provided depending upon purposes. For example, in a case where the display apparatus is used as a TV telephone, it would be ideal to add a transmitting/receiving circuit inclusive of a television camera, audio microphone, illumination equipment and modem to the structural elements.

In the present display apparatus, as a thin display panel especially having SCE-type devices as electron beam sources can be easily formed, the width of the entire display apparatus can be reduced. In addition, as the display panel having the SCE-type devices can have a large screen area, and has high luminance and excellent view angle characteristic, the display apparatus can display a vivid and dynamic image with excellent visibility.

As described above, according to the present example, the respective matrix-arrayed SCE-type devices are driven by a pulsewidth modulation signal corresponding to an image signal, and at that time, the light emission characteristic in a low luminance portion can be increased by setting the pulsewidth increment time of the pulsewidth modulation signal, with respect to the increment of one grayscale level before the pulsewave peak value of the driving wave stabilizes, to a longer period than the pulsewidth increment time after the stabilization of the pulsewave peak value.

Further, by determining a pulsewidth modulation period such that in an image signal, the amount of luminance variation with respect to the increment of one grayscale level is the same in each grayscale level, an image display apparatus which maintains excellent tonality at a low luminance level can be realized with an addition of a minimum amount of hardware.

Especially, in a large-sized matrix image display panel, its capacitance increases with an increase in wiring length, which may provide a further unsharp rise to the drive waveform. Such inconvenience can be solved by the apparatus and method of the present example.

As described above, according to the embodiments of the present invention, an image forming method and apparatus which form an image with luminance corresponding to input image data, with improved tonality representation can be provided.

Further, excellent tonality can be maintained especially at low luminance levels.

Further, input image data is pulsewidth-modulated, and in accordance with the modulated signal, an image corresponding to the grayscale of the image data can be formed.

Further, an image display can be made by outputting a signal pulsewidth-modulated by a clock signal having a frequency corresponding to the conversion characteristic of an image signal.

Further, according to the present invention, an image having required luminance resolution can be realized with a minimum-scaled hardware construction.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

a display panel adapted to display an image;

a pulse width modulation signal generator adapted to input digital data corresponding to the image and a clock signal, and to count pulses of the clock signal in correspondence with the digital data to generate a pulse width modulation signal for driving the display panel, wherein the pulse width modulation signal has a pulse width that corresponds to a number of pulses of the clock signal corresponding to a gray scale level of the image; and a clock generator adapted to generate the clock signal, wherein said clock generator is provided with a memory for storing a plurality of items of data and said clock generator is arranged to generate each pulse of the clock signal in accordance with one of the items of data read from the memory in synchronism with a reference clock signal.

2. The apparatus according to claim 1, wherein said clock generator comprises a counter for inputting and counting the reference clock signal to supply an address signal of the memory and a latch circuit for latching the data read from the memory in accordance with the address signal.

3. The apparatus according to claim 1, wherein said clock generator comprises a plurality of flip-flops connected in series for storing the data and outputting the data in series as the clock signal in synchronism with the reference clock signal.

4. The apparatus according to claim 1, further comprising a system controller for selecting the one of the plurality of items of data.

5. The apparatus according to claim 1, wherein the data is for performing an inverse gamma conversion.

6. The apparatus according to claim 1, wherein the data is for improving the tonality representation characteristics of image data at low luminance.

7. The apparatus according to claim 1, wherein said display panel comprises a vacuum container which accommodates a substrate on which a plurality of electron sources are provided and an image forming member for forming an image by electrons emitted by the plurality of electron sources.

* * * * *